US010246959B2

(12) United States Patent
Adam

(10) Patent No.: US 10,246,959 B2
(45) Date of Patent: Apr. 2, 2019

(54) DOWNHOLE TOOL ACTUATORS AND INDEXING MECHANISMS

(71) Applicant: TURBO DRILL INDUSTRIES, INC., Conroe, TX (US)

(72) Inventor: Mark Adam, Aberdeen (GB)

(73) Assignee: TURBO DRILL INDUSTRIES, INC., Conroe, TX (US)

( * ) Notice: Subject to any disclaimer, the term of this patent is extended or adjusted under 35 U.S.C. 154(b) by 0 days.

(21) Appl. No.: 15/953,441

(22) Filed: Apr. 14, 2018

(65) Prior Publication Data

US 2018/0298707 A1 Oct. 18, 2018

Related U.S. Application Data

(60) Provisional application No. 62/485,569, filed on Apr. 14, 2017.

(51) Int. Cl.

| | |
|---|---|
| ***E21B 23/00*** | (2006.01) |
| *E21B 34/00* | (2006.01) |
| *E21B 17/10* | (2006.01) |
| *E21B 34/14* | (2006.01) |

(52) U.S. Cl.

CPC ..... *E21B 23/00* (2013.01); *E21B 23/004* (2013.01); *E21B 17/1014* (2013.01); *E21B 34/14* (2013.01); *E21B 2034/007* (2013.01)

(58) Field of Classification Search

CPC ..... E21B 23/00; E21B 23/004

See application file for complete search history.

(56) References Cited

U.S. PATENT DOCUMENTS

| | | | |
|---|---|---|---|
| 6,289,999 | B1 | 9/2001 | Dewey et al. |
| 9,683,434 | B2 | 6/2017 | Machocki |
| 2004/0168832 | A1 | 9/2004 | Russell et al. |
| 2010/0252276 | A1 | 10/2010 | Clausen et al. |
| 2011/0073372 | A1 | 3/2011 | Prill et al. |
| 2011/0284233 | A1 | 11/2011 | Wu et al. |
| 2016/0130897 | A1 | 5/2016 | Machocki |
| 2016/0130910 | A1 | 5/2016 | Gonzalez et al. |

FOREIGN PATENT DOCUMENTS

| | | | |
|---|---|---|---|
| GB | 2535509 | A | 8/2016 |

OTHER PUBLICATIONS

International Search Report and Written Opinion issued in PCT/US18/27687, dated Aug. 9, 2018, 14 pages.

*Primary Examiner* — David J Bagnell
*Assistant Examiner* — Kristyn A Hall
(74) *Attorney, Agent, or Firm* — Adolph Locklar

(57) ABSTRACT

A downhole tool control apparatus includes a control assembly, a stroking assembly, and a pocket sleeve positioned in an outer sub. The control assembly and stroking assembly are independently slidable axially within the outer sub. The control assembly and stroking assembly slide depending on the flow rate of fluid through the downhole tool actuator. The stroking assembly includes a spline barrel having a spline projection positioned within a spline pocket formed in the pocket sleeve. The pocket sleeve and control assembly include one or more ratchet teeth positioned in the pocket sleeve such that as the flow rate is changed between a high and a low flow rate, the spline projection engages the ratchet teeth until an actuated cycle is completed, allowing the downhole tool actuator to move to an actuation position.

36 Claims, 74 Drawing Sheets

DOWNHOLE TOOL ACTUATORS AND INDEXING MECHANISMS

CROSS-REFERENCE TO RELATED APPLICATIONS

This application is a nonprovisional application that claims priority from U.S. provisional application No. 62/485,569, filed Apr. 14, 2017.

TECHNICAL FIELD/FIELD OF THE DISCLOSURE

The present disclosure relates to control of downhole tools using selective, on demand actuators and indexing mechanisms.

BACKGROUND OF THE DISCLOSURE

During the life cycle of a wellbore, many tools may be used within the wellbore. In some cases, it may be desirable to selectively activate or change configuration or operating mode of a downhole tool while ensuring that the tools are turned on and off or are reconfigured only when desired. Typically, such operations may be carried out by using a single drop ball, multiple drop balls, an electro-mechanical actuator initiated by a surface downlink, or by a hydraulic pressure differential generated by fluid flow. Other downhole tools may be activated or reconfigured by constantly-cycling indexing mechanisms.

SUMMARY

The present disclosure provides for a downhole tool actuator. The downhole tool actuator may include an outer sub. The outer sub may have an inner surface defining a control apparatus bore. The downhole tool actuator may include a control pin positioned within the control apparatus bore and mechanically coupled to the outer sub. The downhole tool actuator may include a control assembly positioned within the control apparatus bore. The control assembly may be tubular and may define a control assembly bore. The control pin may be positioned at least partially within the control assembly bore. The control assembly may include a control piston. The control assembly may include a control piston spring positioned between a dynamic control spring stop of the control assembly and a fixed control spring stop mechanically coupled to the outer sub. The control assembly may include a ratchet mandrel mechanically coupled to the control piston. The control assembly may include a low flow ratchet sleeve mechanically coupled to the ratchet mandrel and including one or more low flow ratchet teeth. The downhole tool actuator may include a stroking assembly positioned within the control apparatus bore. The stroking assembly may be tubular and may define a stroking assembly bore. The stroking assembly may include a stroking mandrel, the stroking mandrel being tubular and defining a stroking assembly bore. The stroking assembly may include a stroking piston mechanically coupled to the stroking mandrel, a stroking piston spring positioned between a dynamic stroking spring stop and a fixed spring stop mechanically coupled to the outer sub, and a spline barrel. The spline barrel may include a spline projection. The spline barrel may be coupled to the stroking mandrel such that the spline barrel is rotatable relative to the stroking mandrel. The downhole tool actuator may include a pocket assembly mechanically coupled to the outer sub and including a pocket sleeve having a spline pocket formed therein. The spline pocket may include a reset slope, a high-flow ratchet tooth, and an actuation slot. The spline projection of the stroking assembly may be positioned within the spline pocket.

The present disclosure also provides for a downhole tool indexer. The downhole tool indexer may include an outer sub having an inner surface defining a control apparatus bore. The downhole tool indexer may include a control pin positioned within the control apparatus bore and mechanically coupled to the outer sub. The downhole tool indexer may include a control assembly positioned within the control apparatus bore. The control assembly may be tubular and may define a control assembly bore. The control pin may be positioned at least partially within the control assembly bore. The control assembly may include a control piston, a control piston spring positioned between a dynamic control spring stop of the control assembly and a fixed control piston spring stop mechanically coupled to the outer sub, a ratchet mandrel mechanically coupled to the control piston, and a low flow ratchet sleeve mechanically coupled to the ratchet mandrel. The low flow ratchet sleeve may include one or more upper low flow ratchet teeth and one or more lower low flow ratchet teeth. The downhole tool indexer may include a stroking assembly positioned within the control apparatus bore. The stroking assembly may be tubular and may define a stroking assembly bore. The stroking assembly may include a stroking mandrel, the stroking mandrel being tubular and defining a stroking assembly bore. The stroking assembly may include a stroking piston mechanically coupled to the stroking mandrel, a stroking piston spring, and a spline barrel. The spline barrel may include a spline projection. The spline barrel may be coupled to the stroking mandrel such that the spline barrel is rotatable relative to the stroking mandrel. The downhole tool indexer may include a pocket assembly mechanically coupled to the outer sub. The pocket assembly may include a reset sleeve including a first reset slope and a second reset slope. The pocket assembly may include a high flow ratchet sleeve. The high flow ratchet sleeve may include one or more upper high flow ratchet teeth and one or more lower high flow ratchet teeth. The reset sleeve and high flow ratchet sleeve may define a first spline pocket and a second spline pocket. The reset sleeve and high flow ratchet sleeve may define a first transition slot and a second transition slot between the first spline pocket and second spline pocket. The spline projection of the stroking assembly may be positioned within the first or second spline pocket. The pocket assembly may include an orientation spacer mechanically coupled to the reset sleeve and the high flow ratchet sleeve.

The present disclosure also provides for a method. The method may include providing a downhole tool actuator; operatively coupling a downhole tool to the downhole tool actuator, the downhole tool in a first operating mode; and changing the downhole tool into a second operating mode with the downhole tool actuator. Changing the downhole tool into a second operating mode with the downhole tool actuator may include increasing fluid flow through the downhole tool actuator to a high flow rate, positioning the downhole tool actuator in a short stroke position, lowering fluid flow through the downhole tool actuator to a low flow rate, positioning the downhole tool actuator in a control position, increasing fluid flow through the downhole tool actuator to a high flow rate, positioning the downhole tool actuator in an actuation position, stopping fluid flow through the downhole tool actuator, and positioning the downhole tool actuator in a reset position.

The present disclosure also provides for a method. The method may include providing a downhole tool indexer; operatively coupling a downhole tool to the downhole tool indexer, the downhole tool in a first operating mode; and changing the downhole tool into a second operating mode. Changing the downhole tool into a second operating mode may include increasing fluid flow through the downhole tool indexer to a high flow rate, positioning the downhole tool indexer in an first stroking position, lowering fluid flow through the downhole tool indexer to a low flow rate, positioning the downhole tool indexer in a first control position, increasing fluid flow through the downhole tool indexer to a high flow rate, and positioning the downhole tool indexer in a second stroking position.

The present disclosure also provides for a downhole tool control apparatus. The downhole tool control apparatus may include an outer sub having an inner surface defining a control apparatus bore. The downhole tool control apparatus may include a control pin positioned within the control apparatus bore and mechanically coupled to the outer sub. The downhole tool control apparatus may include a control assembly positioned within the control apparatus bore. The control assembly may be tubular and may define a control assembly bore. The control pin may be positioned at least partially within the control assembly bore. The control assembly may include a control piston; a control piston spring positioned between a dynamic control spring stop of the control assembly and a fixed control spring stop mechanically coupled to the outer sub; a ratchet mandrel mechanically coupled to the control piston; and a low flow ratchet sleeve mechanically coupled to the ratchet mandrel. The low flow ratchet sleeve may include one or more low flow ratchet teeth. The downhole tool control apparatus may include a stroking assembly positioned within the control apparatus bore. The stroking assembly may be tubular and may define a stroking assembly bore. The stroking assembly may include a stroking mandrel, the stroking mandrel being tubular and defining a stroking assembly bore; a stroking piston mechanically coupled to the stroking mandrel; a stroking piston spring positioned between a dynamic stroking spring stop and a fixed spring stop mechanically coupled to the outer sub; and a spline barrel. The spline barrel may include a spline projection. The spline barrel may be coupled to the stroking mandrel such that the spline barrel is rotatable relative to the stroking mandrel. The downhole tool control apparatus may include a spline pocket formed on the inner surface of the outer sub. The spline pocket may include a lower boundary, an upper boundary, a reset boundary, and an exit boundary. The lower boundary may include a reset slope. The upper boundary may include at least one high-flow ratchet tooth. The spline projection of the stroking assembly may be positioned within the spline pocket.

The present disclosure also provides for a downhole tool control apparatus. The downhole tool control apparatus may include an outer sub. The outer sub may be tubular and may have an inner surface defining a control apparatus bore. The downhole tool control apparatus may include a stroking assembly positioned within the control apparatus bore. The stroking assembly may include a stroking mandrel and a spline barrel. The spline barrel may include a spline projection. The spline projection may extend radially outward from the spline barrel. The spline barrel may be coupled to the stroking mandrel such that the spline barrel is rotatable relative to the stroking mandrel. The downhole tool control apparatus may include a spline pocket formed on the inner surface of the outer sub. The spline pocket may include a lower boundary, an upper boundary, a reset boundary, and an exit boundary. The lower boundary may include a reset slope. The upper boundary may include at least one high-flow ratchet tooth. The spline projection of the stroking assembly may be positioned within the spline pocket.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
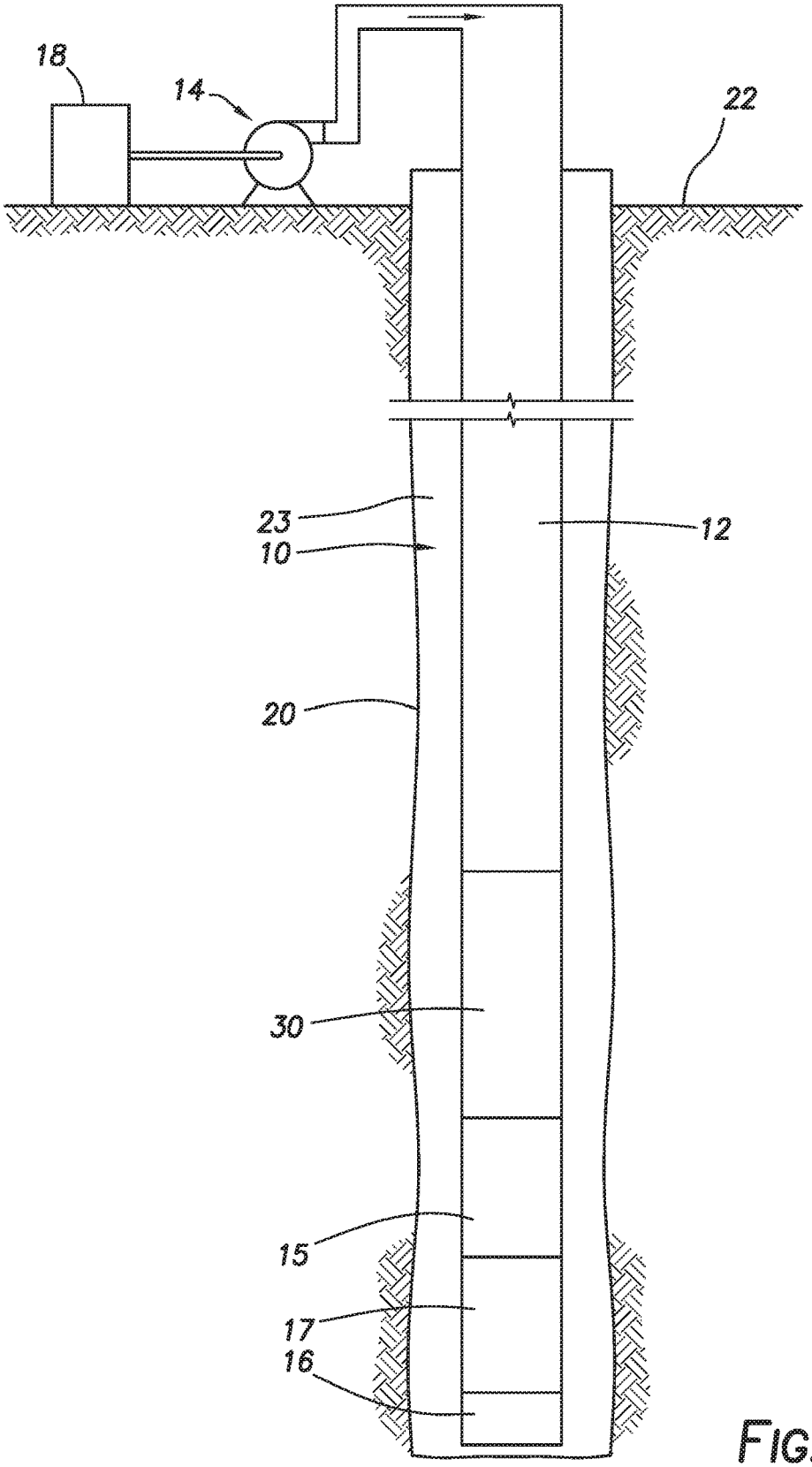
FIG. 1 depicts a schematic view of a wellbore having a downhole tool and downhole tool actuator consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts drill string 10 positioned within wellbore 20. Drill string 10 may include downhole tool 15. Drill string 10 may be constructed from a plurality of tubular components that together define drill string bore 12. Drill string 10 may be positioned within wellbore 20. Wellbore annulus 23 may be defined as the annular space within wellbore 20 about drill string 10. One or more pumps 14 may be positioned to pump fluid through drill string bore 12. In some embodiments, one or more pumps 14 may be adapted to provide fluid flow through drill string bore 12. Pumps 14 may be controlled by controller 18 so as to provide different flow rates of fluid through drill string bore 12.

FIG. 1 further depicts downhole tool 15. Non-limiting examples of downhole tool 15 may be a reamer, underreamer, packer, downhole motor, stabilizer, centralizer, pulse tool, vibration tool, jarring tool, or any other downhole tool. Although depicted at a lower end of drill string 10, downhole tool 15 may be positioned at any point along drill string 10. Downhole tool 15 may be positioned within drill string 10 proximate to downhole tool control apparatus 30 and may be operatively coupled to downhole tool control apparatus 30. Downhole tool control apparatus 30 may be used to change one or more operational states or parameters of downhole tool 15. In some embodiments, downhole tool control apparatus 30 may operate as an actuator or indexer, as further described herein below as, for example and without limitation, downhole tool actuator 100 and downhole tool indexer 100', respectively. In some embodiments, for example and without limitation, downhole tool control apparatus 30 may cause downhole tool 15 to change between operating modes, such as from a first operating mode to a second operating mode. Downhole tool 15 may initially be in the first operating mode and then be selectively changed to the second operating mode by the operation of downhole tool control apparatus 30. In some embodiments as discussed herein, the first operating mode and second operating mode may, for example, correspond to an activation or deactivation of downhole tool 15. In some embodiments, the first operating mode and second operating mode may correspond to different positions of downhole tool 15. For example, as discussed further herein below, in some embodiments, downhole tool 15 may include an indexing mechanism that may be controlled by downhole tool control apparatus 30. In some embodiments, downhole tool 15 may be a fluid-actuated device to which downhole tool control apparatus 30 controls the flow of fluid. In some embodiments, drill string 10 may include one or more additional tools below downhole tool 15 including, for example and without limitation bottom hole assembly (BHA) 17. As understood in the art, BHA 17 may include any tools for use in a wellbore including, for example and without limitation, one or more of drill bit 16, MWD system, downhole motor, rotary steerable system, or other downhole tools. In some embodiments, downhole tool control apparatus 30, downhole tool 15, or both may be considered part of BHA 17 or positioned within BHA 17. In some embodiments, downhole tool control apparatus 30, downhole tool 15, or both may be considered positioned within drill string 10 substantially above the BHA 17.

Figure 2:
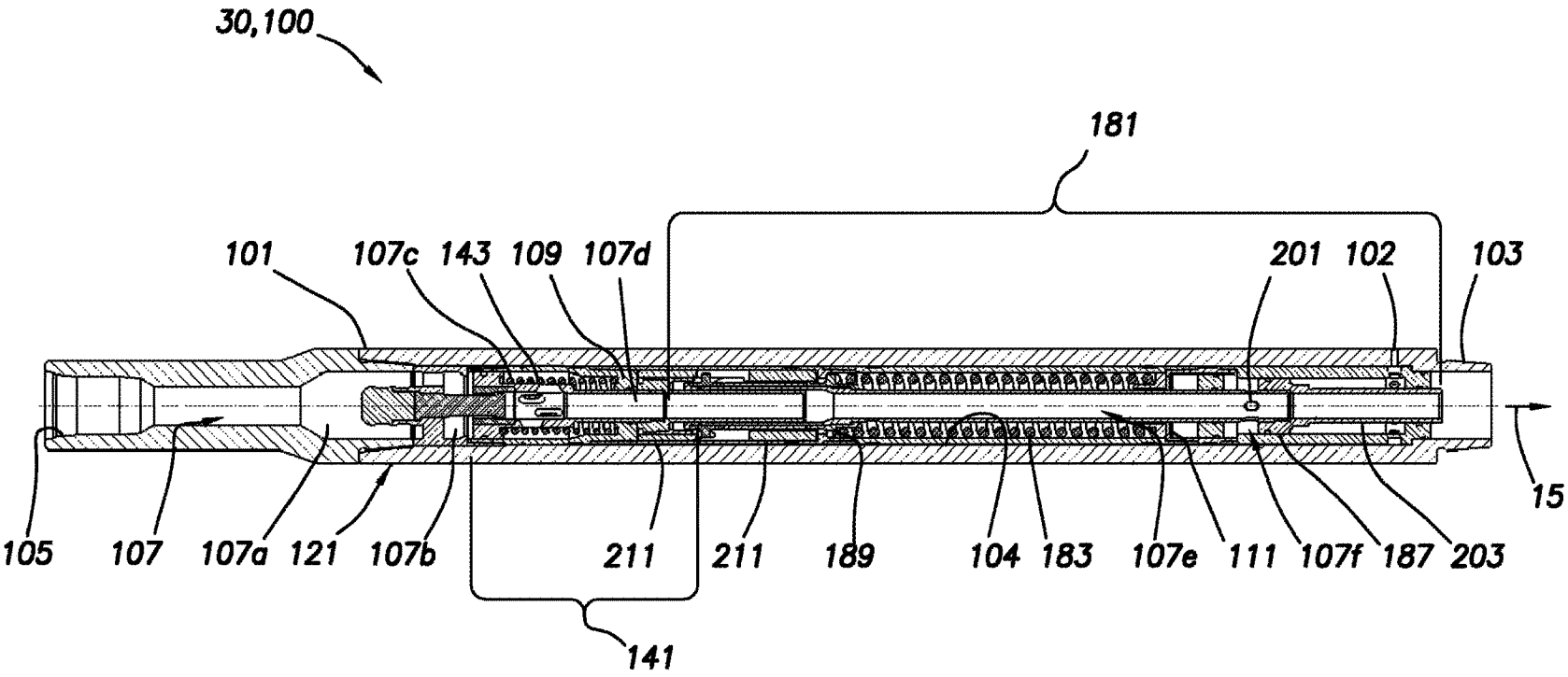
FIG. 2 depicts a cross section view of a downhole tool actuator consistent with at least one embodiment of the present disclosure.

FIG. 2 depicts a schematic view of downhole tool control apparatus 30 consistent with at least one embodiment of the present disclosure. In some embodiments, downhole tool control apparatus 30 may include outer sub 101. Outer sub 101 may be tubular and may act as an outer housing and support structure for other components of downhole tool control apparatus 30. In some embodiments, outer sub 101 may include tool coupler 103, which may be a threaded coupler for coupling to downhole tool 15. In some embodiments, outer sub 101 may include drill string coupler 105, which may be a threaded coupler for coupling to drill string 10. In some embodiments, outer sub 101 may include outer sub inner surface 104 that defines control apparatus bore 107 therein. Control apparatus bore 107 may be fluidly coupled to drill string bore 12 and may thereby receive fluid flow from one or more pumps 14. Control apparatus bore 107, as discussed herein below, may be separated into one or more fluid areas by components of downhole tool control apparatus 30 including, for example and without limitation, upper control apparatus bore 107*a*, control pin chamber 107*b*, control piston chamber 107*c*, control assembly bore 107*d*, stroking assembly bore 107*e*, stroking chamber 107*f*, and stroking reaction chamber 203. As used herein, "upward" refers to a direction within wellbore 20 towards surface 22 and "downward" refers to a direction within wellbore 20 away from surface 22.

Figure 5:
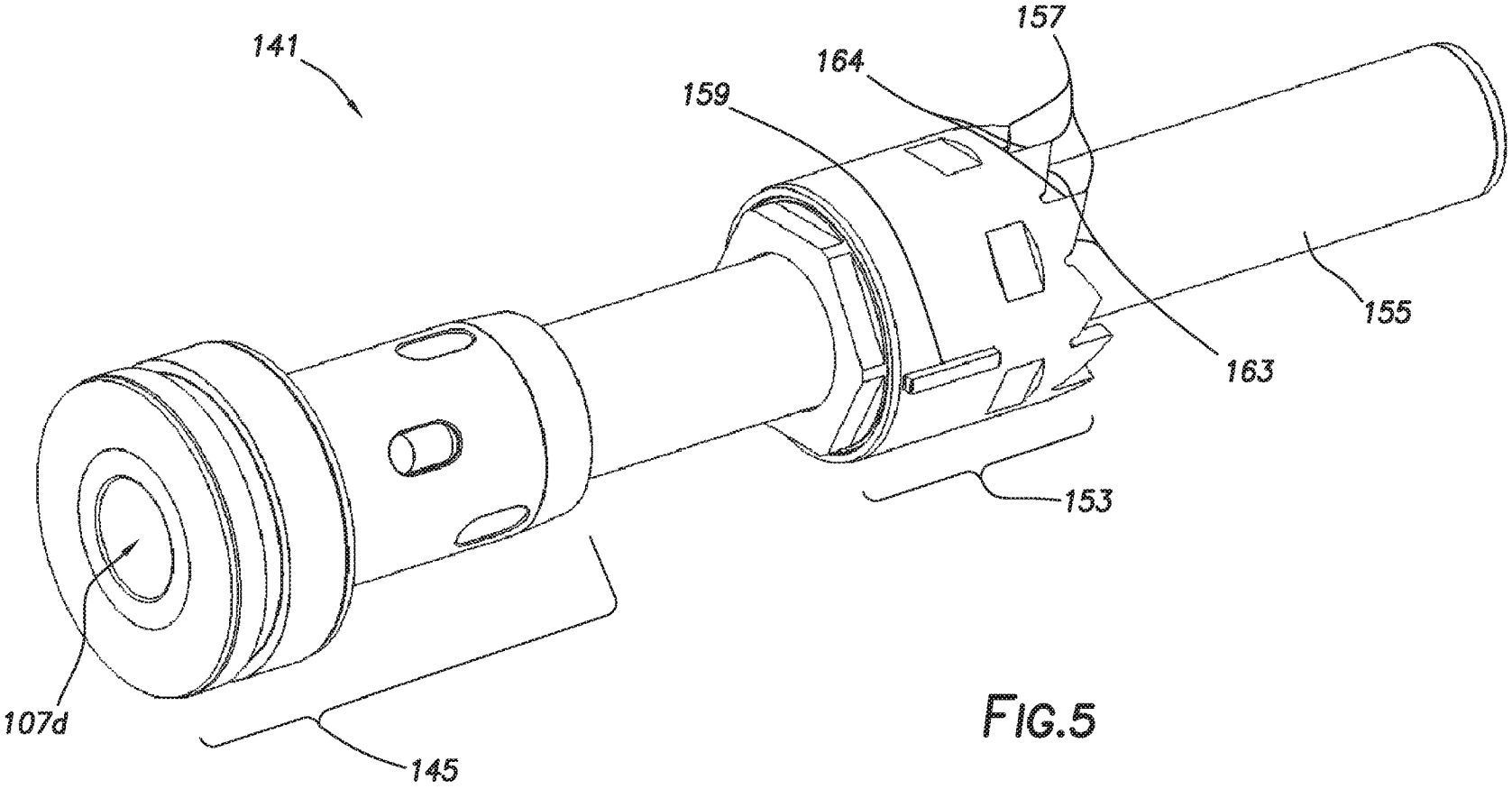
FIG. 5 depicts a perspective view of a control assembly consistent with at least one embodiment of the present disclosure.
Figure 6:
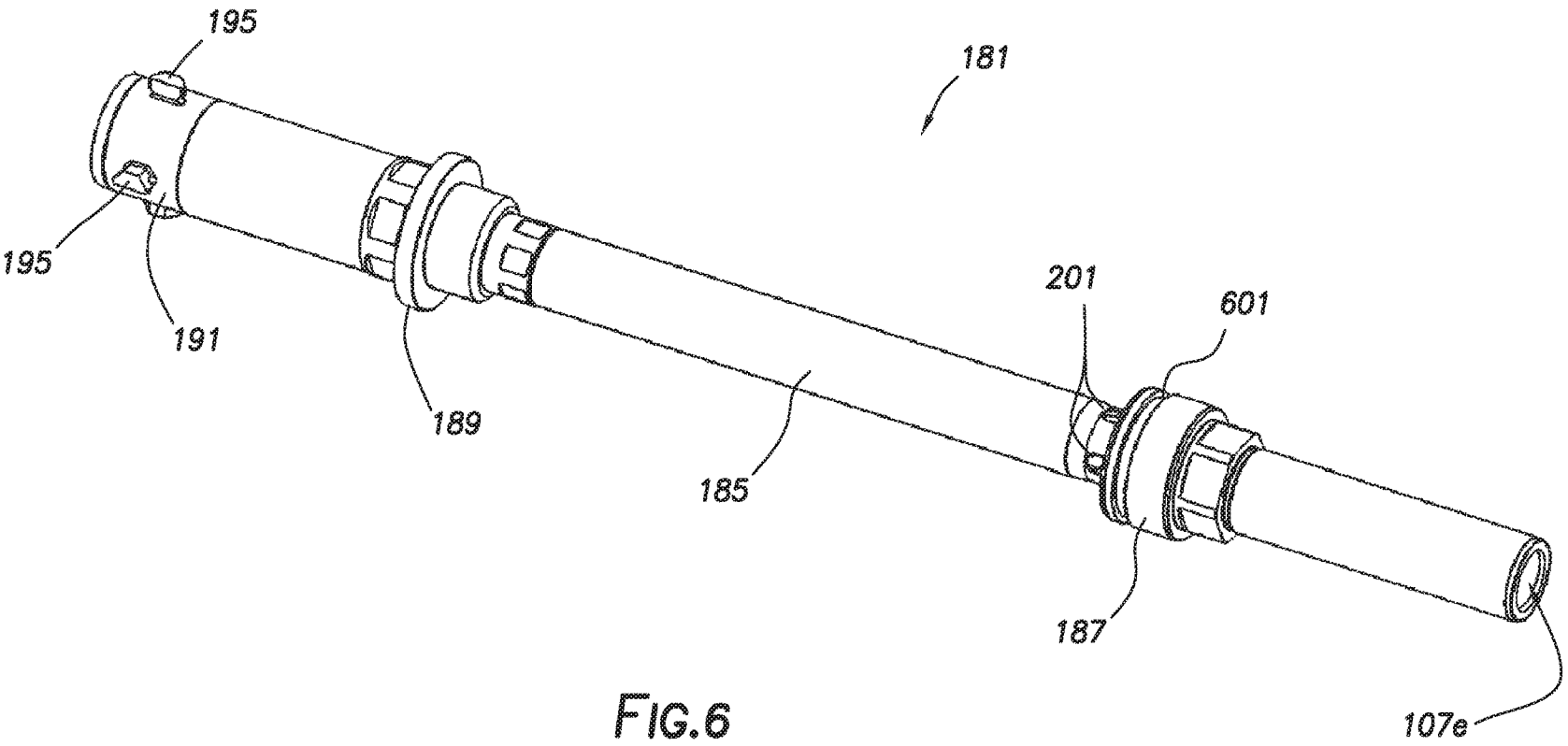
FIG. 6 depicts a perspective view of a stroking assembly consistent with at least one embodiment of the present disclosure.

In some embodiments, downhole tool control apparatus 30 may include control pin assembly 121, control assembly 141, stroking assembly 181, and a pocket assembly such as pocket assembly 211 or 311 as further discussed herein below. In some embodiments, downhole tool control apparatus 30 may include control piston spring 143. In some embodiments, downhole tool actuator may include stroking piston spring 183. In some embodiments, control assembly 141, as depicted in FIG. 5 and described herein below, may consist of several components of downhole tool control apparatus 30 mated and fixed together to form a single assembly component. Control assembly 141 may have a range of movement within downhole tool control apparatus 30 in an axial or longitudinal direction with respect to outer sub 101. In some embodiments, stroking assembly 181 as depicted in FIG. 6 and described herein below, may consist of several components mated and fixed together to form a single assembly. Stroking assembly 181 may have a range of movement within downhole tool control apparatus 30 in an axial direction with respect to outer sub 101. In some embodiments, control assembly 141 and stroking assembly 181 may move independently from each other within the downhole tool control apparatus 30 in an axial direction with respect to outer sub 101.

Figure 3:
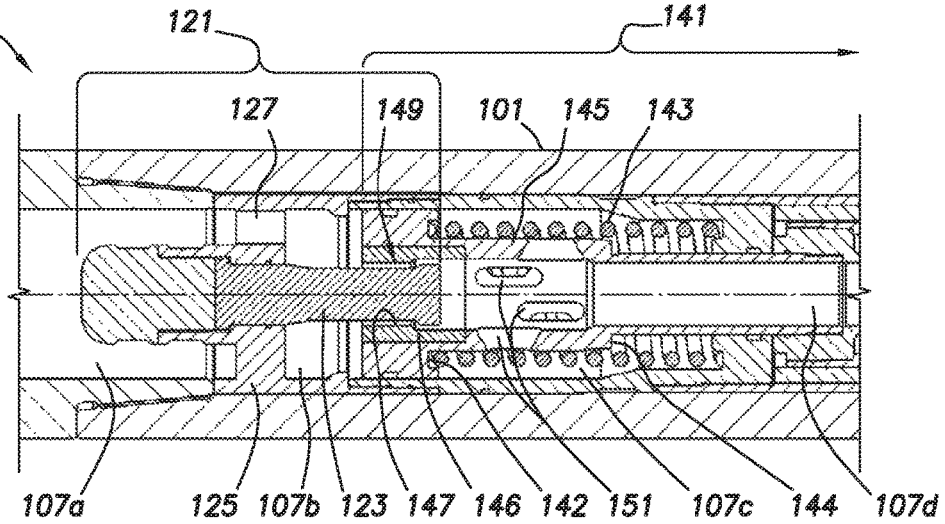
FIG. 3 depicts a partial cross section view of a downhole tool actuator consistent with at least one embodiment of the present disclosure.
Figure 9:
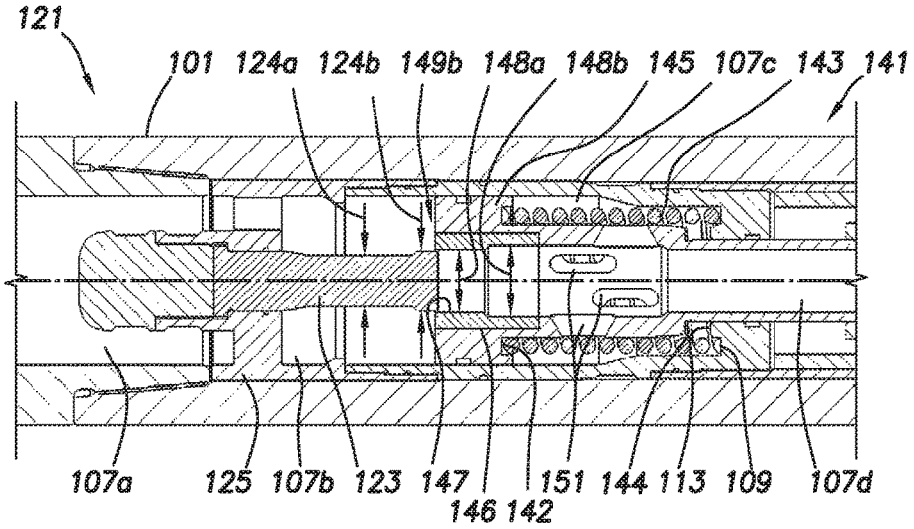
FIG. 9 depicts a partial cross section view of the downhole tool actuator of FIG. 3 in a control low flow position.
Figure 4:
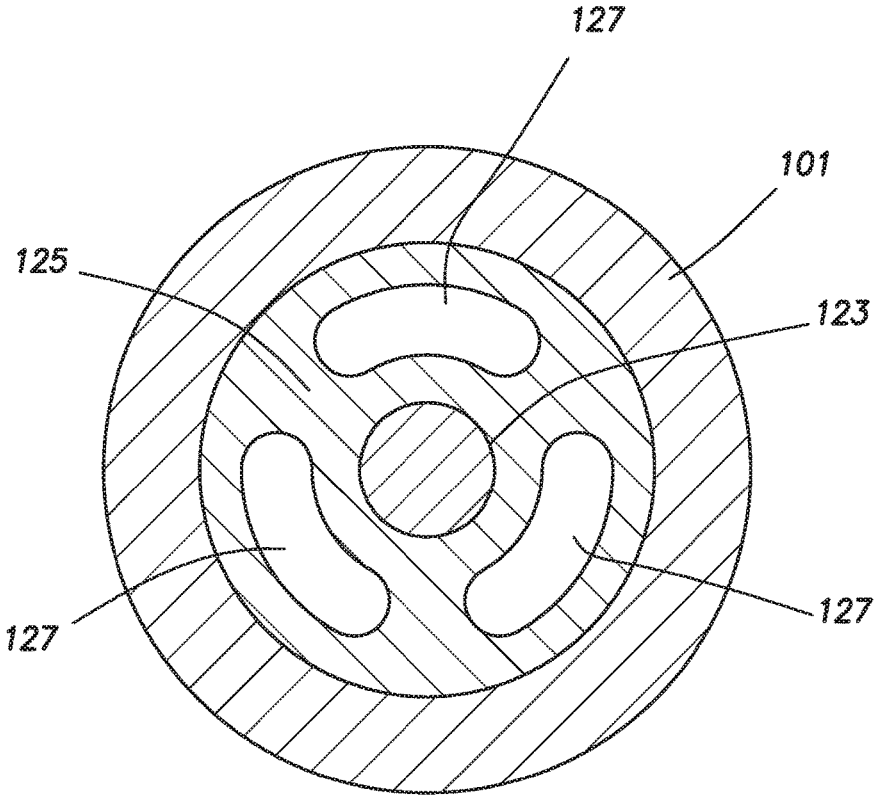
FIG. 4 depicts a cross section view of a control pin housing consistent with at least one embodiment of the present disclosure.

In some embodiments, as depicted in FIG. 3, control pin assembly 121 may include control pin 123. Control pin 123 may be fixedly coupled to outer sub 101 by control pin housing 125. Control pin housing 125 may be generally annular and may include one or more flow paths 127 (depicted in FIG. 4) through which fluid may flow from upper control apparatus bore 107*a* to control pin chamber 107*b*. In some embodiments, control pin 123 may have an outer profile that includes a first control pin diameter 124*a* and a second control pin diameter 124*b*, as depicted in FIG. 9. In some embodiments, control pin assembly 121 may be fixed within downhole tool control apparatus 30 such that control pin assembly 121 does not move in an axial longitudinal direction with respect to outer sub 101.

In some embodiments, with reference to FIG. 5, control assembly 141 may be tubular and may define control assembly bore 107*d*. Control assembly 141 may include control piston 145, low flow ratchet sleeve 153, ratchet mandrel 155, and control sleeve 146. Control assembly 141 may be positioned within outer sub 101 and may slide longitudinally within outer sub 101 in response to fluid flow within control apparatus bore 107 at one or more preselected flow rates as discussed further herein below. For the purposes of this disclosure, each change in flow rate as further described herein below may be held for a preselected duration so as to allow, for example and without limitation, the increase or decrease in flow rate to cause reconfiguration of components of downhole tool control apparatus 30 as further discussed herein below. In some embodiments, control piston 145 may be generally tubular and control sleeve 146 may be positioned within control piston 145. In some embodiments, low flow ratchet sleeve 153 may be generally tubular and may be positioned about and mechanically coupled to ratchet mandrel 155. In some embodiments, ratchet mandrel 155 may be tubular and mechanically coupled to control piston 145.

FIG. 5 depicts low flow ratchet sleeve 153 consistent with embodiments of downhole tool actuator 100. Low flow ratchet sleeve 153 may include one or more low flow ratchet teeth 157. In some embodiments, each of low flow ratchet teeth 157 may include ratchet slope 163 and stop face 164. In some embodiments, low flow ratchet sleeve 153 may include one or more alignment splines 159 positioned to interact with one or more other components of downhole tool actuator 100 to, for example and without limitation, align low flow ratchet teeth 157 and prevent or reduce rotation of control assembly 141 with respect to pocket assembly 211 while allowing longitudinal movement of control assembly 141. In some embodiments, with reference to FIG. 2, control piston spring 143 may extend between dynamic control spring stop 142 of control piston 145 and fixed control piston spring stop 109 formed as part of or mechanically coupled to outer sub 101. Control piston spring 143 may, in some embodiments, be configured to urge control assembly 141 in an upward direction relative to outer sub 101. In some embodiments, control sleeve 146 may have an inner profile that includes a first control sleeve diameter 148*a* and a second control sleeve diameter 148*b*, as depicted in FIG. 9.

Figure 7:
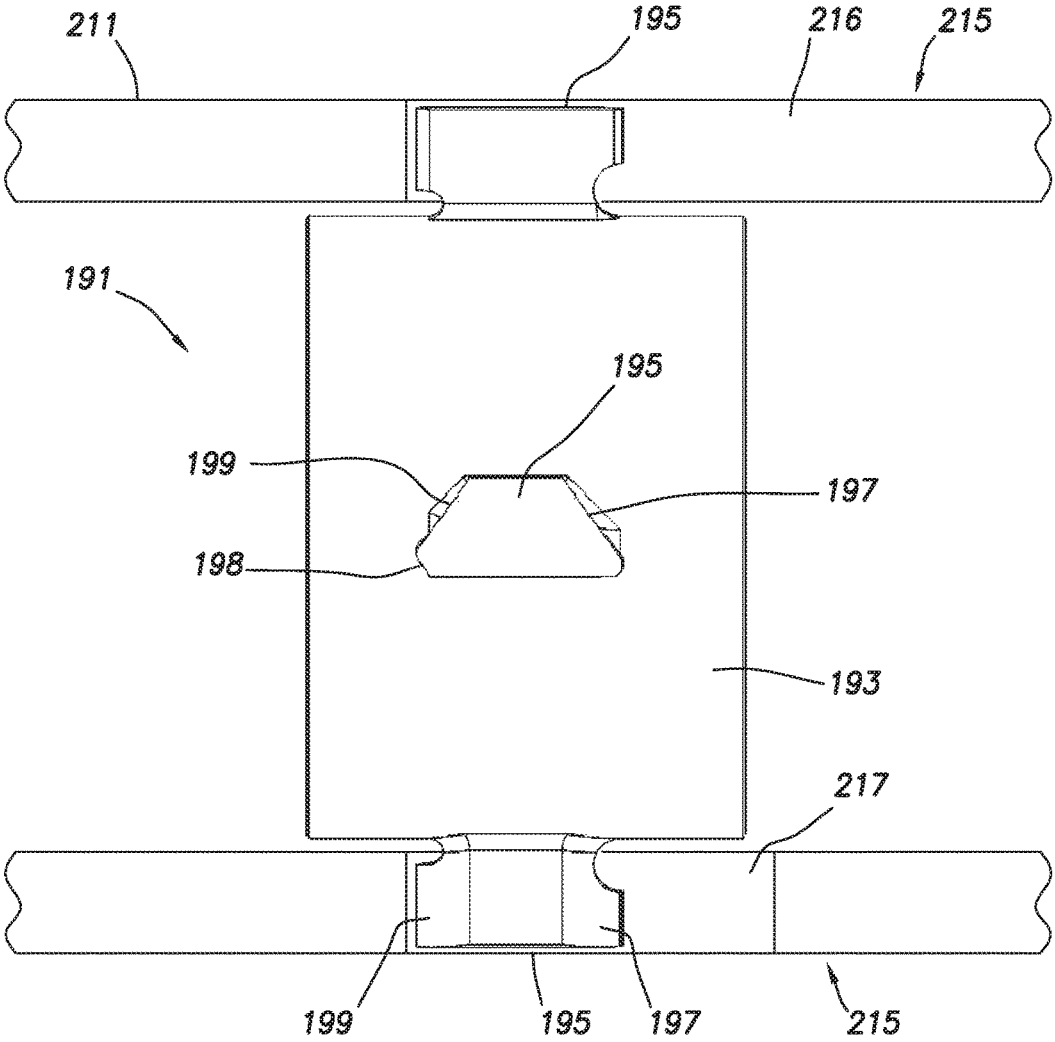
FIG. 7 depicts a side view of a spline barrel consistent with at least one embodiment of the present disclosure.

In some embodiments, with reference to FIG. 6, stroking assembly 181 may include stroking mandrel 185. Stroking mandrel 185 may be tubular and may define stroking assembly bore 107*e*. In some embodiments, stroking assembly 181 may include stroking piston 187, dynamic stroking spring stop 189, and spline barrel 191 each mechanically coupled to stroking mandrel 185. Spline barrel 191 may be coupled to stroking mandrel 185 such that spline barrel 191 moves longitudinally with stroking mandrel 185 relative to outer sub 101. Spline barrel 191 may rotate relative to stroking mandrel 185 and pocket assembly 211. In some embodiments, as depicted in FIG. 7, spline barrel 191 may include spline sleeve body 193 and one or more spline projection 195 extending radially outwardly from spline sleeve body 193. In some embodiments, spline sleeve body 193 may be tubular. In some embodiments, spline projection 195 may include high flow ratchet face 197, low flow ratchet face 199, and reset face 198. Spline projection 195 may engage one or more teeth or slopes of pocket sleeve 213 and low flow ratchet sleeve 153 as discussed further herein below with high flow ratchet face 197, low flow ratchet face 199, and reset face 198.

In some embodiments, with reference to FIG. 2, stroking piston spring 183 may extend between dynamic stroking spring stop 189 formed on or mechanically coupled to stroking piston 187, stroking mandrel 185, or another portion of stroking assembly 181, and fixed stroking spring stop 111 formed as part of or mechanically coupled to outer sub 101. Stroking piston spring 183 may, in some embodiments, be configured to urge stroking assembly 181 in an upward direction relative to outer sub 101.

In some embodiments, with reference to FIG. 6, stroking mandrel 185 may include one or more stroking chamber ports 201 positioned to fluidly couple stroking assembly bore 107*e* and stroking chamber 107*f* as depicted in FIG. 2. In some embodiments, outer sub 101 may include one or more stroking reaction ports 102 positioned to fluidly couple the stroking reaction chamber 203 with wellbore annulus 23 external to tool outer sub 101. In some embodiments, stroking piston 187 may separate stroking chamber 107*f* from stroking reaction chamber 203. In some embodiments, stroking piston 187 may seal to tool outer sub 101 by one or more seals including, for example and without limitation, upper stroking seal 601 and lower stroking seal 602. Fluid flow through drill string 10 when one or more pumps 14 are operating may generate a pressure differential between stroking chamber 107*f* and stroking reaction chamber 203, referred to herein as a stroking pressure differential. The stroking pressure differential may result from a cumulative pressure drop across components of BHA 17, which may include, for example and without limitation, drill bit 16 and other downhole drilling tools such as a rotary steerable system, MWD, or downhole motor. The stroking pressure differential may apply force to stroking piston 187. When one or more pumps 14 are set at a high flow rate, i.e. above a threshold defined as a high flow rate threshold, the stroking pressure differential generated between stroking chamber 107*f* stroking reaction chamber 203 at the pressure of wellbore annulus 23 may generate a stroking piston differential. The stroking pressure differential may generate sufficient force on stroking piston 187 so that stroking piston 187 may overcome the biasing force of stroking piston spring 183, shifting stroking assembly 181 in a downward direction relative to outer sub 101. At a flow rate below the high flow rate, the force on stroking piston 187 generated by the stroking pressure differential may be insufficient to overcome the biasing force of stroking piston spring 183, causing stroking assembly to shift in an upward direction relative to outer sub 101.

When drilling fluid is not flowing through control apparatus bore 107, such as when one or more pumps 14 are turned off, control assembly 141 may be biased by control piston spring 143 into the position depicted in FIG. 3, referred to herein as the "control reset" position. In the control reset position, control pin 123 is positioned at least partially within control assembly bore 107*d*. Inner wall 147 of control sleeve 146 may be positioned at least partially over the outer wall of control pin 123. The area between the control pin 123 and the control sleeve 146 may define a flow path therebetween that fluidly couples control pin chamber 107*b* and control assembly bore 107*d*. This flow path, referred to herein as total flow area TFA 149, may be of variable area due to control assembly 141 translating in longitudinal axial direction relative to the control pin 123 in response to fluid flow configurations described herein below.

In some embodiments, control pin 123 may include an outer profile and control sleeve 146 may include an inner profile. For example and without limitation, as depicted in FIG. 9, the outer profile of control pin 123 may include first control pin diameter 124*a* and second control pin diameter 124*b*, and the inner profile of control sleeve 146 may include first control sleeve diameter 148*a* and second control sleeve diameter 148*b*. First control pin diameter 124*a* may be smaller than second control pin diameter 124*b*. First control sleeve diameter 148*a* may be smaller than second control sleeve diameter 148*b*. In some embodiments, second control pin diameter 124*b* may be smaller than first control sleeve diameter 148*a*.

In some embodiments, control piston 145 may include one or more apertures 151 that fluidly couple control assembly bore 107*d* with control piston chamber 107*c*. In some embodiments, one or more control piston seals 150 may be positioned between control piston 145 and outer sub 101 to, for example and without limitation, fluidly seal control pin chamber 107*b* from control piston chamber 107*c*.

In some embodiments, as fluid flows through TFA 149, a control pressure differential may be generated between control pin chamber 107*b* and control piston chamber 107*c*. The control pressure differential may act on control piston 145 generating a force in opposition to that of control piston spring 143. In some embodiments, at a predetermined flow rate, referred to herein as the low flow rate. The low flow rate may be defined as a selected flow rate that is above a reset flow rate threshold, below which control assembly 141 translates to the control reset position, but below a low flow rate threshold, below which stroking assembly 181 is in contact with control assembly 141 through spline projection 195 as discussed herein below. At the low flow rate, the control pressure differential may be sufficient to overcome the bias of control piston spring 143, allowing control assembly 141 to move in an axially downward direction. In other embodiments, the high flow rate is required to generate sufficient pressure differential to move control assembly 141 to move in an axially downward direction. Movement of control assembly 141 may alter TFA 149 between control pin 123 and control sleeve 146, which may alter the control pressure differential and therefore the force exerted on control piston 145. For example, reducing the flow rate from the high flow rate to the low flow rate may reduce the control pressure differential such that the force exerted on control piston 145 by the control pressure differential is less than the biasing force of control piston spring 143, allowing control piston spring 143 to move control assembly 141 in an axial upward direction.

In some embodiments, the values for the reset flow rate threshold, the low flow rate threshold, and the high flow rate threshold may be modified by selecting a control pin 123 or control sleeve 146 having selected diameters to modify the TFA of each of the above described positions. In some embodiments, the values for the low flow rate and high flow rate may be modified or affected by the components included in BHA 17, drill bit 16, or other tools in the drill string below downhole tool control apparatus 30. Additionally, the relative placement of downhole tool control apparatus 30 and BHA 17 and the weight, density, viscosity, or other parameters of the fluid used may at least partially affect the low flow rate and high flow rates.

In some embodiments, with flow rate off and control assembly 141 positioned in the control reset position, with reference to FIG. 3, control sleeve 146 may be positioned over control pin 123 such that TFA 149 through downhole tool control apparatus 30 is restricted by the flow path between control pin 123 outer profile and the inner wall 147 of control sleeve 146. The TFA with flow rate off and control assembly 141 positioned in the control reset position will hereafter be referred to as reset TFA 149*a*. In some embodiments, reset TFA 149*a* may be the smaller TFA of either the area between first control sleeve diameter 148*a* and first control pin diameter 124*a* or the area between second control sleeve diameter 148*b* and second control pin diameter 124*b*. In some embodiments, reset TFA 149*a* may, for example and without limitation, allow a certain amount of flow through downhole tool control apparatus 30 while control assembly 141 is positioned in the control reset position. As an example, reset TFA 149*a* may allow fluid within drill string bore 12 to pass through downhole tool control apparatus 30 during a tripping in or out operation.

Figure 8:
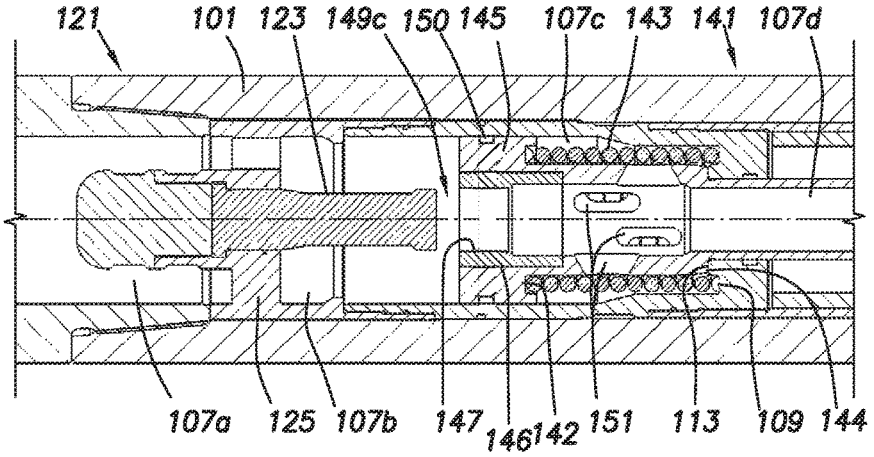
FIG. 8 depicts a partial cross section view of the downhole tool actuator of FIG. 3 in a control high flow position.

In some embodiments, as fluid flow is increased from no flow rate to the high flow rate, pressure may increase within control pin chamber 107*b* above reset TFA 149*a*, generating a transient control pressure differential, between control pin chamber 107*b* and control piston chamber 107*c* caused by the pressure drop across the restricted flow through reset TFA 149*a*. The transient control pressure differential may exert a force on control piston 145 in opposition to the bias of control piston spring 143, causing control assembly 141 to move relative to outer sub 101 in a downward direction away from control pin 123. As control assembly 141 moves in a downward direction, control sleeve 146 moves beyond control pin 123 as depicted in FIG. 9, and the transient control pressure differential reduces until the force acting on control piston 145 balances with the biasing force imparted by control piston spring 143. Depending on the flow rate, the relative position between control sleeve 146 and control pin 123 may result from the balance between the control pressure differential and control piston spring 143 such that the flow through the TFA between control sleeve 146 and control pin 123 creates the pressure differential to balance against control piston spring 143. In some embodiments, once control sleeve 146 moves beyond control pin 123, low flow ratchet teeth 157 may enter or be longitudinally aligned within the boundary defined by pocket sleeve 213 as further discussed below. Once the high flow rate is achieved, control sleeve 146 and control pin 123 may be positioned such that the TFA defines high flow TFA 149*c* as depicted in FIG. 8. Control assembly 141 continues to move until the control pressure differential dissipates as high flow TFA 149*c* is larger than reset TFA 149*a*. The larger high flow TFA 149*c* restricts fluid flow therethrough less than reset TFA 149*a*, thereby allowing the pressure differential between control pin chamber 107*b* and control piston chamber 107*c* to dissipate. The high flow rate may generate a control pressure differential across either high flow TFA 149*c* or across the bore area of first control sleeve diameter 148*a*. The active control pressure differential may be whichever pressure differential generated is larger, and is referred to herein as the control high flow pressure differential. When subject to the high flow rate, control assembly 141 is referred to herein as set in the control high flow position. In some embodiments, the control high flow pressure differential may generate sufficient force on control piston 145 to overcome the biasing force of control piston spring 143 such that control piston 145 may hold stop face 144 of control assembly 141 near to or in contact with control piston stop 113 when control assembly 141 is in the control high flow position. Control piston stop 113 may be formed on or mechanically coupled to outer sub 101 as depicted in FIG. 8. In other embodiments, the control high flow position of control piston 145 may be defined as a range of positions for control piston 145 while subject to different flow rates above the high flow rate threshold. In such an embodiment, control piston 145 may be in a balanced position and not necessarily in contact with control piston stop 113 while flow rate is above the high flow rate.

In some embodiments, at the high flow rate wherein control assembly 141 is set in the control high flow position, the flow rate through drill string bore 12 may be reduced or stopped. The flow rate may be reduced to the low flow rate. A reduction in flow rate from the high flow rate to the low flow rate may reduce the control high flow pressure differential such that the biasing force exerted by control piston spring 143 may overcome the force generated by the control piston 145. As the control pressure differential decreases, control assembly 141 may move in an upward direction toward the control low flow position as depicted in FIG. 9. When the flow rate through drill string bore 12 is maintained at the low flow rate, control assembly 141 may move in an upward direction such that first control sleeve diameter 148*a* of the control sleeve 146 may approach second control pin diameter 124*b* of control pin 123. In this operation, a restricted flow area, referred to herein as control TFA 149*b*, is created. As control assembly 141 moves upward, and inner wall 147 of control sleeve 146 approaches the outer wall of control pin 123, the area of TFA 149 may reduce to control TFA 149*b*. By reducing to control TFA 149*b*, the control pressure differential is increased and the force exerted on control piston 145 is also increased. In some embodiments, at the low flow rate, the force exerted on control piston 145 by control piston spring 143 and the control pressure differential may balance at the control low flow position. Provided the flow rate is maintained at the low flow rate after having been previously at the high flow rate, pressure may be generated in control pin chamber 107*b* above control TFA 149*b* compared to lower pressure contained in control piston chamber 107*c* below the control TFA 149*b* due to the pressure drop across control TFA 149*b*. This pressure differential is referred to herein as the control low flow pressure differential. The control low flow pressure differential may act on control piston 145 to generate sufficient force to counteract the biasing force of control piston spring 143, thereby maintaining control assembly 141 in the control low flow position as depicted in FIG. 8. Upon further slowing or stopping the flow through drill string bore 12, the pressure differential across control TFA 149*b* may reduce or dissipate, lowering the force on control piston 145, allowing control piston spring 143 to bias control assembly 141 to return to the control reset position as depicted in FIG. 3.

Figure 14:
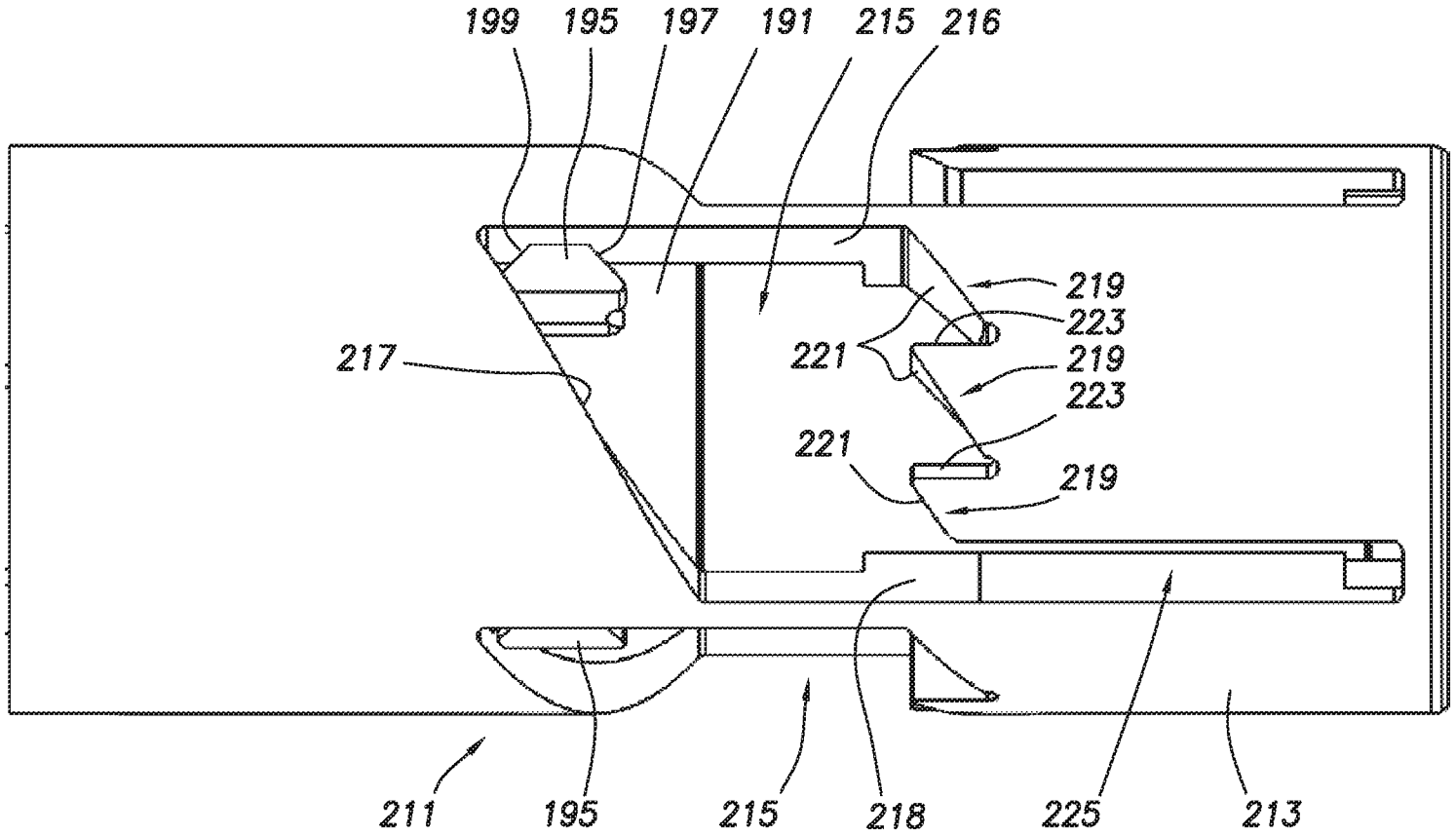
FIG. 14 depicts a side view of a pocket sleeve consistent with at least one embodiment of the present disclosure.

FIG. 14 depicts pocket assembly 211 consistent with embodiments of downhole tool actuator 100. Pocket assembly 211 may be mechanically coupled to outer sub 101. In some embodiments, pocket assembly 211 may be formed as a single unit. In other embodiments, as discussed further herein below with respect to FIG. 21, pocket assembly 211 may be formed from two or more subcomponents. Pocket assembly 211 may include pocket sleeve 213. Pocket sleeve 213 may be tubular. Pocket sleeve 213 may include one or more spline pockets 215 formed therein. In some embodiments, pocket sleeve 213 may include a spline pocket 215 for each spline projection 195 of spline barrel 191. Spline pocket 215 may be a cutout or depression within which the spline projection 195 may be positioned when downhole tool actuator 100 is assembled. Spline pocket 215 may define a boundary within which spline projection 195 may traverse during operation of downhole tool actuator 100 as further described herein below. In some embodiments, the boundary of spline pocket 215 may define a lower boundary, an upper boundary, reset boundary 216, and exit boundary 218 as further described below. In some embodiments, the lower boundary defined by spline pocket 215 may include one or more ratchet teeth or slopes positioned to engage spline projection 195 as stroking assembly 181 moves longitudinally relative to pocket assembly 211, to rotate spline barrel 191 relative to pocket assembly 211 toward exit boundary 218 as spline projection 195 engages the slope, and to limit the longitudinal movement of stroking assembly 181 as further described herein below. For example and without limitation, in some embodiments, the upper boundary defined by spline pocket 215 may include reset slope 217. Reset slope 217 may extend between reset boundary 216 and exit boundary 218 at an angle such that when spline barrel 191 is moved upward by longitudinal translation of stroking assembly 181, reset face 198 of spline projection 195 engages reset slope 217. Continued upward longitudinal translation of stroking assembly 181 may cause rotation of spline barrel 191 toward reset boundary 216 until spline projection 195 engages reset boundary 216. Further movement of stroking assembly 181 may be stopped once spline projection 195 engages reset slope 217 and reset boundary 216, defined as a "home" position with the stroking assembly 181 at the stroking reset position.

Figure 11:
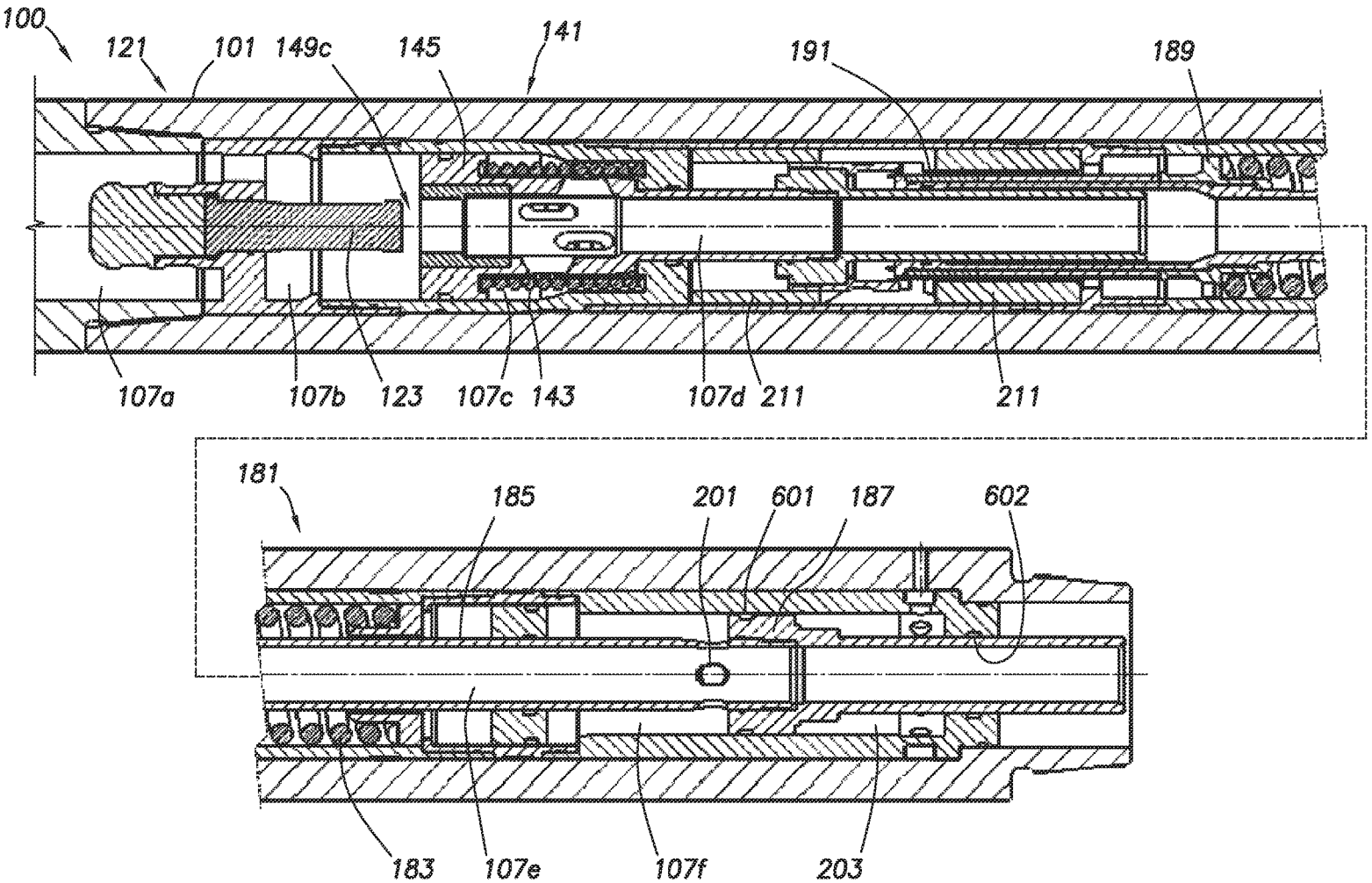
Figure 15A:
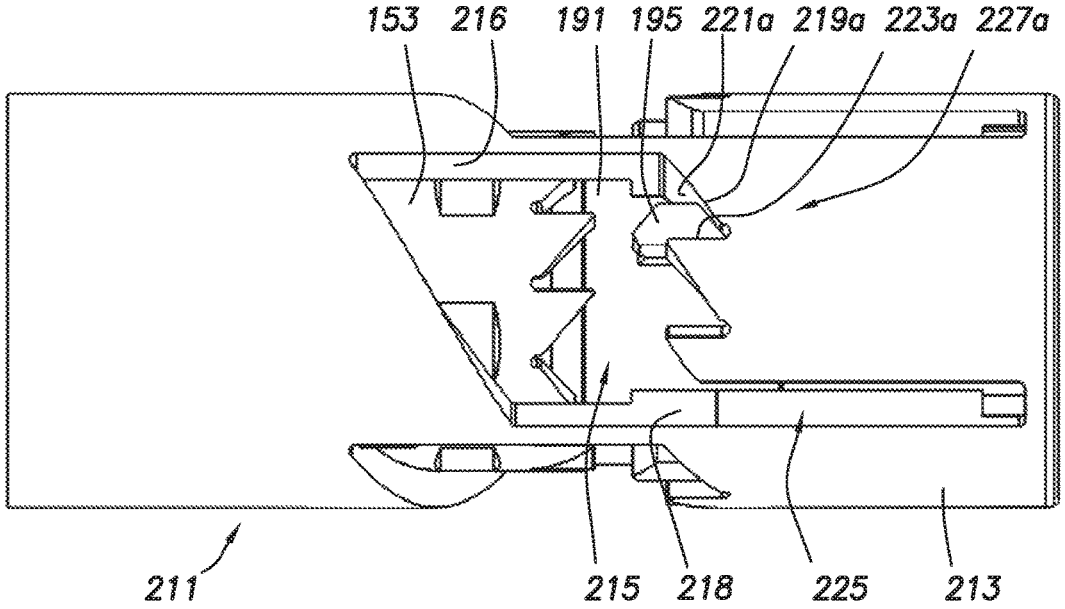
FIG. 15A depicts a partial side view of a downhole tool actuator consistent with at least one embodiment of the present disclosure at a stage in an actuation cycle.
Figure 17A:
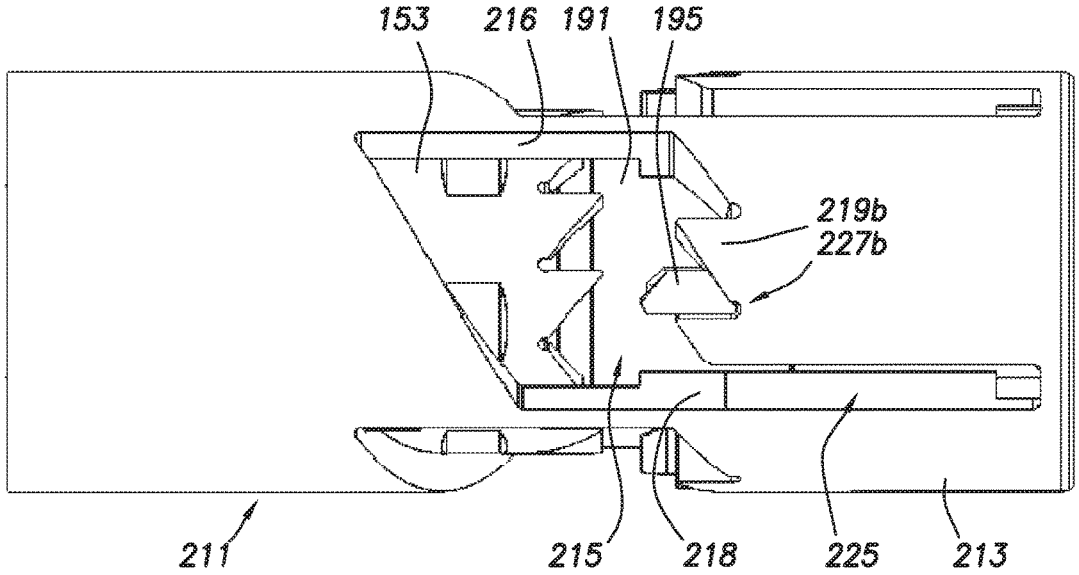
FIG. 17A depicts a partial side view of a downhole tool actuator consistent with at least one embodiment of the present disclosure at a stage in an actuation cycle.

In some embodiments, a portion of the lower boundary of spline pocket 215 may include one or more high flow ratchet teeth 219. Each high flow ratchet tooth 219 may include a ratchet slope 221 and a stop face 223. Each high flow ratchet tooth 219 may be engaged by the spline projection 195 as the stroking assembly 181 moves in a downward direction when spline projection 195 is aligned therewith. As the stroking assembly 181 moves in a downward direction, high flow ratchet face 197 of spline projection 195 may engage ratchet slope 221 of high flow ratchet tooth 219 causing rotational movement of spline barrel 191 towards exit boundary 218 until spline projection 195 makes contact with stop face 223 of the next high flow ratchet tooth 219. Stop face 223 may retard or prevent further rotational movement of spline barrel 191 and may stop further downward movement of stroking assembly 181, thereby setting a downward stroking limit for stroking assembly 181. The downward stroking limit when spline projection 195 engages high flow ratchet tooth 219 may be referred to as the high flow ratchet position, also referred to as a default position. FIGS. 15A and 17A depict spline projection 195 fully engaged in one of high flow ratchet teeth 219. FIG. 11 depicts the stroking assembly 181 in the high flow ratchet position or default position.

Figure 13:
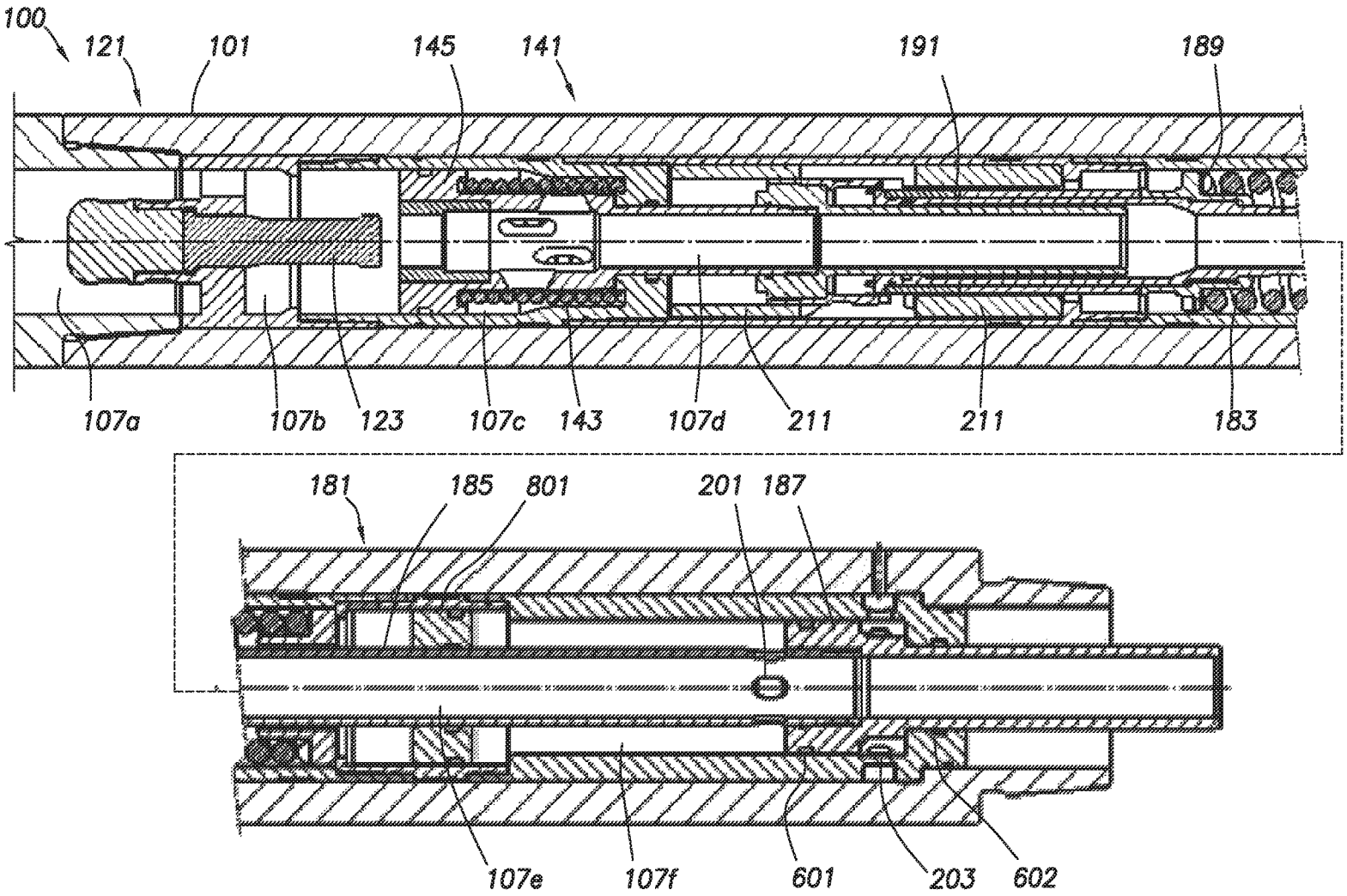
FIG. 13 depicts a cross section view of the downhole tool actuator of FIG. 2 in an actuation stroke position.
Figure 19A:
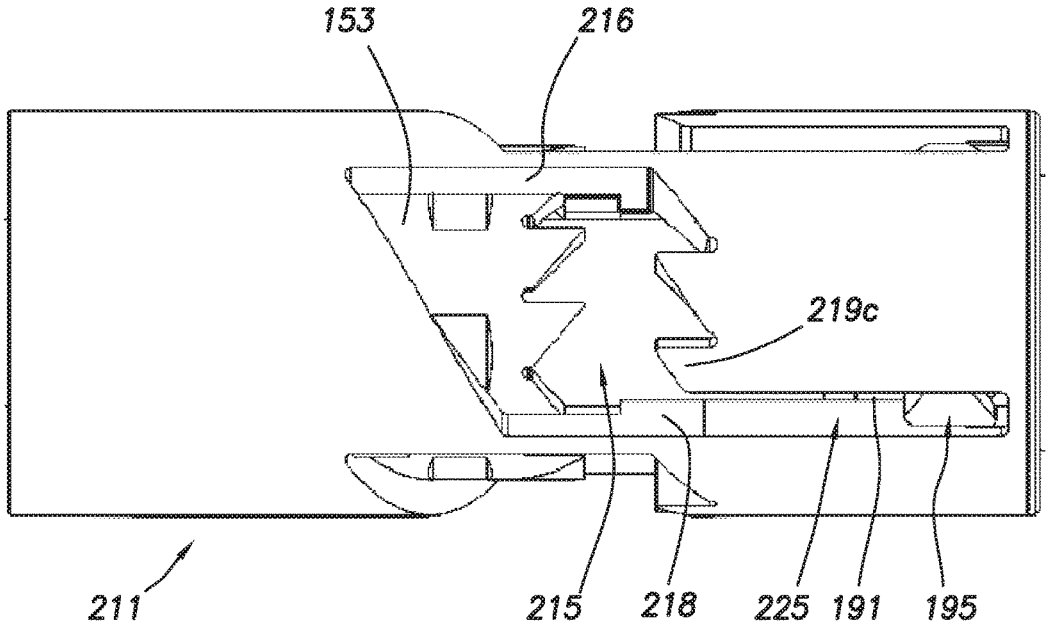
FIG. 19A depicts a partial side view of a downhole tool actuator consistent with at least one embodiment of the present disclosure at a stage in an actuation cycle.

In some embodiments, a portion of the lower boundary of spline pocket 215 may include actuation slot 225. Actuation slot 225 may extend further in the downward direction than high flow ratchet teeth 219. Actuation slot 225 may allow longitudinal movement of spline projection 195 such that the stroking assembly 181 may translate axially downward further than the high flow ratchet position to what is herein referred to as the actuation position. FIG. 19A depicts spline projection 195 located in actuation slot 225. FIG. 13 depicts stroking assembly 181 in the actuation position. In some embodiments, stroking assembly 181 may interact with downhole tool 15 when in the actuation position as further described herein below. In some embodiments, actuation slot 225 may be located at or may include a portion of exit boundary 218 of spline pocket 215.

In some embodiments, pocket assembly 211 may contain an alignment groove that may provide an axially sliding fit with alignment spline 159 of low flow ratchet sleeve 153. The alignment groove may angularly align pocket assembly 211 to control assembly 141 such that low flow ratchet teeth 157 are aligned with high flow ratchet teeth 219 and actuation slot 225. In some embodiments, pocket assembly 211 may be mechanically coupled to outer sub 101 such that pocket assembly 211 is fixed in axial longitudinal position within downhole tool actuator 100. In some embodiments, one or more components of pocket assembly 211 may be formed integrally with outer sub 101. In some such embodiments, spline pocket 215 may be at least partially formed in an inner surface of outer sub 101 such that spline pocket 215 is formed radially outward from the otherwise generally cylindrical inner surface of outer sub 101.

Figure 10:
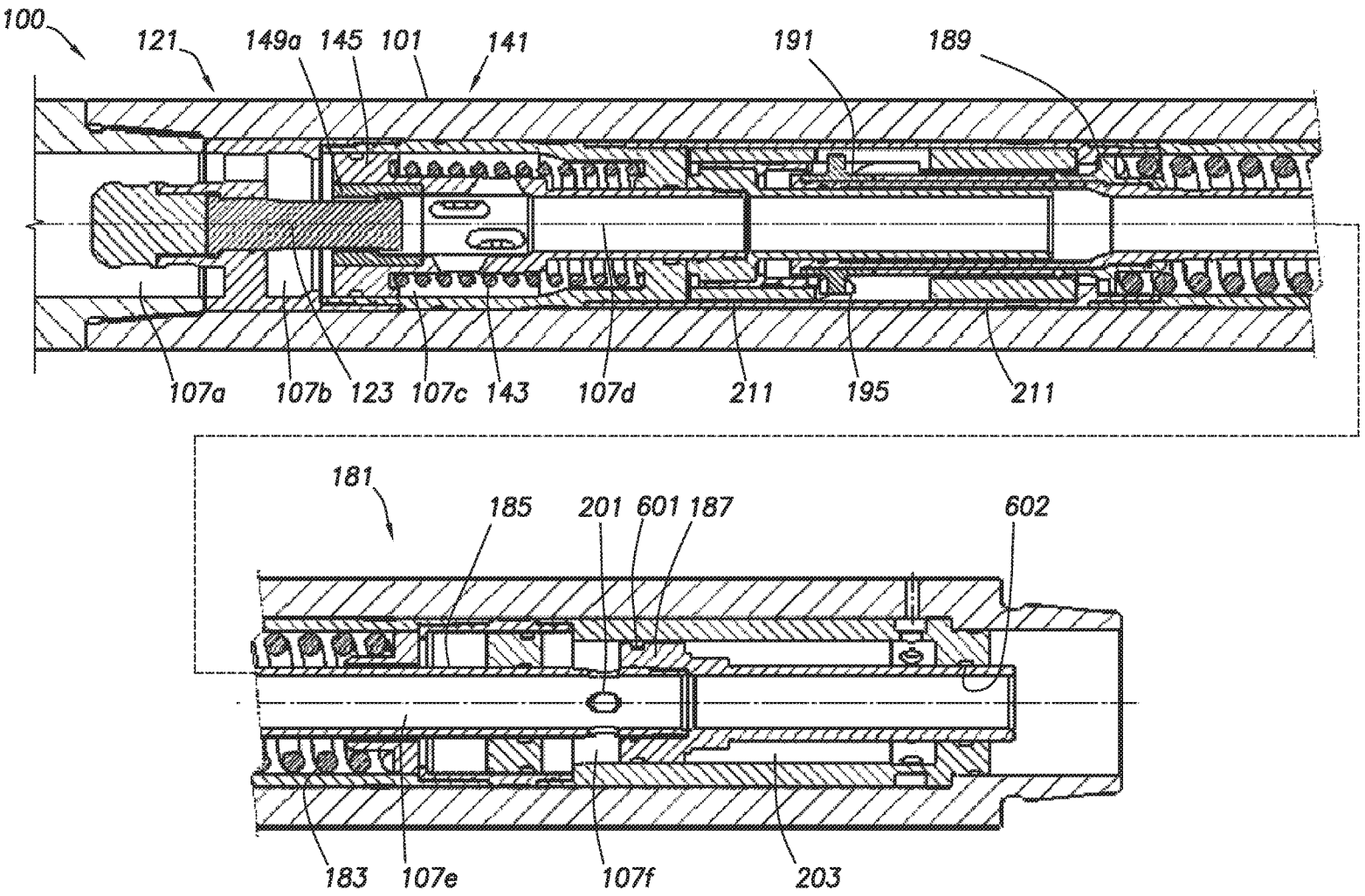
FIGS. 10-12 depict cross section views of the downhole tool actuator of FIG. 2 in a reset position, short stroke position and control low flow position respectively.

In some embodiments, as depicted in FIG. 10, when fluid flow is below the reset flow rate threshold (such as at zero flow rate), control assembly 141 and stroking assembly 181 may be in the respective reset positions. Control piston spring 143 may bias control assembly 141 into the control reset position, and stroking piston spring 183 may bias stroking assembly 181 into stroking reset position. In such a configuration, downhole tool actuator 100 is positioned in the reset position as depicted in FIG. 10.

At the high flow rate, control assembly 141 may move to the control high flow position, and stroking assembly 181 may move in a downward direction such that spline projection 195 engages either a high flow ratchet tooth 219 or actuation slot 225 of pocket sleeve 213. Depending on the orientation of spline barrel 191 and spline projection 195, spline projection 195 may engage high flow ratchet tooth 219 or actuation slot 225. When spline projection 195 engages a high flow ratchet tooth 219, the stroking assembly 181 may move to the high flow ratchet position. Downhole tool actuator 100 may be positioned in the short stroke position, as depicted in FIG. 11. When spline projection 195 engages actuation slot 225, stroking assembly 181 may move to the actuation position, and the downhole tool actuator 100 may be positioned in the actuation stroke position, as depicted in FIG. 13. At the high flow rate, downhole tool actuator 100 may move to either the short stroke position as depicted in FIG. 11 or the actuation stroke position as depicted in FIG. 13, depending on the position of spline projection 195 within pocket sleeve 213. The position of spline projection 195 within pocket sleeve 213 may be determined with respect to progress of an inert cycle, default cycle, stay cycle, actuation cycle or indexing cycle, each further described herein below.

Once stroking assembly 181 is in the actuation or high flow ratchet position, a reduction in flow rate through drill string bore 12 may cause stroking assembly 181 to move from the actuation position or high flow ratchet position to either the reset position or the low flow ratchet position due to the biasing force of stroking piston spring 183.

Figure 12:
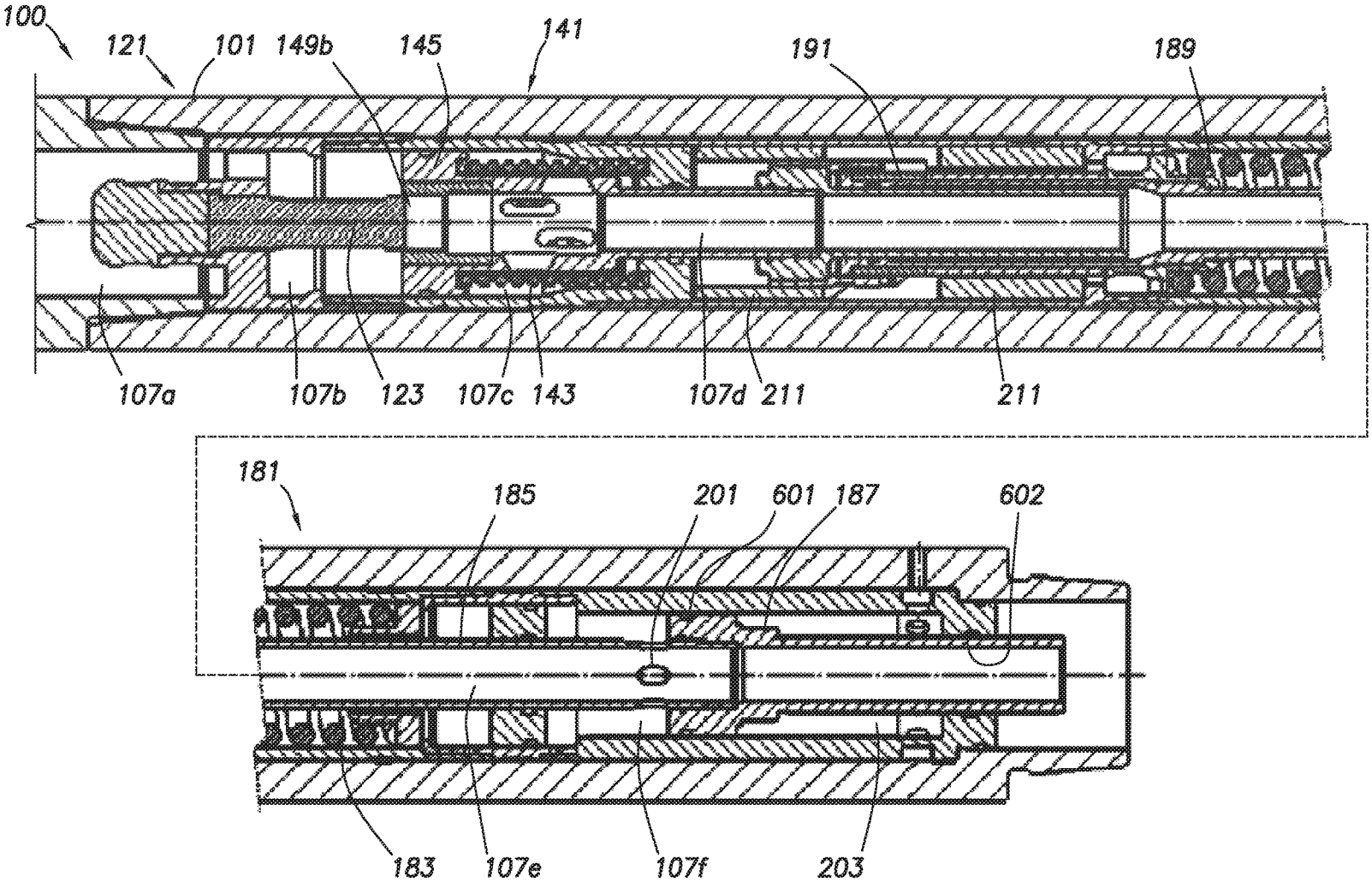

When the flow rate through drill string bore 12 is reduced from the high flow rate and maintained at the low flow rate, control assembly 141 may translate upward from the control high flow position to and be maintained at the control low flow position, while stroking assembly 181 moves upward to the low flow ratchet position as depicted in FIG. 12. When the flow rate through drill string bore 12 remains above the low flow rate, spline projection 195 of spline barrel 191 of stroking assembly 181 may engage a low flow ratchet tooth 157 of low flow ratchet sleeve 153. Stroking assembly 181 may, due to the biasing force of stroking piston spring 183, impart a force against control assembly 141. The control pressure differential, i.e. the control low flow pressure differential, may provide sufficient force to overcome the combined bias of both control piston spring 143 and stroking piston spring 183 such that stroking assembly 181 is held in the low flow ratchet position as depicted in FIG. 12.

When the flow rate through drill string bore 12 is below the low flow rate, control assembly 141 and stroking assembly 181 may be fully biased to their respective reset positions as depicted in FIG. 10 by control piston spring 143 and stroking piston spring 183. As the flow rate through drill string bore 12 is reduced, the control pressure differential may reduce until the bias of control piston spring 143 and stroking piston spring 183 is higher than the force imparted on control piston 145. Control assembly 141 and stroking assembly 181 are biased to their respective reset positions.

In some embodiments, downhole tool actuator 100 may be configured such that at any stage of a fluid flow rate sequence such as, for example and without limitation, an inert cycle, a default cycle, a stay cycle, an actuation cycle or an indexing cycle, as described below, the removal of flow through downhole tool actuator 100 may cause the return of control assembly 141 and stroking assembly 181 to their respective reset positions as depicted in FIG. 10, referred to herein as a reset sequence depicted in FIGS. 20A-20E. Initiating a reset sequence at a flow step in the actuation cycle prior to downhole tool actuator 100 moving to the actuation stroke position may be referred to as an inert cycle or a default cycle. In some embodiments, where a number of operations may be undertaken with drill string 10 positioned in wellbore 20 before downhole tool 15 is to be activated, reconfigured, or otherwise actuated, the flow rate through drill string bore 12 may vary according to the operations being performed. In some such cases, the flow rate may increase to an "operational" flow rate above the high flow rate threshold. In some such cases, unwanted actuation of downhole tool 15 may be avoided despite the changes in flow rate due to the necessity of a full actuation cycle before such actuation may occur. In such a case, downhole tool actuator 100 may undergo multiple inert or default cycles without actuation of downhole tool 15. The initial operational status, mode, or configuration of downhole tool 15 may define a default configuration such that other than in the case where a full actuation cycle is undertaken, downhole tool 15 remains in the default configuration as high flow ratchet teeth 219 prevent downhole tool actuator 100 from moving to the actuation position. Such an inert or default cycle is depicted in FIGS. 44A-44D.

Figure 44A:
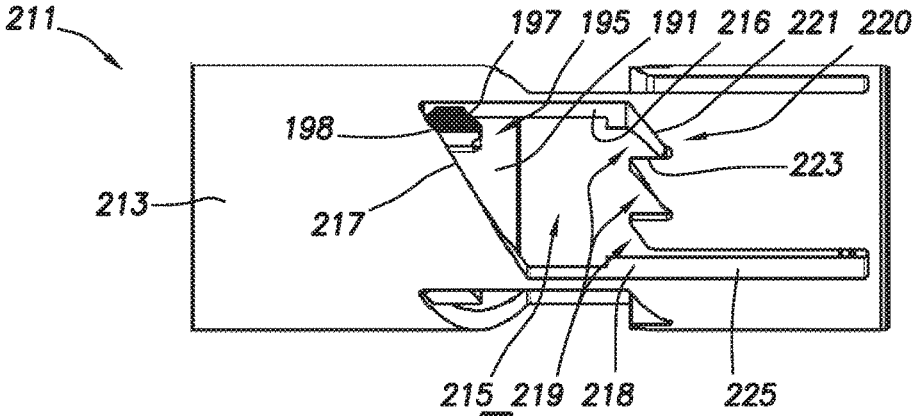
FIGS. 44A-44G depict an inert or default cycle of a downhole tool actuator consistent with at least one embodiment of the present disclosure.
Figure 44B:
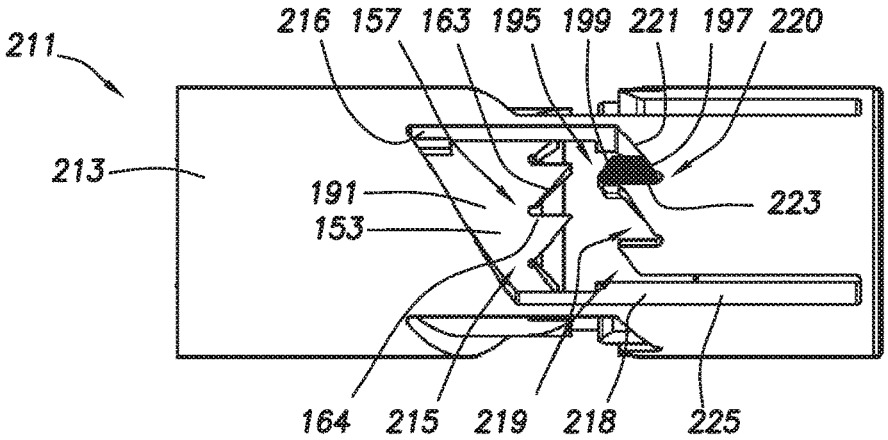
Figure 44C:
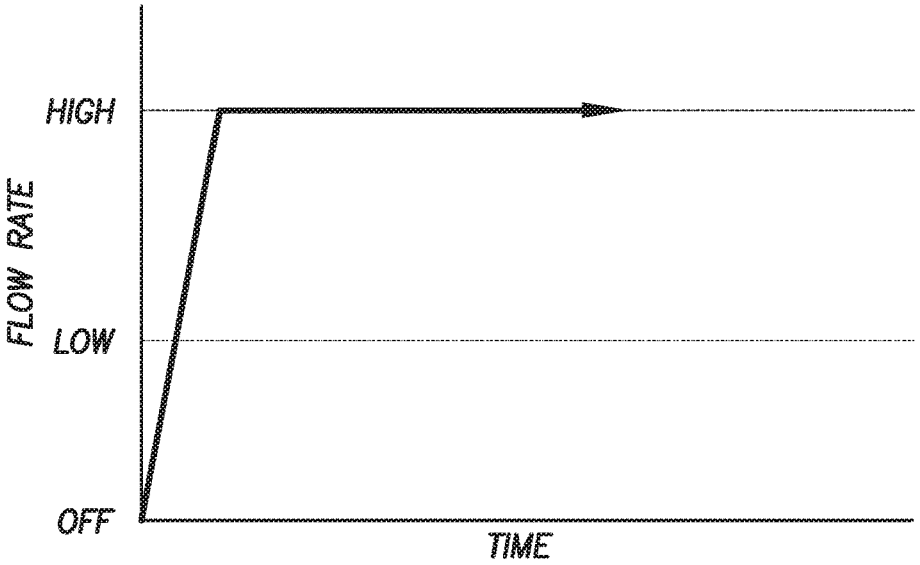
Figure 44D:
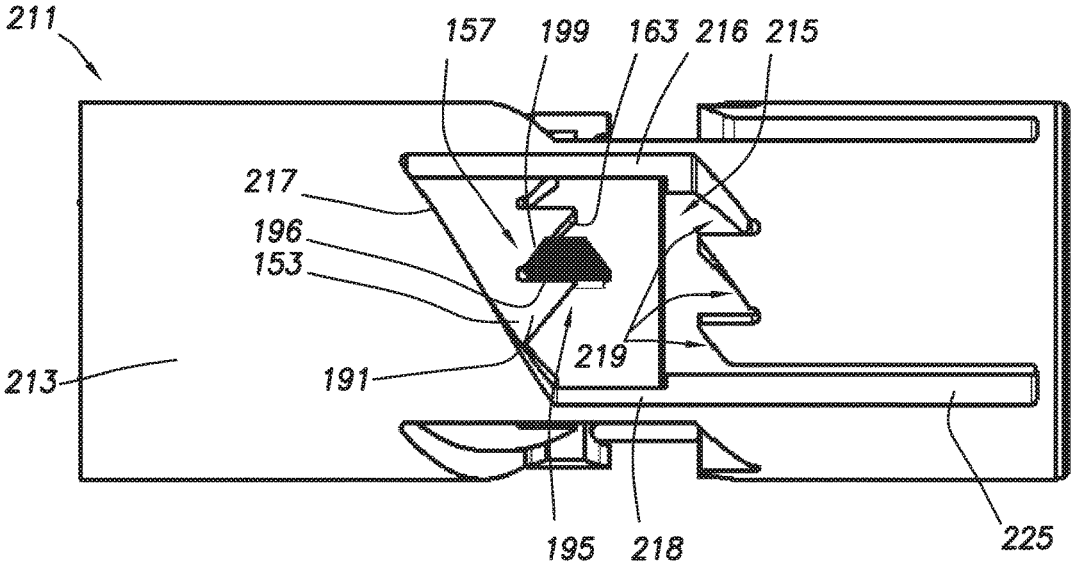
Figure 44E:
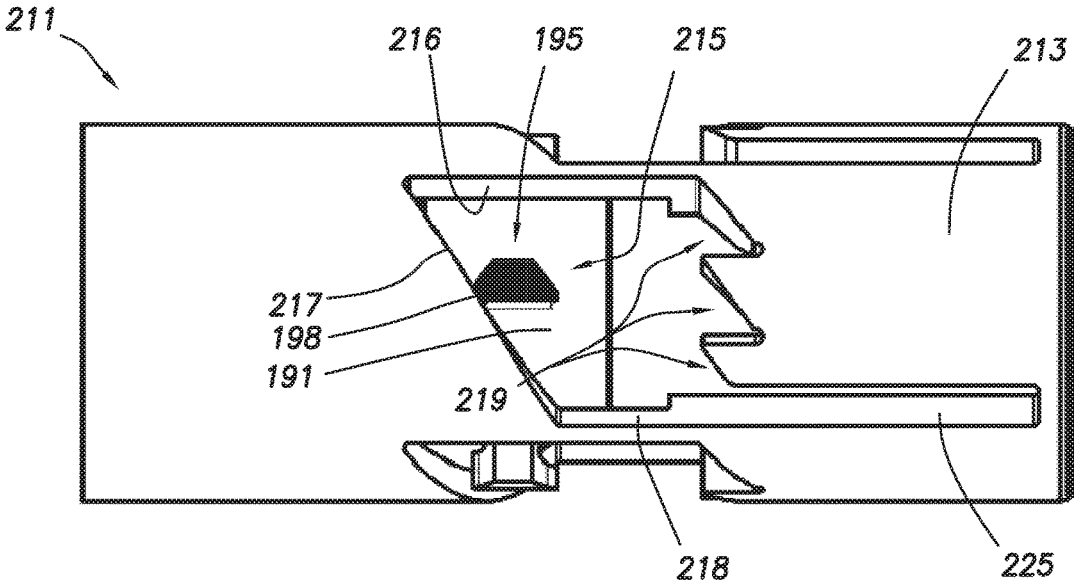
Figure 44F:
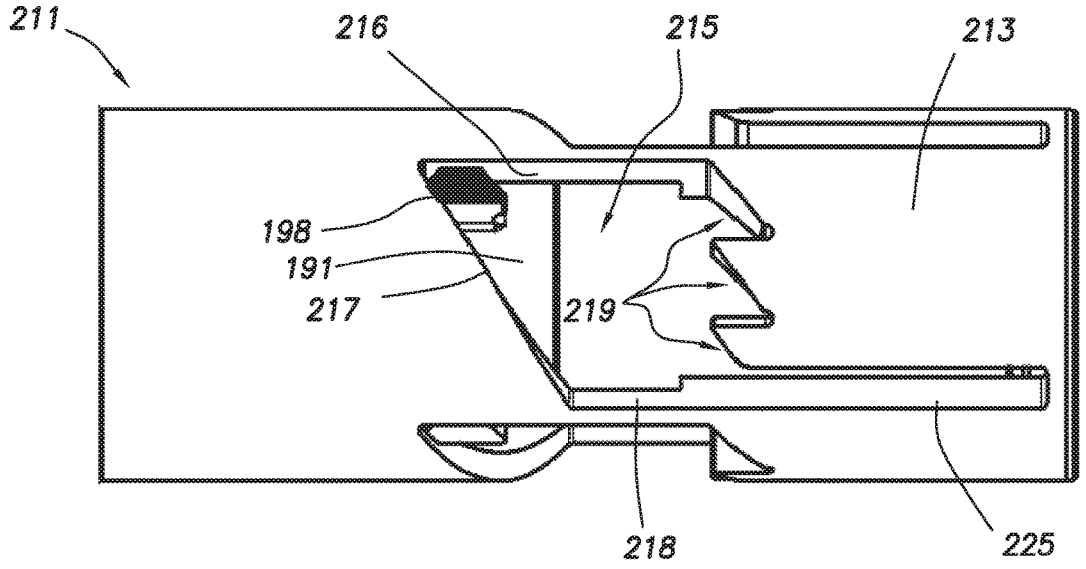
Figure 44G:
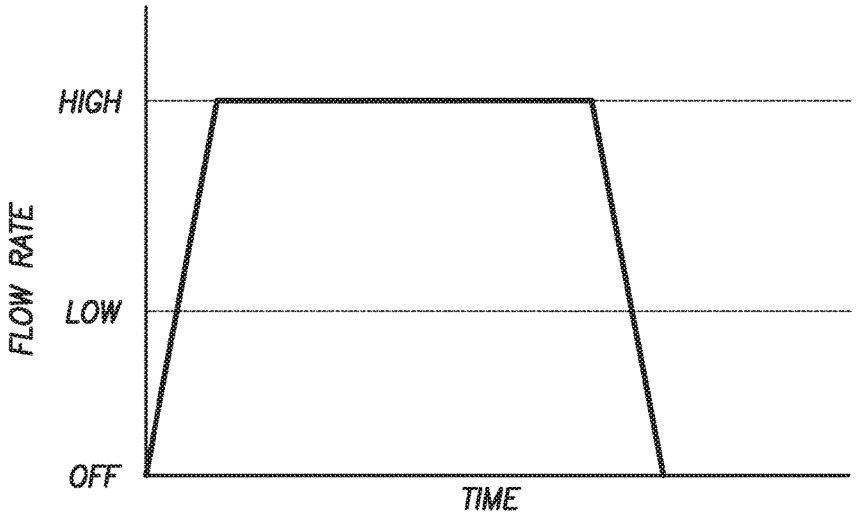

In some embodiments, downhole tool actuator 100 may begin the inert or default cycle in the reset position as depicted in FIG. 10, with control assembly 141 and stroking assembly 181 in their reset positions, such that spline projection 195 is in the home position against reset slope 217, as depicted in FIG. 44A. The flow rate may be increased through downhole tool actuator 100 to the high flow rate as shown in FIG. 44C during normal operations of drill string 10 in wellbore 20. As flow rate increases, control assembly 141 shifts downward into the control high flow position (depicted in FIG. 8) and stroking assembly 181 shifts downward into the high flow ratchet position such that spline projection 195 engages first ratchet slope 221*a* as depicted in FIG. 44B, is rotated to a first high flow ratchet position 227*a*, and first stop face 223*a* of first high flow ratchet tooth 219*a* limits longitudinal movement of stroking assembly 181 to position downhole tool actuator 100 at the short stroke position as depicted in FIG. 11. Fluid flow may be maintained at or set above the high flow rate such as to an operational flow rate for a prolonged duration, as depicted in FIG. 44C, which may allow drilling operations to continue with downhole tool 15 maintained set in its default or current operational mode. After the current drilling operation is complete, the flow through downhole tool actuator may be reduced or stopped as depicted in FIG. 44G. As the flow rate reduces to the low flow rate, stroking piston spring 183 may bias stroking assembly upward until spline projection 195 of spline barrel 191 of stroking assembly 181 engages a low flow ratchet tooth 157 of low flow ratchet sleeve 153 as depicted in FIG. 44D. As the flow rate reduces to zero, control piston spring 143 may bias control assembly 141 upward to the control reset position such that low flow ratchet teeth 157 move upward out of alignment with the boundary of spline pocket 215 as depicted in FIG. 44E. Stroking piston spring 183 may bias stroking assembly 181 upward such that spline projection 195 engages reset slope 217 as depicted in FIG. 44E. Continued upward movement of stroking assembly 181 may return stroking assembly 181 to the stroking reset position, with spline projection 195 engaging reset slope 217 and reset boundary 216 as depicted in FIG. 44F, such that downhole tool actuator 100 returns to the reset position. In some embodiments, by including additional high flow ratchet teeth 219 (and corresponding low flow ratchet teeth 157), unintentional actuation of downhole tool 15 may be avoided by requiring additional changes in flow rate as described below with respect to the actuation cycle. The chance of an unintentional actuation of downhole tool 15 caused by, for example, unintentional lowering of the flow rate to the low flow rate, may therefore be reduced.

An actuation cycle as described herein refers to a series of changes in flow rate through downhole tool actuator 100 to cause the shifting of control assembly 141 and stroking assembly 181 until stroking assembly 181 is in the actuation position as described herein above with respect to FIG. 13.

In some embodiments, downhole tool actuator 100 may begin the actuation cycle in the reset position as depicted in FIG. 10, with control assembly 141 and stroking assembly 181 in their respective reset positions, such that spline projection 195 is in the home position against reset slope 217, as depicted in FIG. 14. In some embodiments, the rate of fluid flow through downhole tool actuator 100 at the beginning of the actuation cycle may be zero.

Figure 15B:
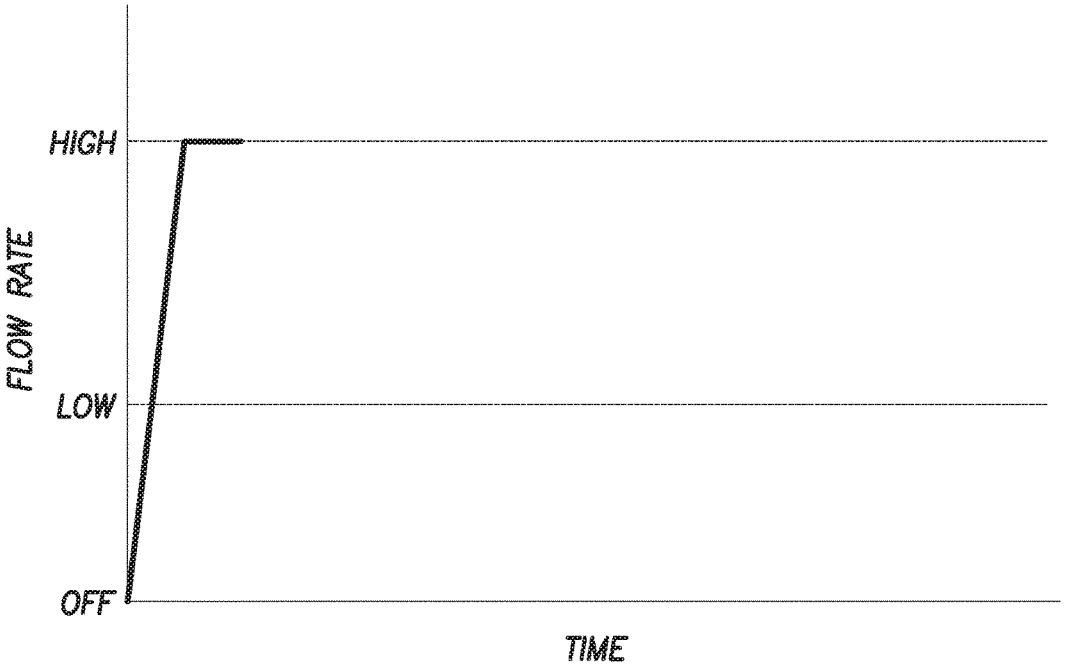
FIG. 15B depicts a chart of fluid flow rates of an actuation cycle.

The flow rate may be increased through downhole tool actuator 100 to the high flow rate, defining the first flow rate step as depicted in FIGS. 15A and 15B. As flow rate increases, control assembly 141 shifts downward into the control high flow position (depicted in FIG. 8) and stroking assembly 181 shifts downward into the high flow ratchet position such that spline projection 195 engages first ratchet slope 221*a*, spline barrel 191 is rotated toward exit boundary 218 until spline projection 195 makes contact with first stop face 223*a* of first high flow ratchet tooth 219*a*, defining first high flow ratchet position 227*a*, and first stop face 223*a* of first high flow ratchet tooth 219*a* limits longitudinal movement of stroking assembly 181 to position downhole tool actuator 100 at the short stroke position as depicted in FIG. 11.

Figure 16A:
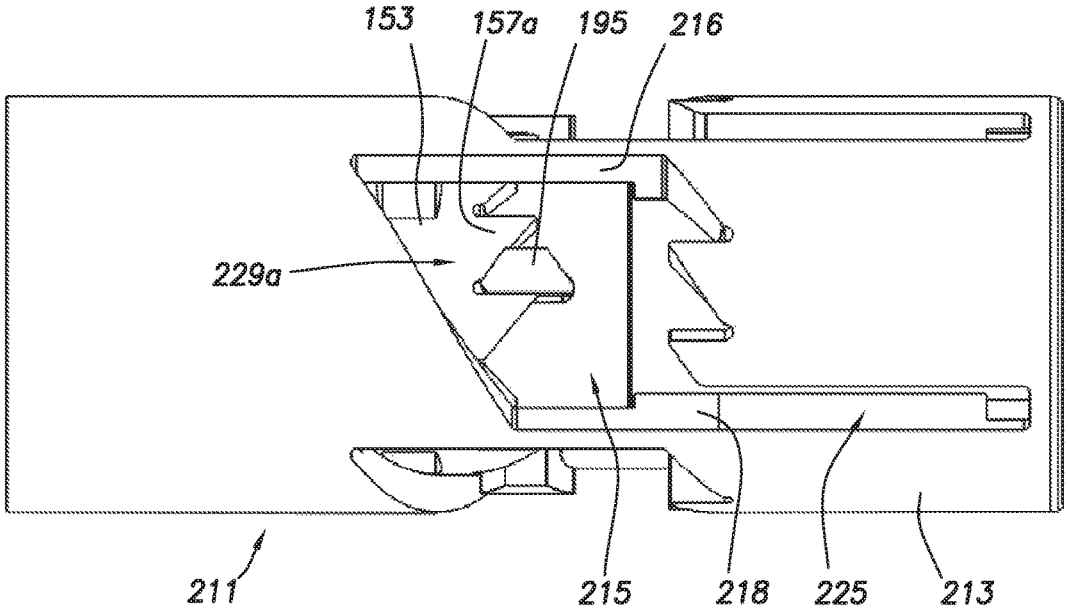
FIG. 16A depicts a partial side view of a downhole tool actuator consistent with at least one embodiment of the present disclosure at a stage in an actuation cycle.
Figure 16B:
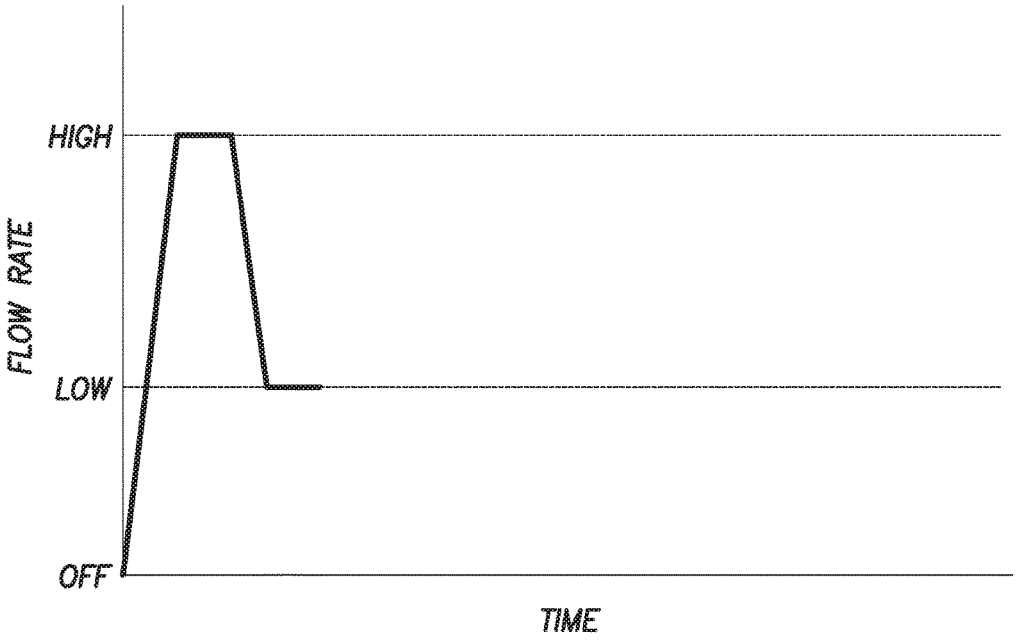
FIG. 16B depicts a chart of fluid flow rates of an actuation cycle.

The flow rate may then be decreased to the low flow rate, defining the second flow rate step as depicted in FIGS. 16A and 16B. Control assembly 141 translates upward to the control low flow position. The low flow rate maintains control assembly 141 in the control low flow position as stroking assembly 181 moves upward to the low flow ratchet position (depicted in FIG. 12). As stroking assembly 181 moves upward, spline projection 195 of spline barrel 191 engages first low flow ratchet tooth 157*a*, causing spline barrel 191 to rotate into first low flow ratchet position 229*a*, and low flow ratchet sleeve 153 restricts further upward movement of stroking assembly 181 past the low flow ratchet position. Low flow ratchet sleeve 153 may, when control assembly 141 is in the control low flow position, be positioned such that spline projection 195 does not contact reset slope 217 or such that low flow ratchet sleeve 154 prevents further upward movement of spline projection 195 along reset slope 217.

Figure 17B:
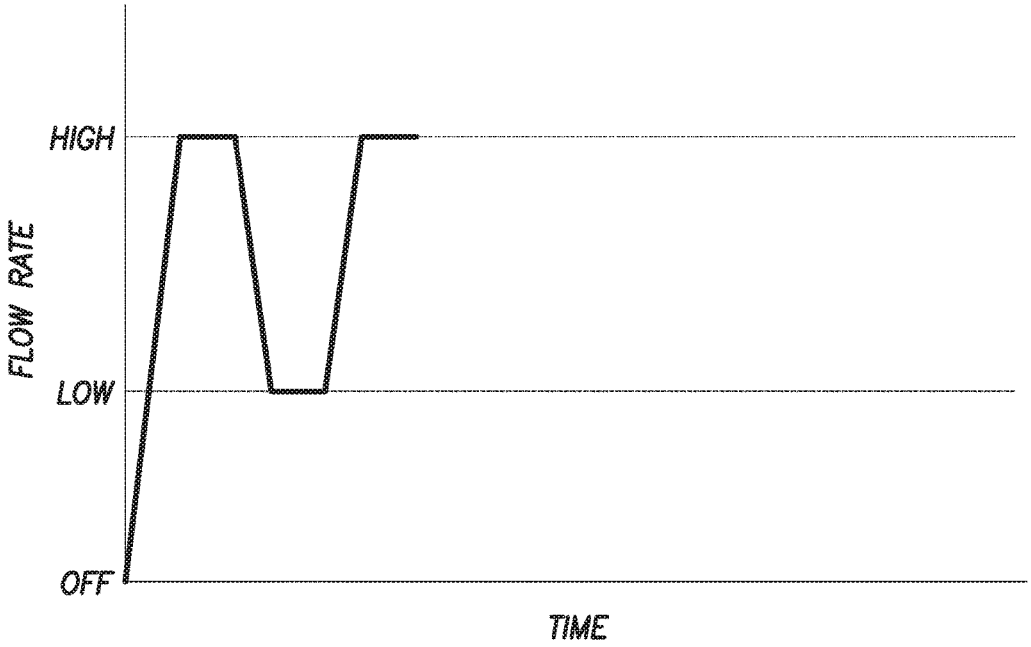
FIG. 17B depicts a chart of fluid flow rates of an actuation cycle.
Figure 18A:
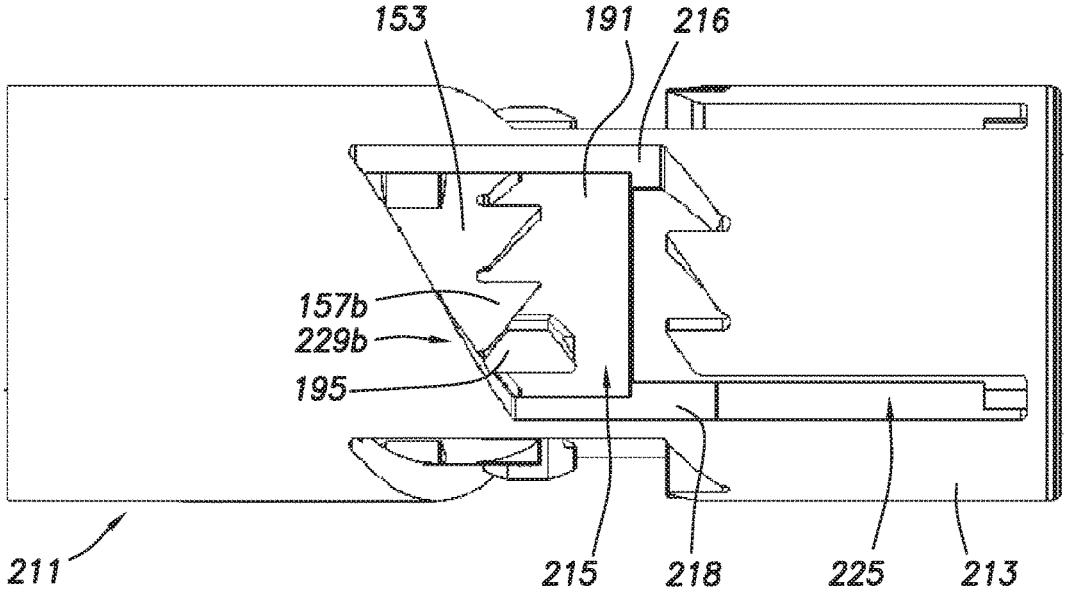
FIG. 18A depicts a partial side view of a downhole tool actuator consistent with at least one embodiment of the present disclosure at a stage in an actuation cycle.
Figure 18B:
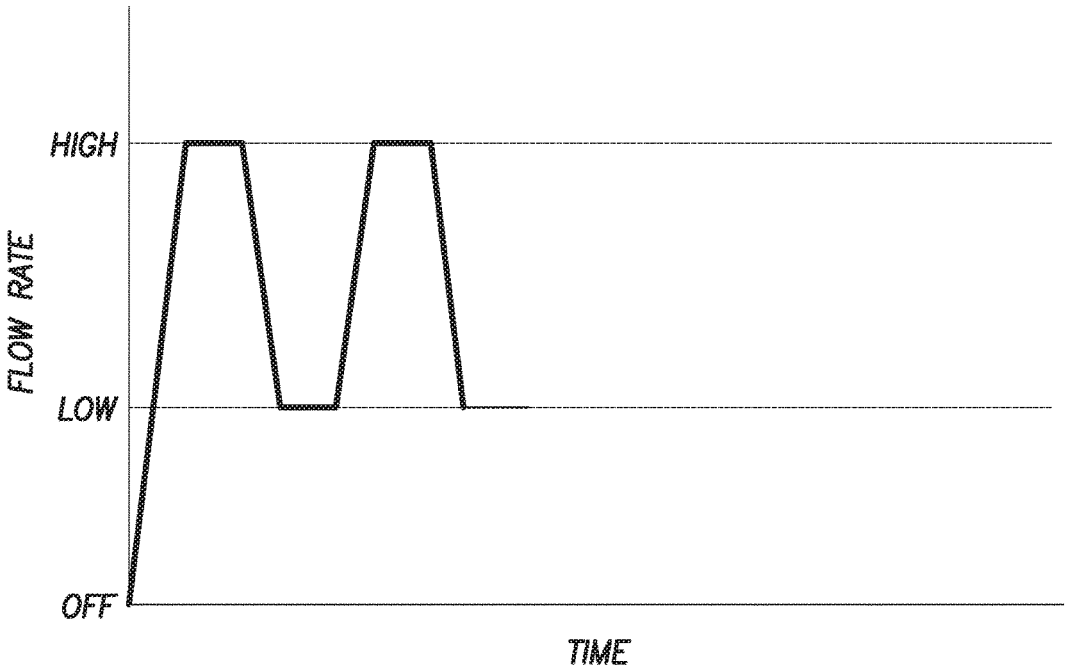
FIG. 18B depicts a chart of fluid flow rates of an actuation cycle.
Figure 19B:
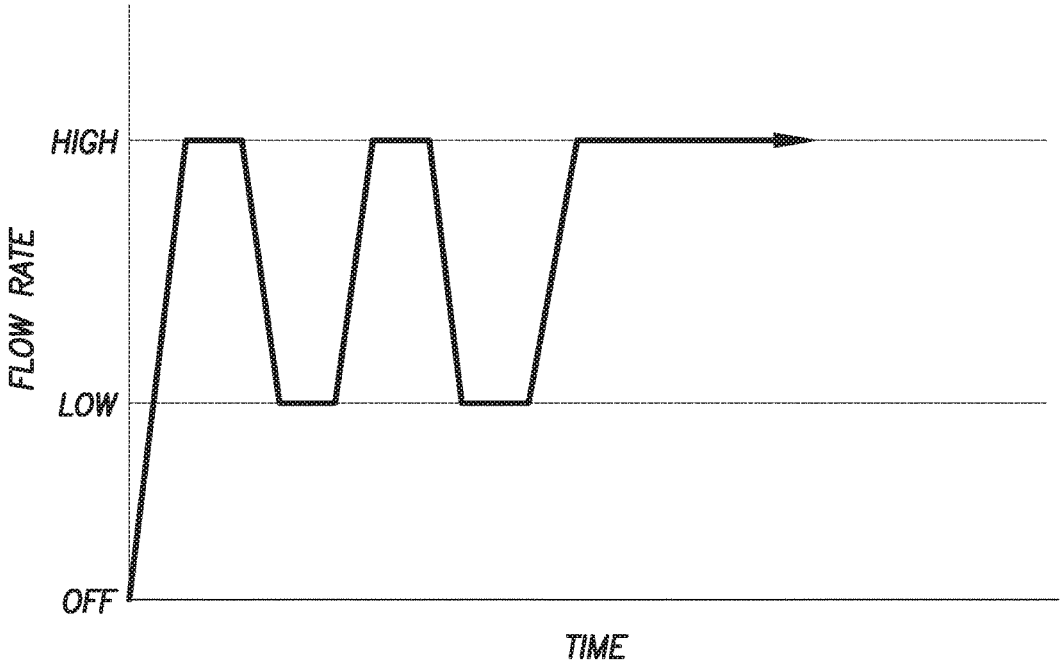
FIG. 19B depicts a chart of fluid flow rates of an actuation cycle.

The flow rate may then be switched between the high flow rate and the low flow rate causing the stroking assembly 181 to shift between the high flow ratchet position and the low flow ratchet position until spline projection 195 is aligned with actuation slot 225. Such an alignment allows stroking assembly 181 to shift into the actuation position as depicted in FIG. 13, with the spline projection 195 positioned as depicted in FIG. 19A. The number of flow rate steps may depend on the number of high flow ratchet teeth 219 and low flow ratchet teeth 157. For example, as depicted in FIGS. 17A, 17B, the flow rate may be increased to the high flow rate a second time, defining the third flow rate step as depicted in FIGS. 17A and 17B. The control assembly 141 shifts downward into the control high flow position and stroking assembly 181 translates downward to the high flow ratchet position such that spline projection 195 engages second high flow ratchet tooth 219*b*, positioning spline projection 195 in second high flow ratchet position 227*b* (again placing stroking assembly 181 in the high flow ratchet position). The flow rate may then be decreased to the low flow rate, defining the fourth flow rate step as depicted in FIGS. 18A and 18B. Control assembly 141 translates upward to the control low flow position. As stroking assembly 181 translates upward to the low flow ratchet position, spline projection 195 engages second low flow ratchet tooth 157*b*, causing spline projection 195 to be positioned in second low flow ratchet position 229*a* with stroking assembly 181 in the low flow ratchet position and downhole tool actuator 100 positioned at the control stroke as depicted in FIG. 12. The flow rate may then be increased to the high flow rate for a third time, defining the fifth flow rate step as depicted in FIGS. 19A, 19B. Control assembly 141 shifts downward into the control high flow position and the stroking assembly 181 shifts downward such that spline projection 195 engages third high flow ratchet tooth 219*c*. High flow ratchet tooth 219*c* may cause spline barrel 191 to rotate, allowing spline projection 195 to continue moving downward into actuation slot 225, allowing stroking assembly 181 to move longitudinally to the actuation position such that the downhole tool actuator 100 is positioned at the actuation stroke position as depicted in FIG. 13. Once in the actuation position, the high flow rate may continue, maintaining stroking assembly 181 in the actuation position and, in some embodiments, activating downhole tool 15.

In some embodiments, for example and without limitation, downhole tool actuator 100 may cause downhole tool 15 to change to a different mode or position. In some such embodiments, reduction of flow may not deactivate downhole tool 15 or cause downhole tool 15 to revert to the original mode or position. In some embodiments, a subsequent actuation cycle may be performed to change downhole tool 15 to change to a different mode or position or to deactivate downhole tool 15.

Figure 20A:
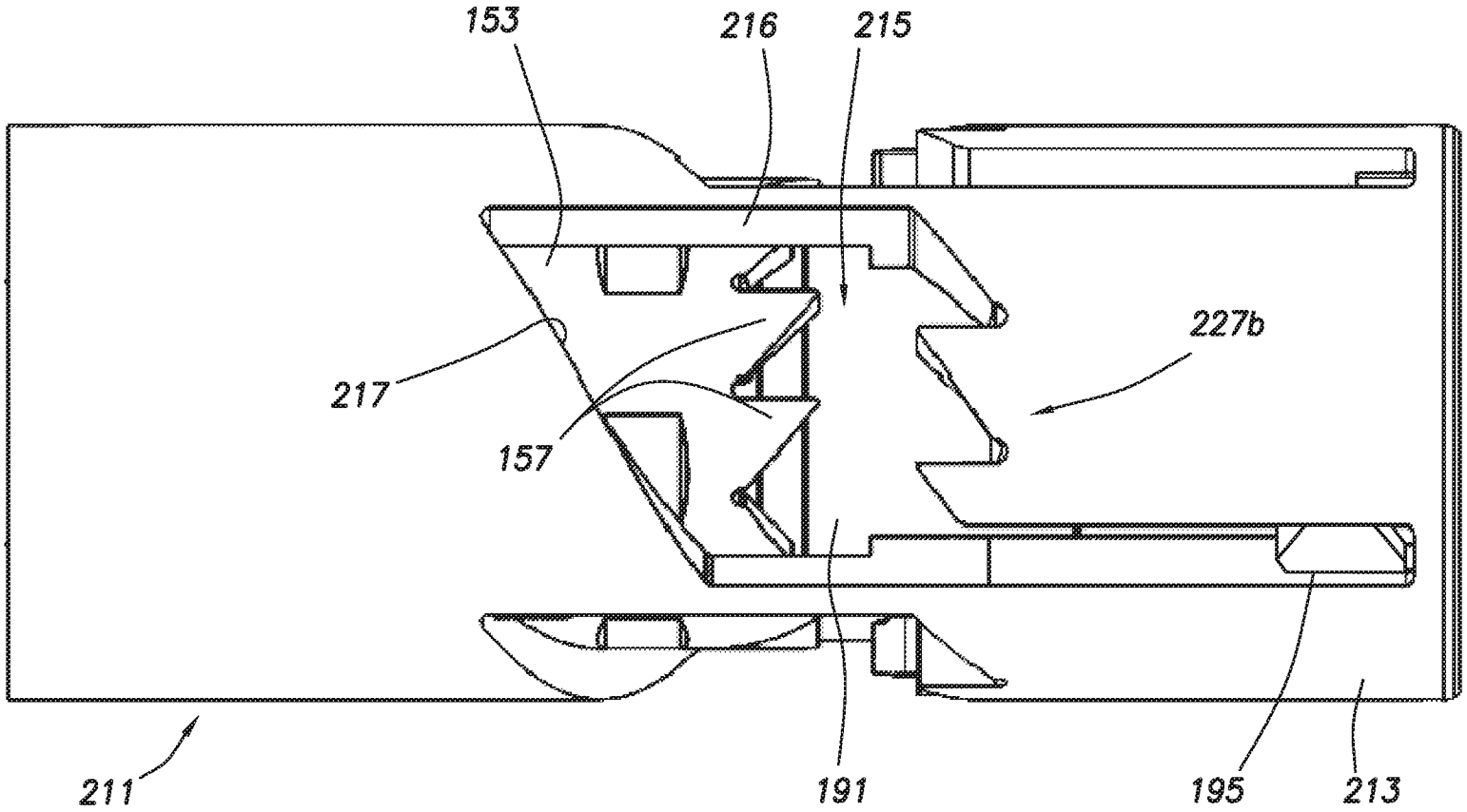
FIGS. 20A-20D depict partial side views of a downhole tool actuator consistent with at least one embodiment of the present disclosure in a reset sequence as depicted in FIG. 20E.

In some embodiments, when downhole tool actuator 100 is at the actuation stroke position, a step of reducing flow rate to a flow rate below the low flow rate threshold or stopping fluid flow through downhole tool actuator 100 may be included in the actuation cycle, defining a sixth flow step. Such an operation may be described as a reset sequence as further described herein above with reference to FIGS. 20A-E. FIG. 20A depicts spline projection 195 in the actuation position. The actuation cycle may consist of flow steps such that the reset sequence may be initiated prior to completion of an actuation cycle, where a subsequent full actuation cycle may result in an actuation. In such an embodiment, the actuation of downhole tool 15 may be considered complete once the reset sequence of downhole tool actuator 100 is completed.

In some embodiments, reduction of flow rate such that downhole tool actuator 100 is no longer in the actuation position may not deactivate downhole tool 15 or cause downhole tool 15 to revert to the previous configuration or operating mode. In some embodiments, a subsequent actuation cycle may be performed to change downhole tool 15 to a different mode or position or to deactivate downhole tool 15. In some embodiments, downhole tool actuator 100 may actuate or interact with downhole tool 15 only when downhole tool actuator 100 is positioned at the actuation stroke position. In such an embodiment, the actuation will remain active provided pumps 14 remain set at the high flow rate. Lowering the flow rate to below the low flow rate may reset downhole tool actuator 100 such that increasing the flow rate to the high flow rate causes downhole tool actuator 100 to return to the short stroke position and downhole tool 15 reverts to its original mode or position.

Figure 20B:
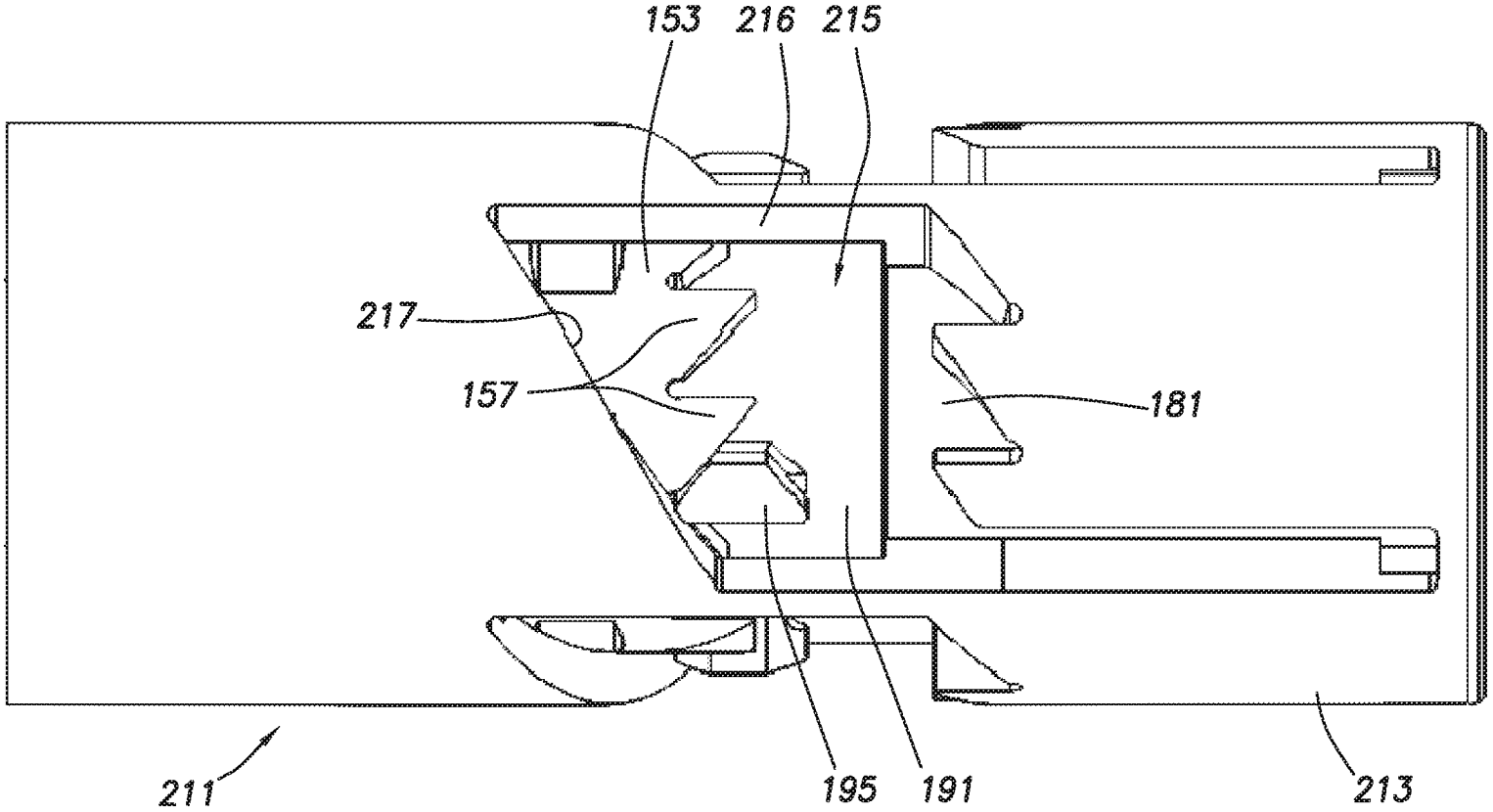
Figure 20C:
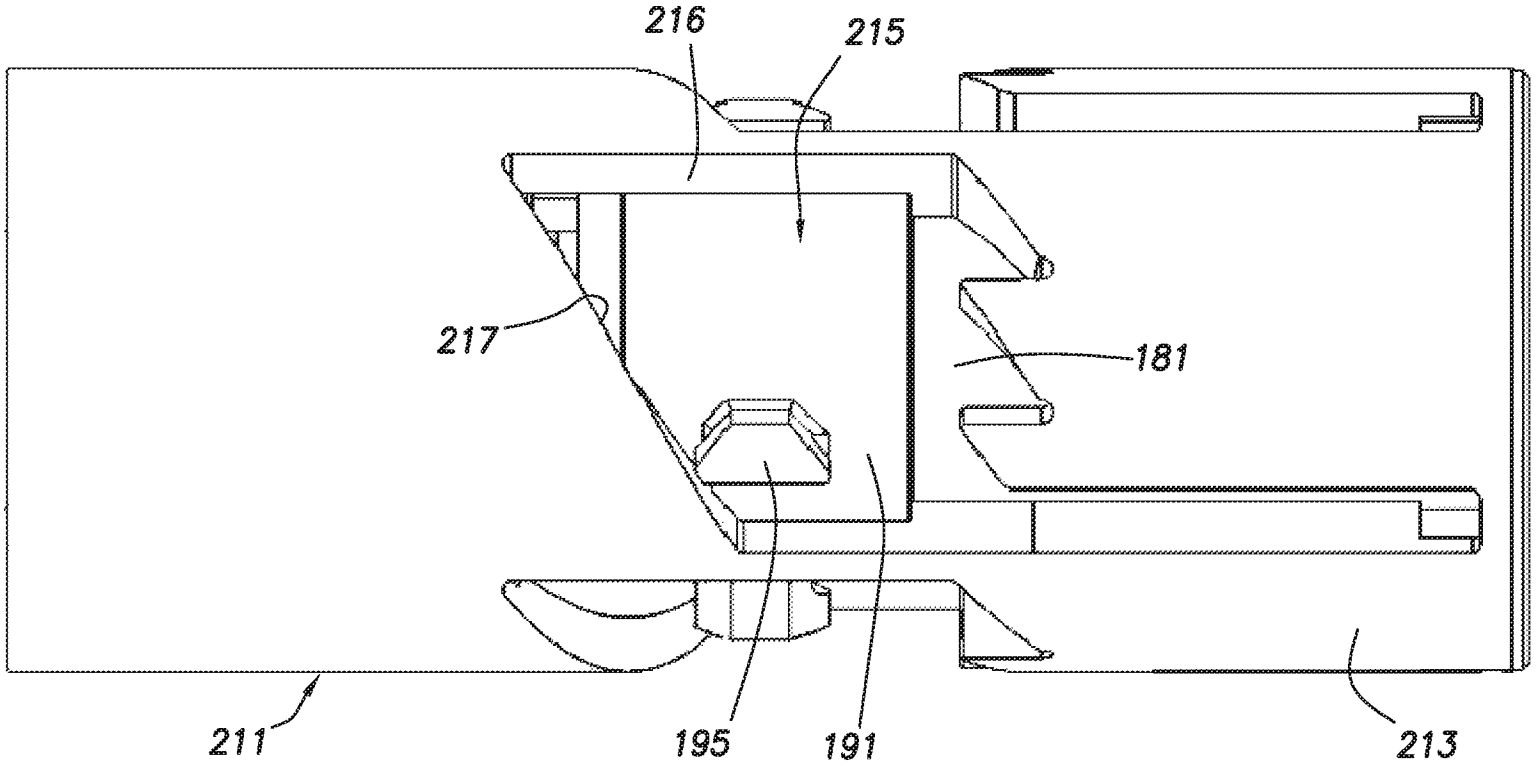
Figure 20D:
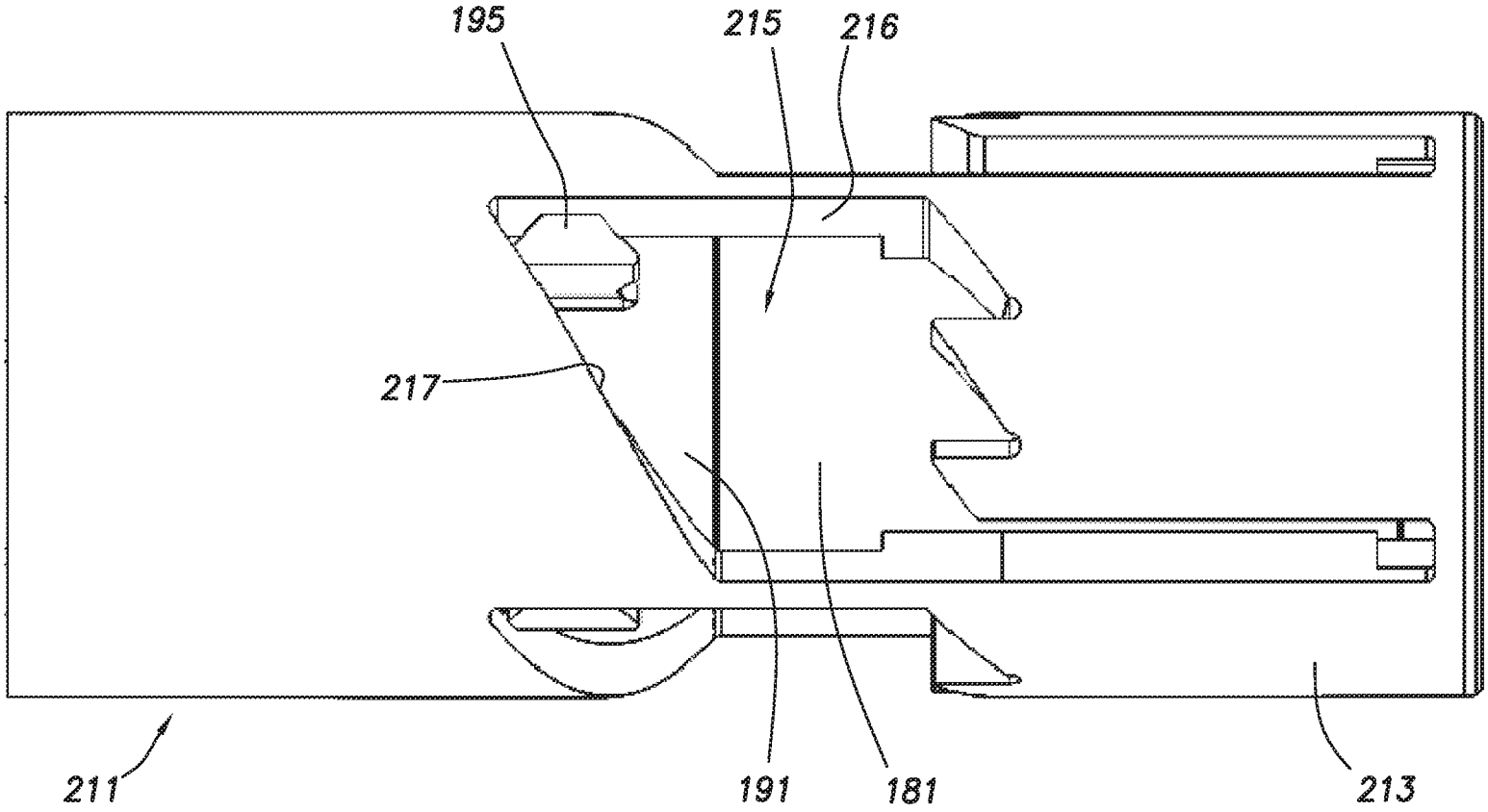
Figure 20E:
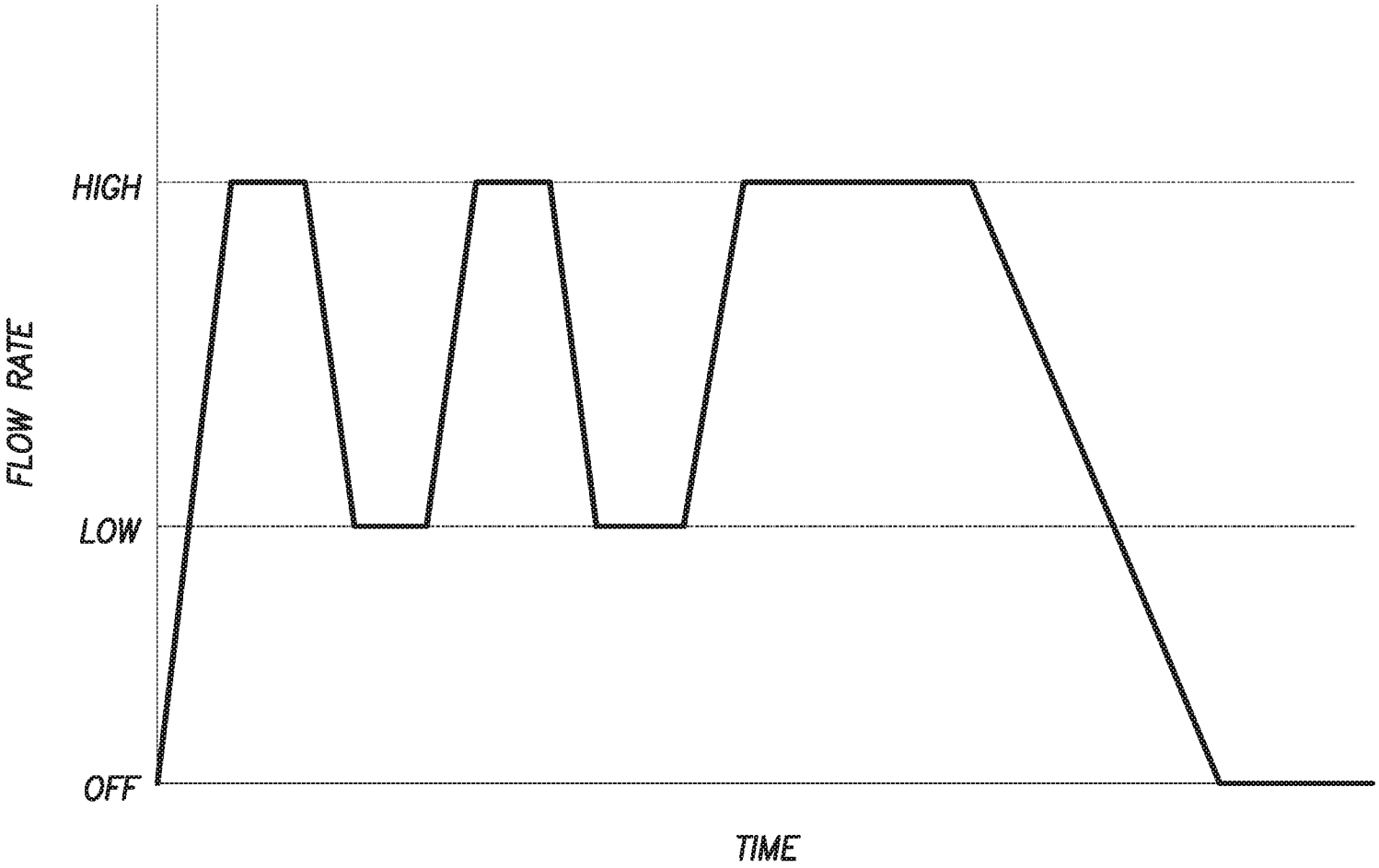

A reset sequence of downhole tool actuator 100 consistent with at least one embodiment of the present disclosure will now be described. FIG. 20A depicts spline projection 195 engaged in actuation slot 225 and stroking assembly 181 in the actuation position. Control assembly 141 and stroking assembly 181 will return to the stroking reset position regardless of the position of spline projection 195 at the beginning of the reset sequence. As fluid flow slows as depicted in FIG. 20E, from the high flow rate by turning pumps 14 off, stroking assembly 181 moves in an upward direction biased by the stroking piston spring 183 until spline projection 195 contacts low flow ratchet teeth 157 as depicted in FIG. 20B. As the flow rate continues to decrease past the low flow rate and past the reset flow rate threshold, control assembly 141 moves upward toward the control reset position such that low flow ratchet teeth 157 retract from spline pocket 215 as they move to a longitudinal position longitudinally above spline pocket 215 and out of the path of spline projection 195 allowing reset face 198 of spline projection 195 to engage reset slope 217, as depicted in FIG. 20C. As the stroking assembly 181 moves upward, the spline projection 195 engages the first reset slope 217 such spline barrel 191 rotates until the spline projection 195 returns to the home position as depicted in FIG. 20D, allowing stroking assembly 181 to return to the stroking reset position. Because spline projection 195 is in the home position, a full actuation cycle may be used to move stroking assembly 181 to the actuation position once pumps 14 are turned off and the flow rate substantially stops.

Figure 40A:
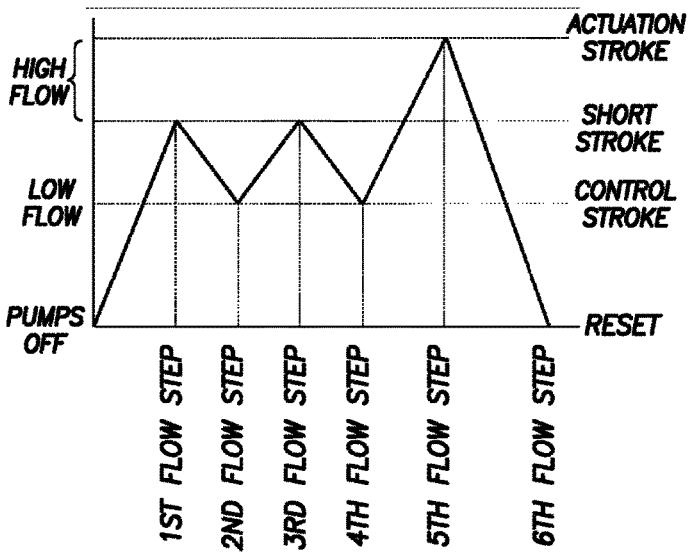
FIG. 40A depicts flow rates during an actuation cycle consistent with at least one embodiment of the present disclosure.
Figure 43A:
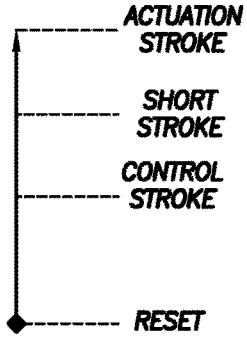
FIG. 43A depicts a schematic representation of stroking positions for a downhole tool actuator consistent with at least one embodiment of the present disclosure.

An actuation cycle in accordance with the above described actuation cycle is depicted in FIG. 40A. As depicted in FIG. 43A, the longitudinal movement of stroking assembly 181 defines a stroking range for stroking assembly 181 including the positions of stroking assembly 181 as described herein.

In some embodiments, downhole tool actuator 100 may be used with downhole tool 15 where downhole tool 15 is activated or deactivated or where the operating mode or configuration of downhole tool 15 is changed by physical interaction between a component of downhole tool 15 and stroking assembly 181. In such an embodiment, downhole tool 15 may, for example and without limitation, include a stroking indexing mechanism, such as a j-slot indexing mechanism, operated by axially positioning indexing mandrel 501 between two or more positions as depicted in FIGS. 39A-F. In some such embodiments, the operational mode or configuration of downhole tool 15 may be changed by depressing indexing mandrel 501 to a switch position as depicted in FIG. 39D. In such an embodiment, downhole tool 15 may be switched between two operating modes such as activating or deactivating a tool such as an underreamer or downhole vibration tool. In such embodiments, downhole tool 15 may only be used during certain operations, such that downhole tool 15 remains deactivated until its activation is desired. In some embodiments, downhole tool 15 may be switched between multiple positions, such as, for example and without limitation, an underreamer that may have positions of full cutting gauge, smaller intermediate cutting gauge, and cutter blocks fully retracted. Similarly, a downhole vibration tool may have a high-pressure pulse setting, a low-pressure pulse setting, and a no pressure pulse setting.

Figure 39A:
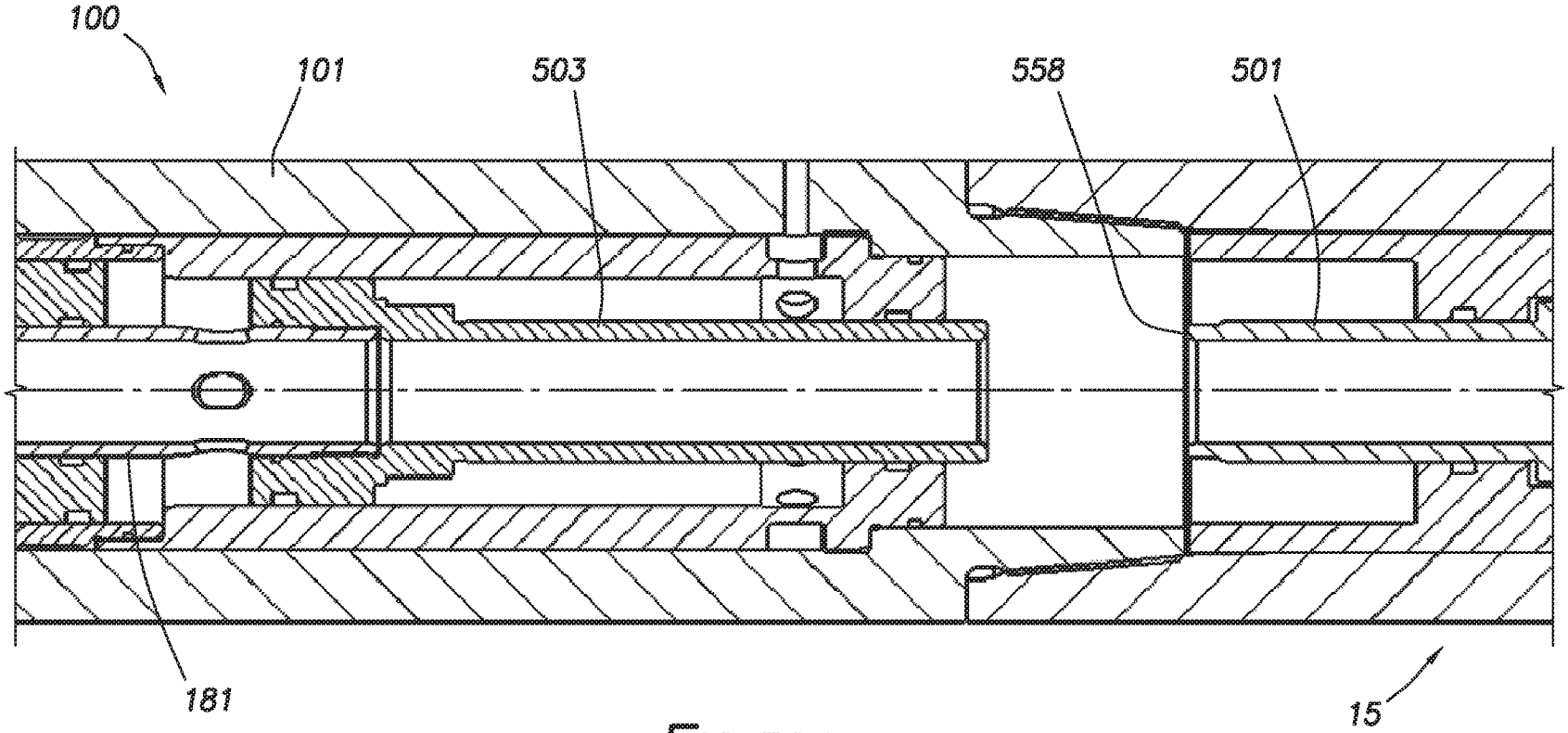
FIGS. 39A-39F depict partial cross section views of an actuator mandrel for a downhole tool actuator consistent with at least one embodiment of the present disclosure.
Figure 39B:
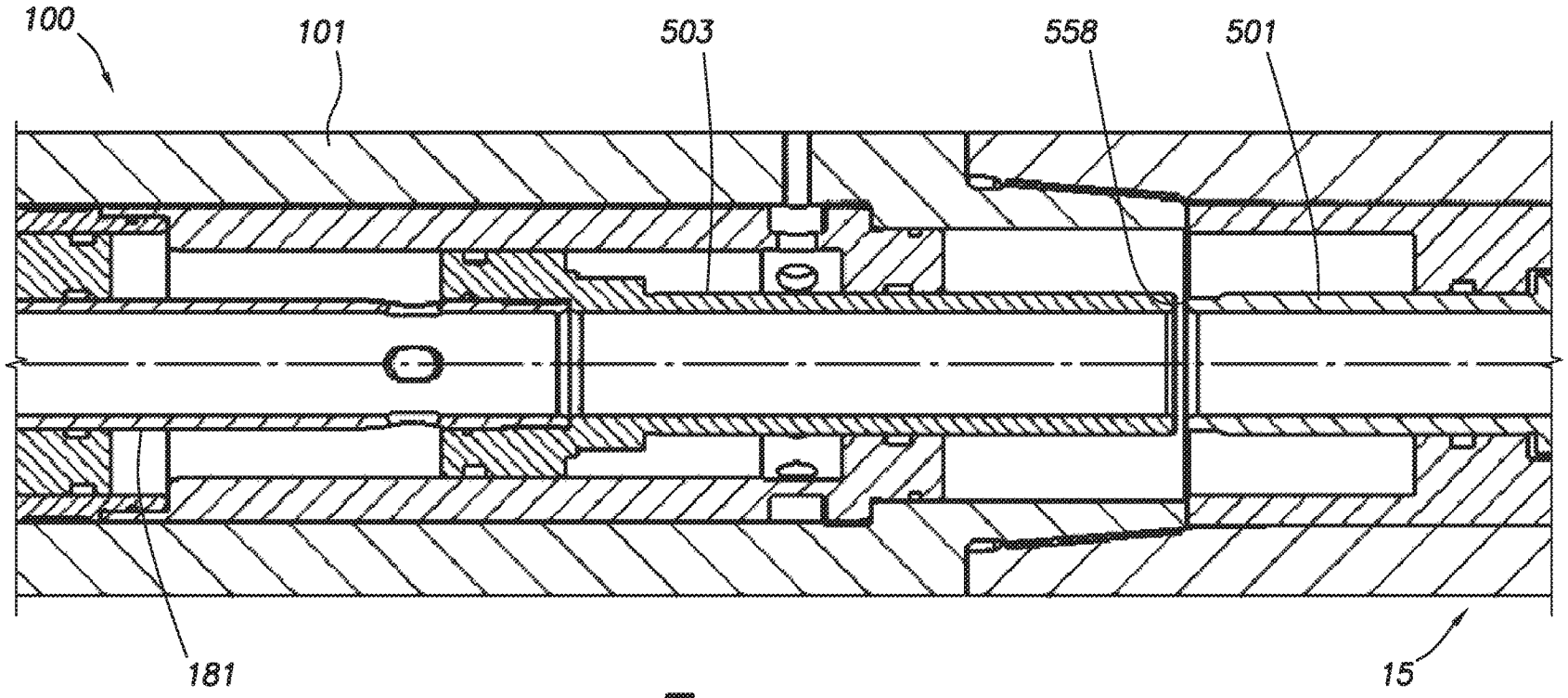
Figure 39C:
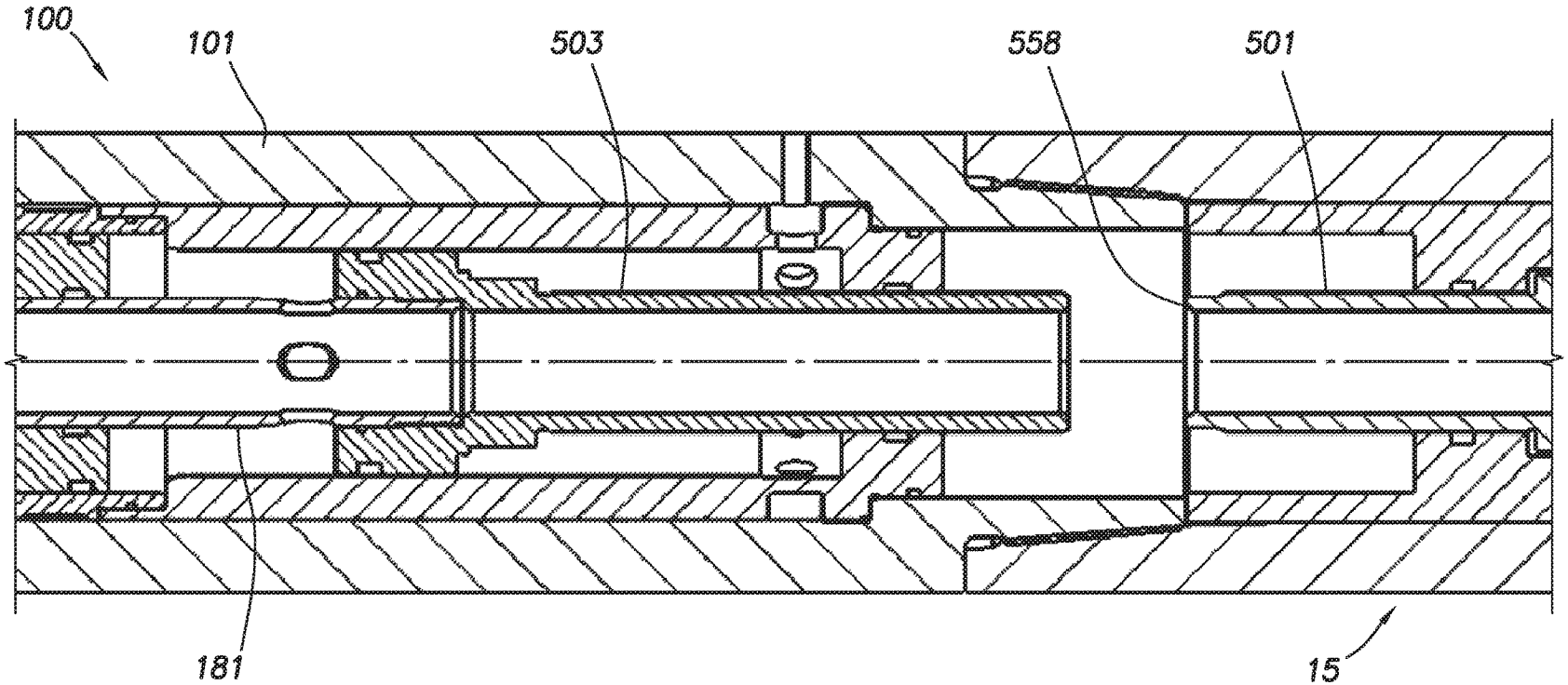
Figure 39D:
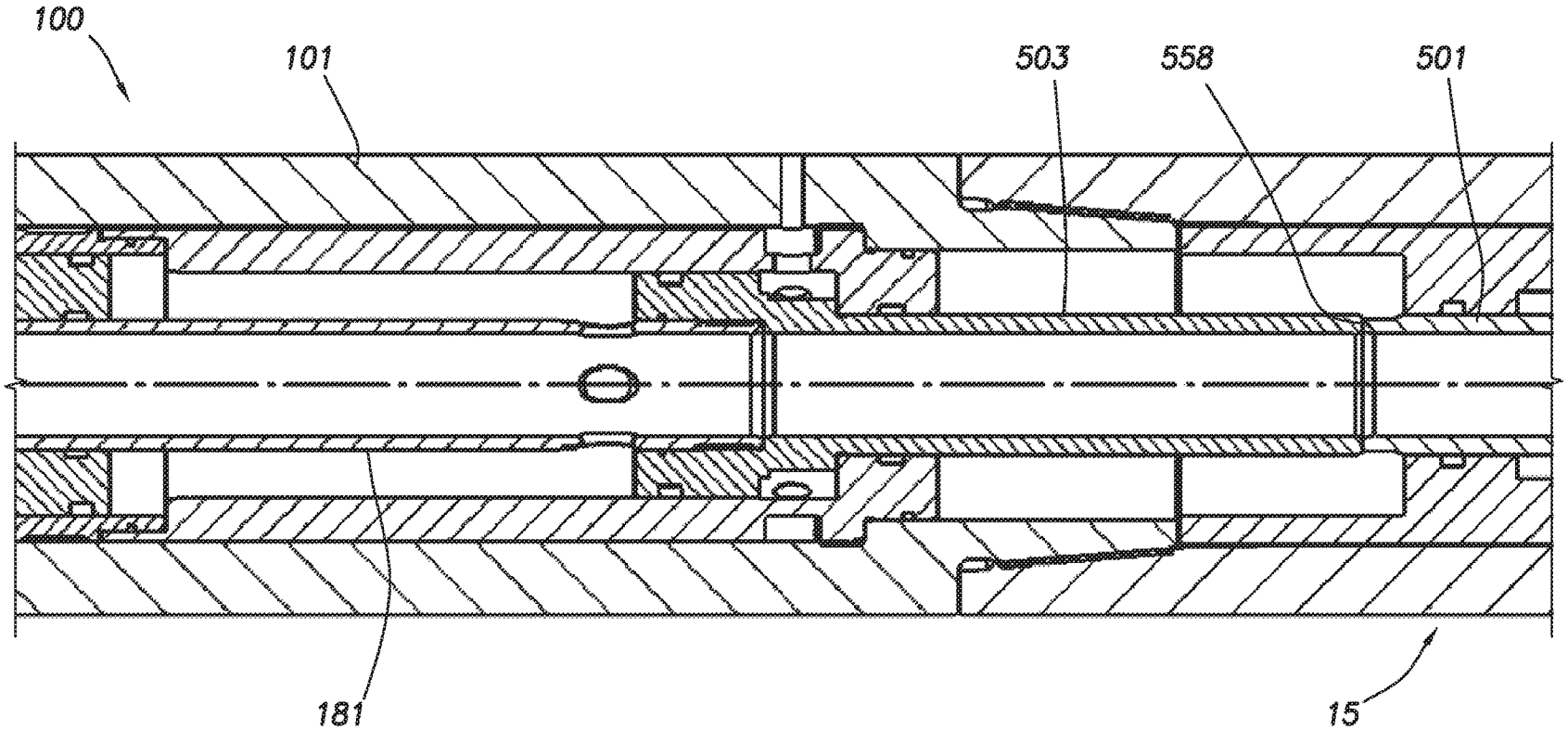
Figure 39E:
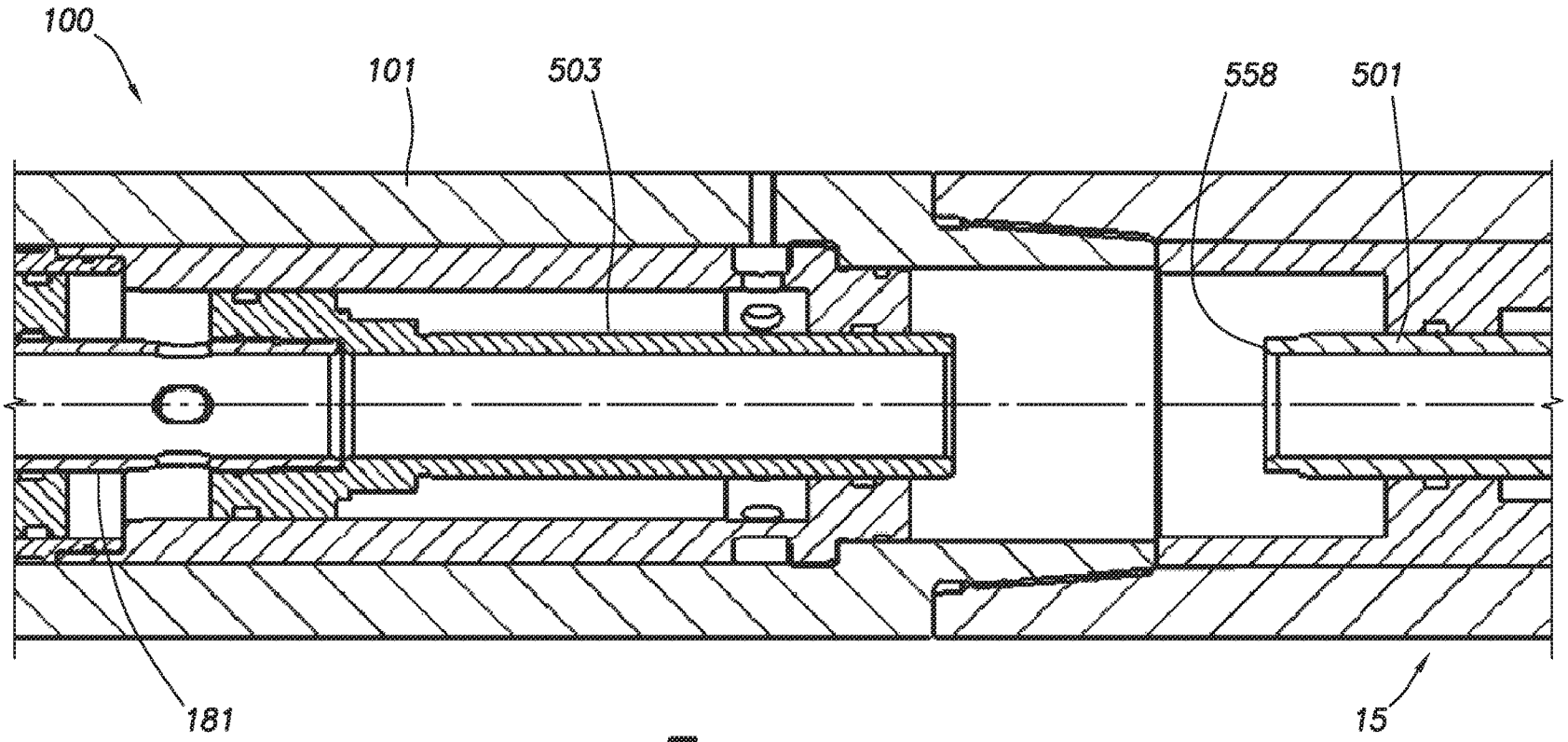
Figure 39F:
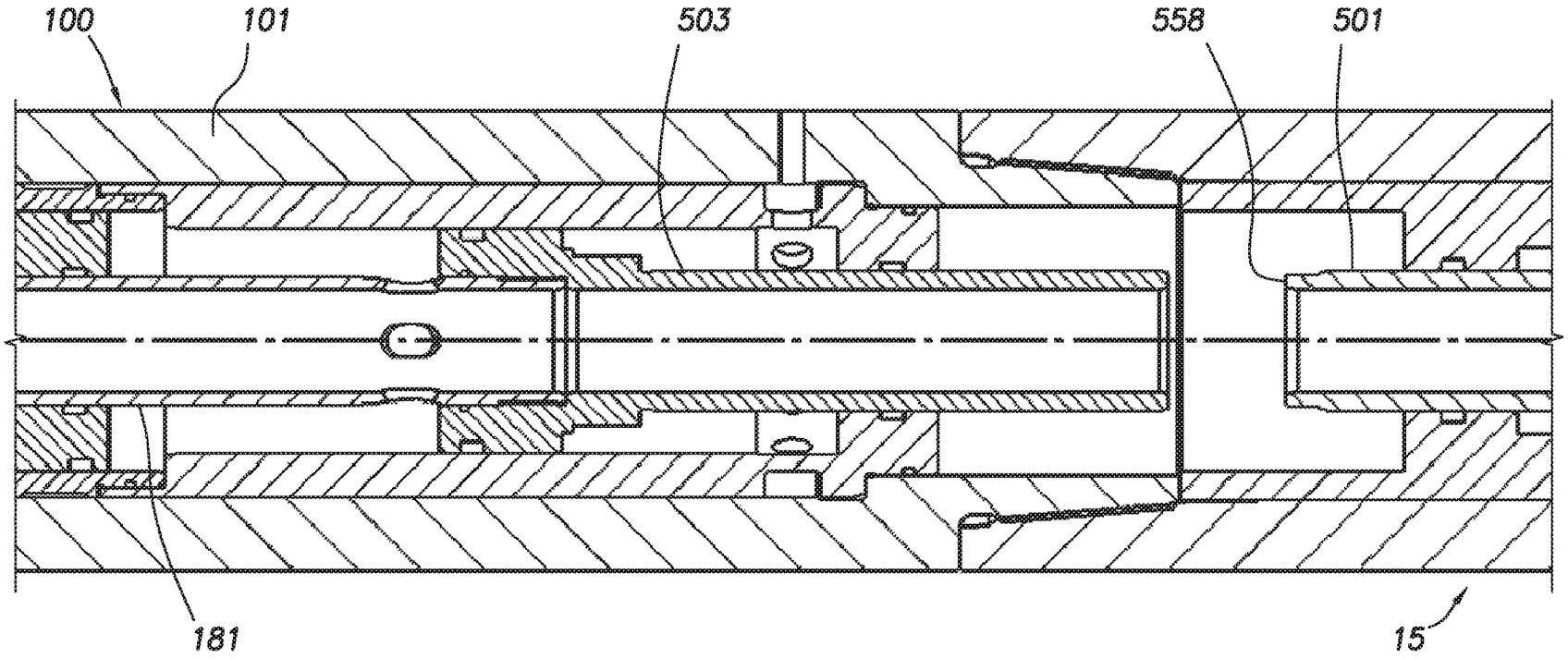

In some embodiments, when downhole tool is in a first position, configuration, or mode, indexing mandrel 501 may be in an extended position as depicted in FIGS. 39A-C. When downhole tool 15 is in a second position, configuration, or mode, indexing mandrel 501 may be in a second extended position or active position as depicted in FIGS. 39E and 39F. In some embodiments, indexing mandrel 501 may be maintained in the extended or active positions by a biasing spring within the tool indexing mechanism.

In some such embodiments, upper face 558 of indexing mandrel 501 may protrude from downhole tool 15 and may be positioned such that upper face 558 is aligned with actuator mandrel 503 positioned at and mechanically coupled to the end of stroking assembly 181. Actuator mandrel 503 may shift relative to outer sub 101 as stroking assembly 181 is shifted between the stroking reset, high flow ratchet, low flow ratchet, and actuation positions such that when downhole tool actuator 100 is in the actuation position, actuator mandrel 503 engages indexing mandrel 501 to shift indexing mandrel 501. To switch downhole tool 15 from the first to the second position, configuration, or mode, a full actuation cycle of downhole tool actuator may be used.

When stroking assembly 181 is in the stroking reset position as depicted in FIG. 39A, the high flow ratchet position as depicted in FIG. 39B (and FIG. 39F), and the low flow ratchet position as depicted in FIGS. 39C, actuator mandrel 503 may not contact upper face 558 of indexing mandrel 501 such that movement of actuator mandrel 503 does not engage the indexing mechanism of downhole tool 15.

As downhole tool actuator 100 shifts into the actuation position, actuator mandrel 503 may engage indexing mandrel 501, shifting actuator mandrel 503 into the switch position depicted in FIG. 39D, causing downhole tool 15 to change position, configuration, or mode. In some embodiments, as flow rate is reduced and downhole tool actuator 100 is shifted into the reset position, indexing mandrel 501 may be biased outward to the active position by the spring positioned in downhole tool 15 as depicted in FIG. 39E. The change in operational state of downhole tool 15 may, in some embodiments, occur while indexing mandrel 501 is depressed, as indexing mandrel 501 is depressed, or as indexing mandrel 501 is released. A full actuation cycle may be required to position downhole tool actuator 100 in the actuation position and thereby cause actuator mandrel 503 to engage indexing mandrel 501 to change downhole tool 15 to change back to the first position, configuration, or mode, or to a third position, configuration or mode. In some embodiments, downhole tool 15 may be maintained in any position, configuration, or mode by operating pumps 14 within inert cycle parameters such that downhole actuator mandrel 503 does not engage with indexing mandrel 501 of downhole tool 15.

Figure 40B:
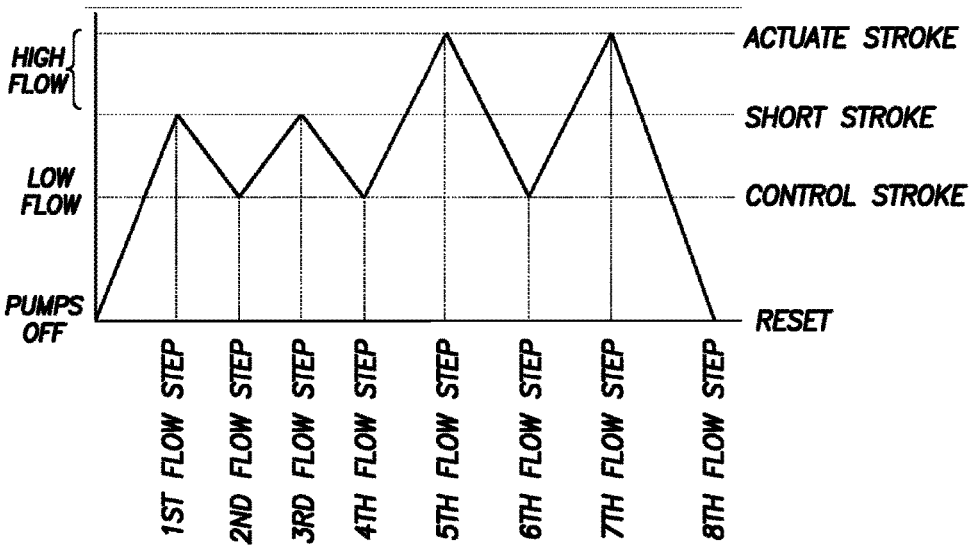
FIG. 40B depicts flow rates during an actuation cycle consistent with at least one embodiment of the present disclosure.
Figure 40C:
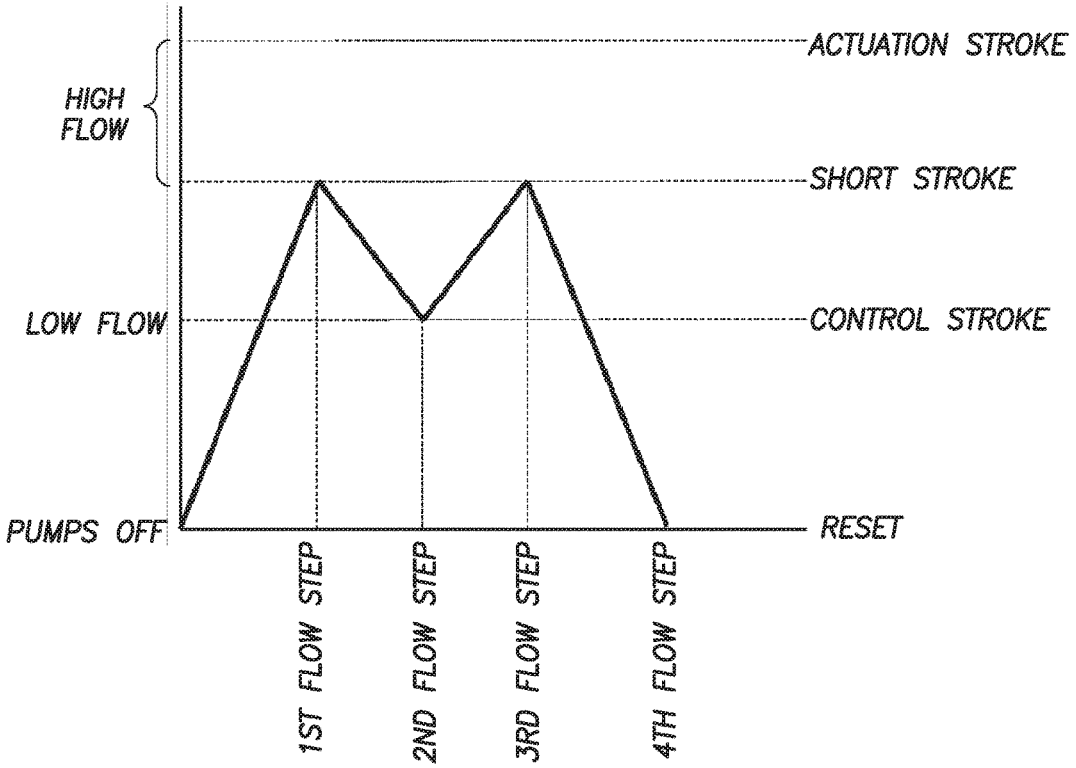
FIG. 40C depicts flow rates during an inert cycle consistent with at least one embodiment of the present disclosure.

In some embodiments, downhole tool 15 may be cycled sequentially between three or more positions by repeating multiple actuation cycles as depicted in FIGS. 40A-C. In some such embodiments, to switch downhole tool from a first position to a third position may require the completion of two full actuation cycles as depicted in FIG. 40A. In some embodiments, downhole tool actuator 100 may switch downhole tool 15 from a first position to a third position in a single actuation cycle by completing an actuation cycle as depicted in FIG. 40B. As shown in FIG. 40B, when the actuation cycle reaches the $5^{th}$ flow step with the downhole tool actuator 100 at actuation stroke position and the spline projection 195 located in actuation slot 225, downhole tool 15 is shifted in position as indexing mandrel 501 moves to the switch position. Subsequently reducing pumps 14 to the low flow rate ($6^{th}$ flow step) may return downhole tool actuator 100 to the control stroke, (which may allow downhole tool 15 to shift to the second operating mode) such that turning pumps 14 to the high flow rate may shift downhole tool actuator 100 to the actuation stroke position a second time as shown as the $7^{th}$ flow step, again moving indexing mandrel 501 to the switch position. Turning pumps 14 off ($8^{th}$ flow step) would therefore complete a single actuation cycle in which downhole tool 15 is twice changed in position, configuration, or mode, thereby changing from the first position, configuration, or mode to the third position, configuration, or mode in a single actuation cycle. In some embodiments, downhole tool 15 may be maintained in any such position, configuration, or mode by operating pumps 14 within inert cycle parameters such that downhole actuator mandrel 503 does not engage with indexing mandrel 501 of downhole tool 15.

Downhole tool 15 may remain in the last selected position, configuration, or mode until a subsequent full actuation cycle of downhole tool actuator 100, including during any inert or default cycles as depicted in FIG. 40C, as downhole tool actuator 100 may not shift into the actuation stroke position during the inert or default cycle.

In some embodiments, downhole tool actuator 100 (or downhole tool indexer 100' as described further herein below) may be used with downhole tool 15 where downhole tool 15 is a fluid-activated tool temporarily activated as described below. In such an embodiment, downhole tool actuator 100 may include valve assembly 401, as depicted in FIGS. 38A-D.

In some such embodiments, downhole tool actuator 100 may control downhole tool 15 such that downhole tool 15 may change to an alternative operating mode or configuration or may be activated after a completing an actuation cycle up to the actuation stroke position as described above and remain operating in the alternative operating mode or condition while the fluid flow remains above the high flow rate threshold. As discussed above, reducing fluid flow below the reset flow rate threshold may reset downhole tool actuator 100 to the reset position such that subsequently returning the fluid flow rate to the high flow rate after being turned off, downhole tool 15 will revert to its original position or operating mode. For example, one or more default or inert cycles may be undertaken, in which downhole tool actuator 100 moves between the short stroke position and the reset position, while downhole tool 15 remains in the position or operating mode. In such an embodiment, downhole tool 15 may operate for a majority of time in a default position, function, or mode, but may be selectively actuated to operate in the activated position, function, or mode.

Downhole tool 15 may be coupled to downhole tool actuator 100 at tool coupler 103 with valve assembly 401 positioned at the interface therebetween. In some embodiments, valve assembly 401 may include components of both downhole tool actuator 100 and downhole tool 15 or components of downhole tool actuator 100 alone. In some embodiments, valve assembly 401 may include valve mandrel 403. Valve mandrel 403 may be mechanically coupled to the end of stroking mandrel 185. Valve mandrel 403 may include one or more valve ports 405 formed therein. Valve mandrel 403 may be tubular and may define valve bore 407 fluidly coupled to stroking assembly bore 107*e*. Valve ports 405 may fluidly couple valve bore 407 to the exterior of valve mandrel 403.

In some embodiments, valve assembly 401 may include valve housing 409. Valve housing 409 may be generally tubular and may be mechanically coupled to outer sub 101. Valve housing 409 may be positioned between end face 453 of outer sub 101 and opposing face 452 of downhole tool 15. In some embodiments, a portion of valve housing 409 may protrude into inner bore 450 of outer sub 101. One or more valve seals 411 may be positioned between valve housing 409 and valve mandrel 403 to reduce or retard fluid flow between valve mandrel 403 and valve housing 409. In some embodiments, valve housing 409 may be tubular and may define tool actuation annulus 413. Tool actuation annulus 413 may fluidly couple to downhole tool 15 such that fluid flow through tool actuation annulus 413 may be used to power, activate, or otherwise change the configuration or operating mode of downhole tool 15. Valve housing seal 451 may be positioned between inner bore 450 and valve housing 409 to define tool actuation annulus 413. In some embodiments, valve housing 409 may include one or more housing ports 415 positioned to fluidly couple the interior of valve housing 409 with tool actuation annulus 413.

Figure 38A:
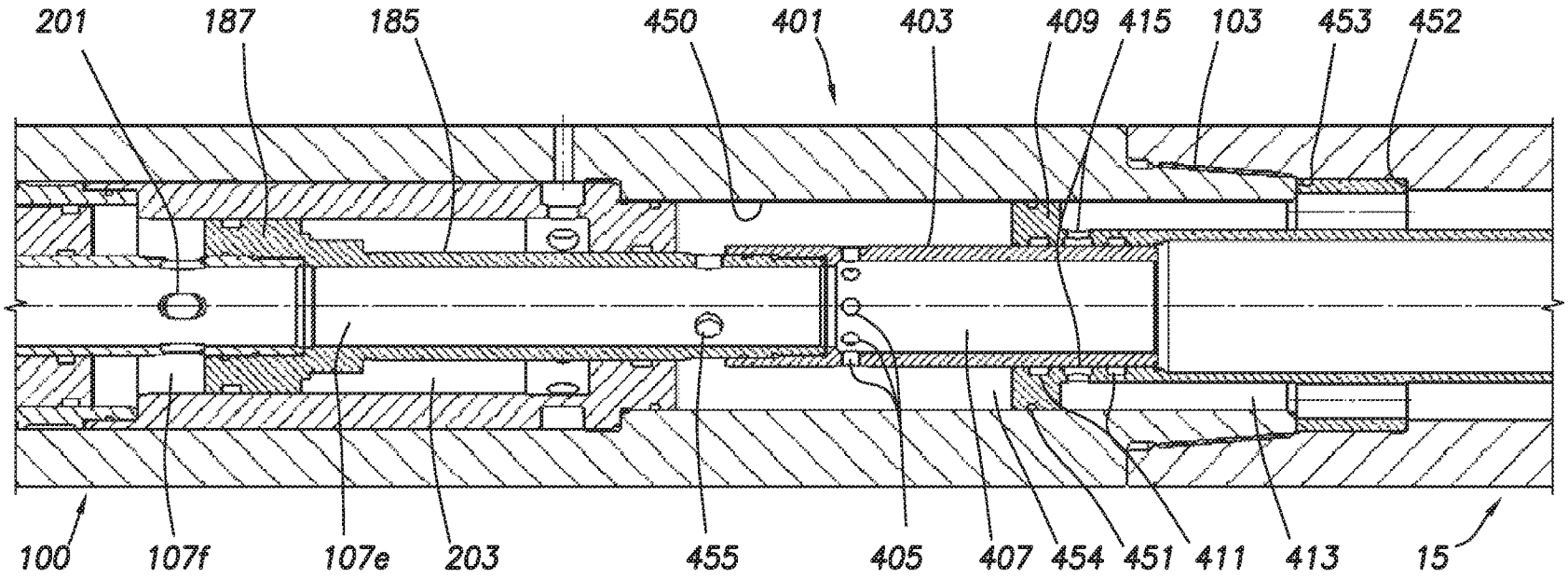
FIGS. 38A-38D depict partial cross section views of a valve assembly for a downhole tool actuator consistent with at least one embodiment of the present disclosure.
Figure 38B:
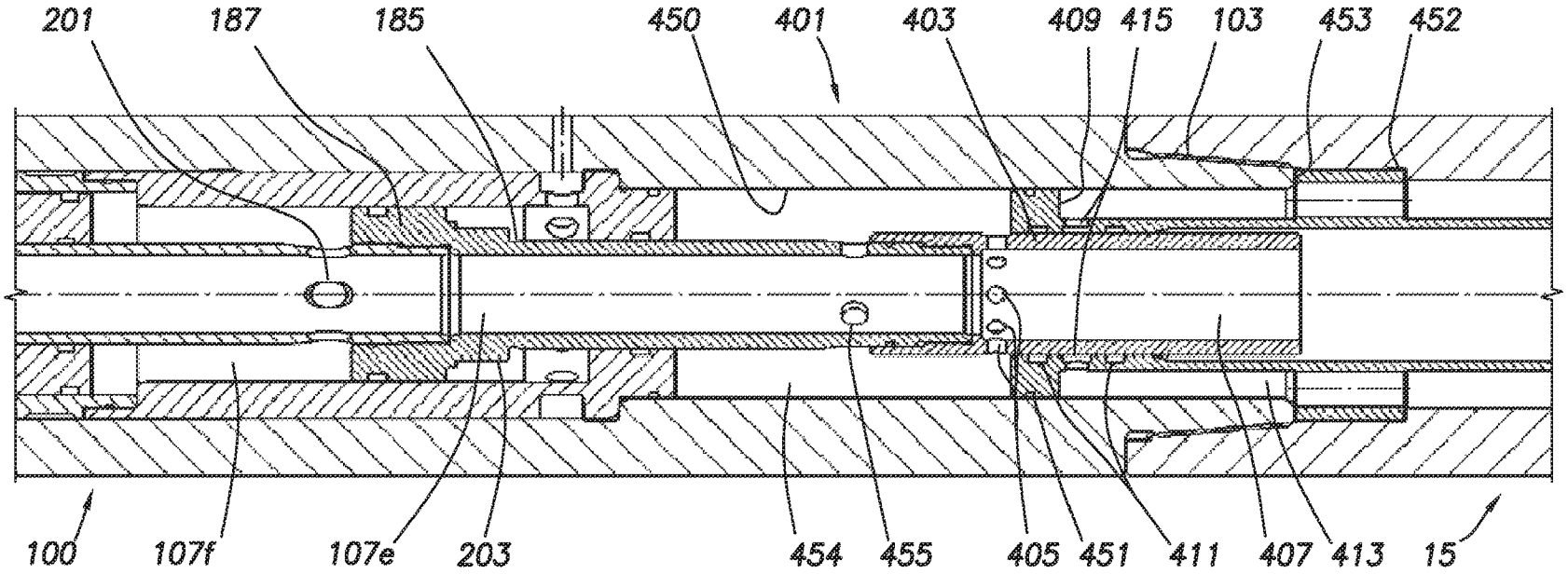
Figure 38C:
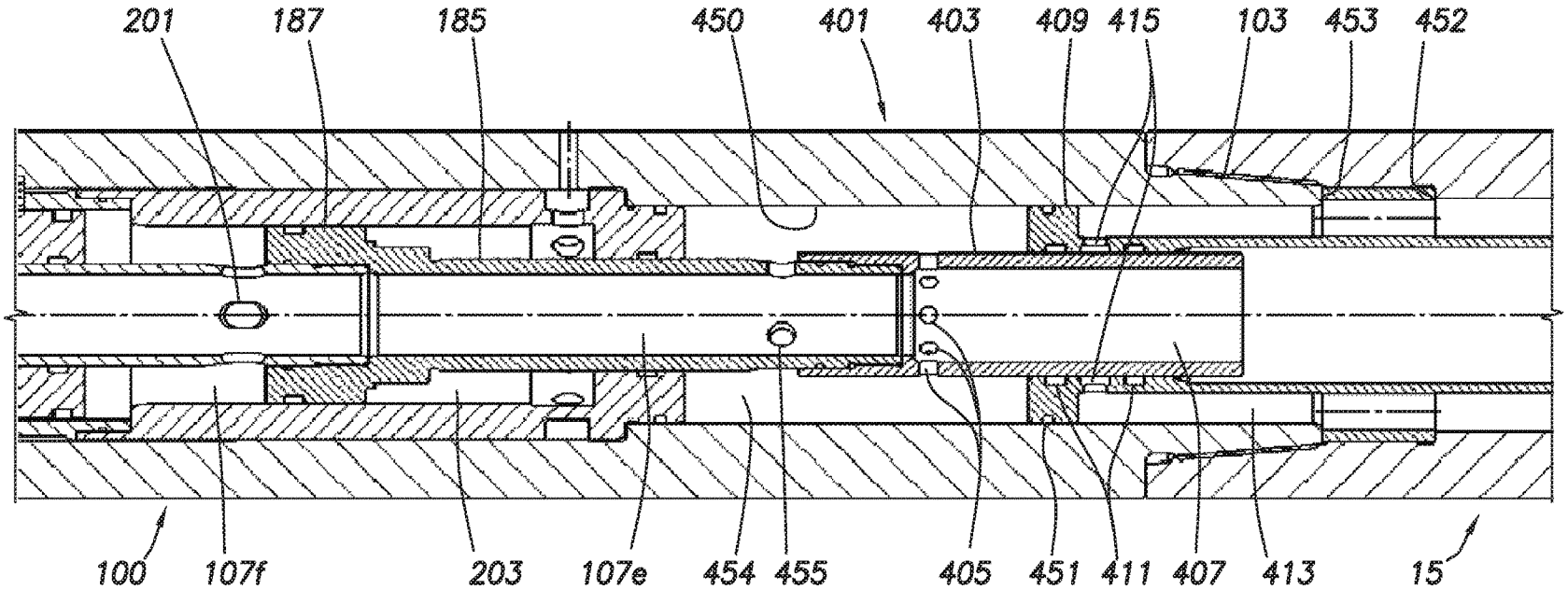

In some embodiments, valve mandrel 403 may be positioned to translate longitudinally relative to valve housing 409 as stroking assembly 181 translates through the stroking reset, low flow ratchet, high flow ratchet, and actuation positions. In some embodiments, when stroking assembly 181 is in the stroking reset position (as depicted in FIG. 38A), high flow ratchet position (as depicted in FIG. 38B), or low flow ratchet position (as depicted in FIG. 38C), valve mandrel 403 may be positioned to block fluid communication between valve bore 407 and housing ports 415, thereby reducing or preventing fluid flow to tool actuation annulus 413. In some embodiments, when stroking assembly 181 is in the actuation position as depicted in FIG. 38D, valve ports 405 may be substantially aligned with housing ports 415, thereby fluidly coupling valve bore 407 and tool actuation annulus 413, allowing fluid to flow through tool actuation annulus 413 and activate downhole tool 15.

FIG. 38A depicts valve assembly 401 in a configuration where the fluid flow rate is below the low flow rate such that downhole tool actuator 100 is in the reset position.

FIG. 38B depicts valve assembly 401 in a configuration where pumps 14 are set at the high flow rate such that downhole tool actuator 100 is at the short stroke position. FIG. 38C depicts valve assembly 401 in a configuration where pumps 14 are set at the low flow rate such that downhole tool actuator 100 is in the control position. In each of these positions, valve mandrel 403 is positioned such that valve ports 405 are not aligned with housing ports 415, and valve seals 411 retard or prevent fluid communication from the bore of downhole tool actuator 100 through valve bore 407 to tool actuation annulus 413. In some embodiments, valve ports 405 may allow fluid communication with relief chamber 454.

Figure 38D:
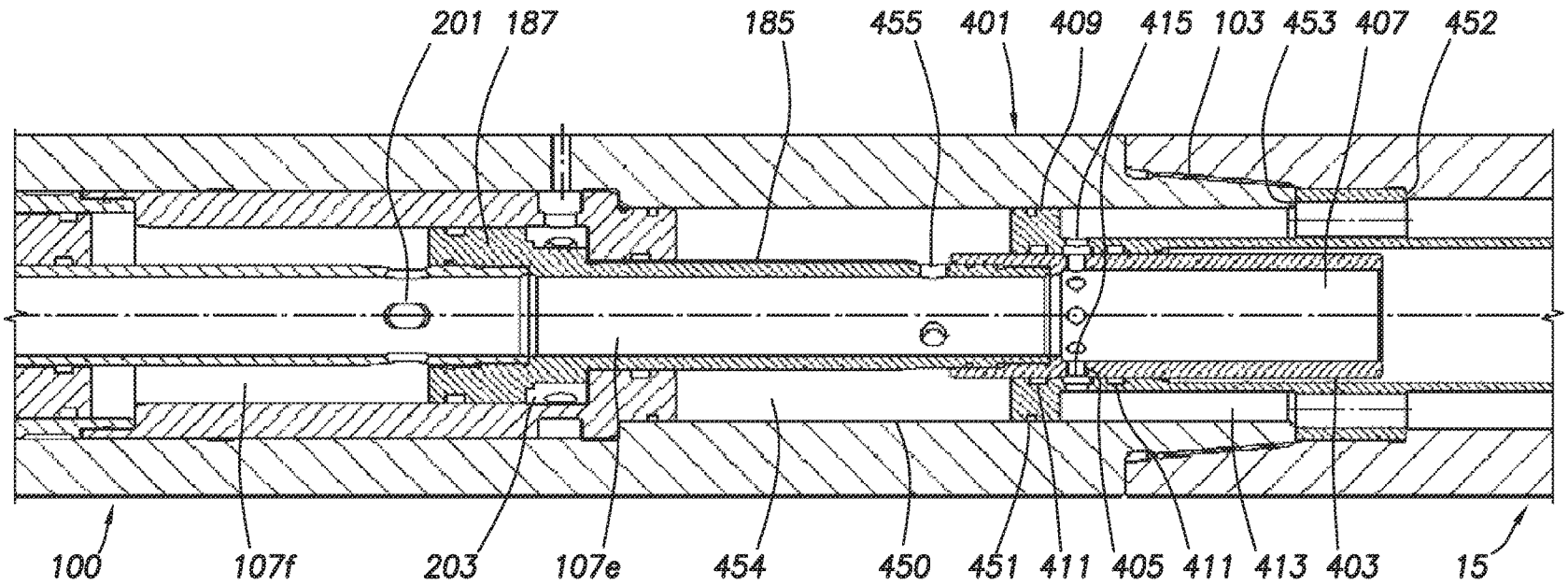

FIG. 38D depicts valve assembly 401 in a configuration in which downhole tool actuator 100 is at the actuation stroke position. Valve ports 405 of valve mandrel 403 are positioned in between valve seals 411 of valve housing 409 such that valve ports 405 align with housing ports 415, thereby allowing fluid communication between the bore of downhole tool actuator 100 through valve bore 407 and tool actuation annulus 413.

In some embodiments, an additional set of relief ports 455 may be included and formed within stroking piston 187 to communicate fluid from the bore of downhole tool actuator 100 to relief chamber 454.

Figure 47A:
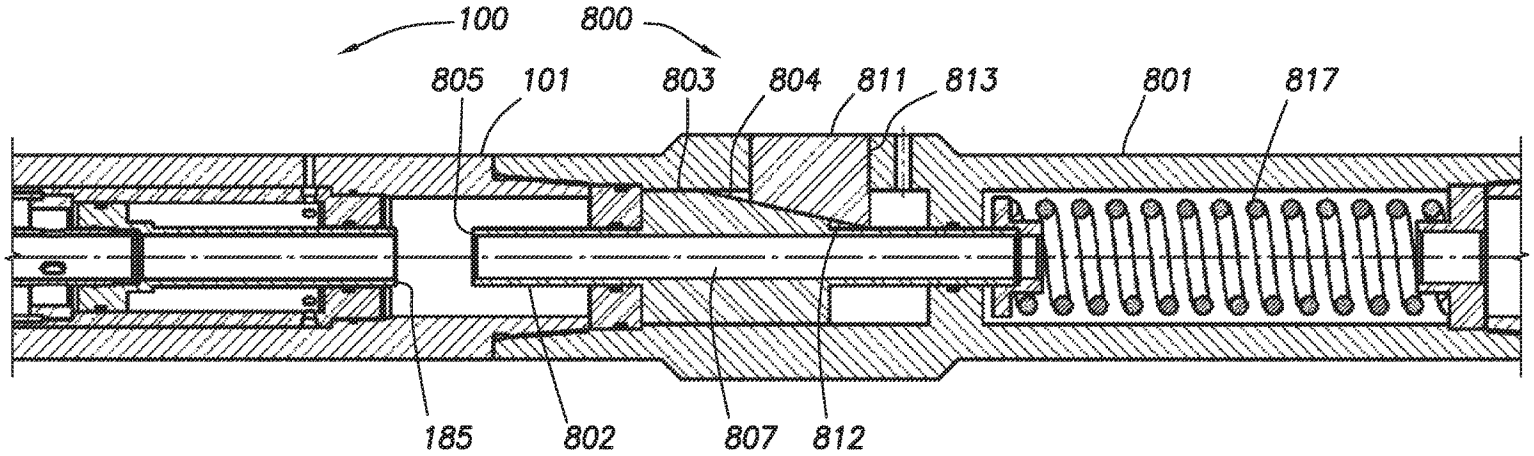
FIGS. 47A-47C depict a retractable stabilizer used with a downhole tool actuator consistent with at least one embodiment of the present disclosure.
Figure 47B:
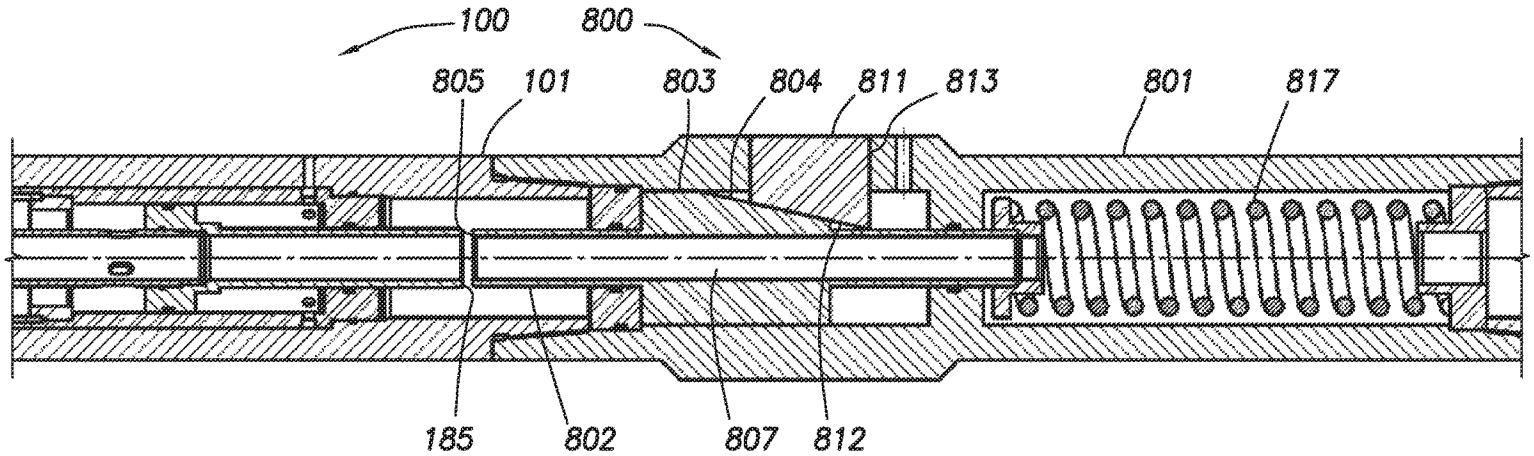
Figure 47C:
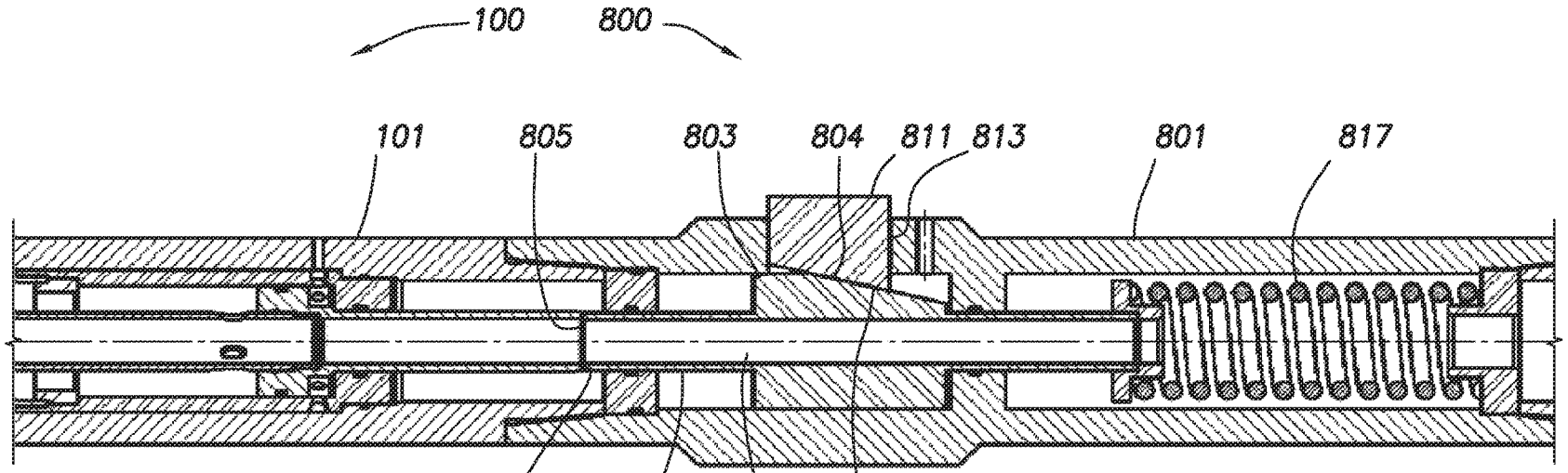

In some embodiments, as a further example, downhole tool actuator 100 may be used with downhole tool 15 where downhole tool 15 is a retractable stabilizer, depicted in FIGS. 47A-C as retractable stabilizer 800. Retractable stabilizer 800 may include stabilizer body 801 mechanically coupled to outer sub 101 of downhole tool actuator 100. Retractable stabilizer 800 may include stabilizer mandrel 802. Stabilizer mandrel 802 may be generally tubular. Stabilizer mandrel may extend through stabilizer body 801 and may be adapted to translate longitudinally relative to stabilizer body 801. In some embodiments, retractable stabilizer 800 may include stabilizer spring 817 positioned to bias stabilizer mandrel 802 upward relative to stabilizer body 801. In some embodiments, retractable stabilizer 800 may include wedge body 803. Wedge body 803 may be mechanically coupled to stabilizer mandrel 802. Wedge body 803 may include tapered surface 804. In some embodiments, stabilizer body 801 may include aperture 813 positioned to receive stabilizer pad 811. Stabilizer pad 811 may be adapted to move radially inward and outward relative to stabilizer body 801 through aperture 813. In some embodiments, stabilizer pad 811 may contact wedge body 803 at tapered surface 804 such that downward translation of stabilizer mandrel 802 causes radial extension of stabilizer pad 811 outward from stabilizer body 801. In some embodiments, retractable stabilizer 800 may therefore be actuated such that stabilizer pad 811 is radially extended only when stabilizer mandrel 802 is moved downward relative to stabilizer body 801 against the biasing force of stabilizer spring 817.

In some such embodiments, downhole tool actuator 100 may be used to actuate retractable stabilizer 800. In some embodiments, while downhole tool actuator 100 is in the reset position depicted in FIG. 47A or the short stroke position depicted in FIG. 47B, retractable stabilizer 800 remains in the retracted or non-actuated position. After an actuation cycle as described above, as stroking mandrel 185 moves downward to the actuation position, stroking mandrel 185 may contact stabilizer mandrel 802 and force stabilizer mandrel 802 downward, causing radial extension of stabilizer pad 811 as shown in FIG. 47C. Retractable stabilizer 800 may therefore be actuated while downhole tool actuator 100 is in the actuation stroke position. Once the flow rate is reduced to the low flow rate or stopped, stabilizer spring 817 may bias stabilizer mandrel 802 upward, allowing stabilizer pad 811 to retract radially. Accordingly, retractable stabilizer 800 may be selectively actuated when desired using downhole tool actuator 100. In some embodiments, although described as retractable stabilizer 800, the replacement of stabilizer pad 811 with a different tool, such as, for example and without limitation, a cutter for an underreamer, may allow a similar structure as described with respect to retractable stabilizer 800 to be used to actuate other tools.

Figure 43B:
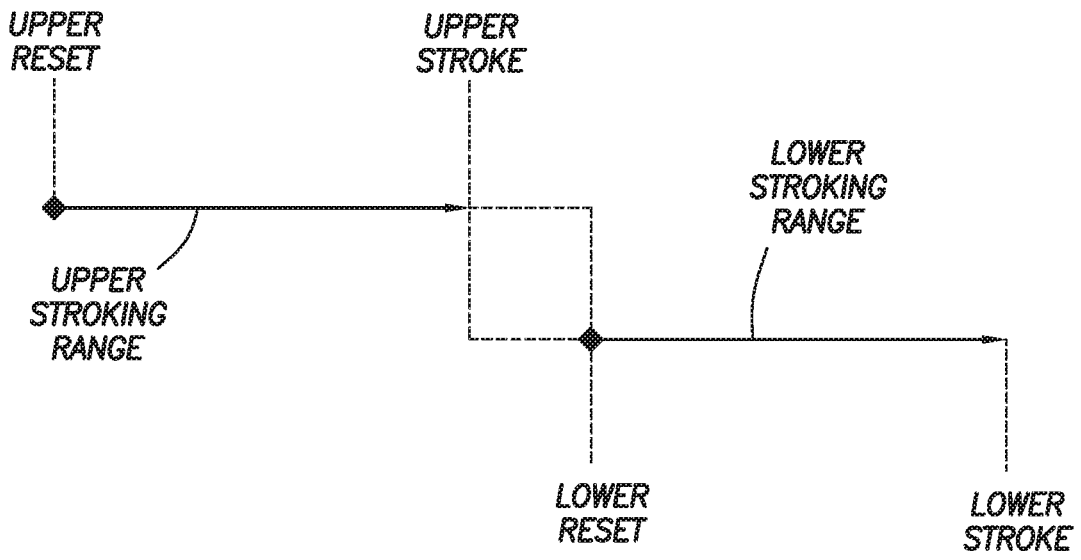
FIG. 43B depicts a schematic representation of stroking ranges for a downhole tool indexer consistent with at least one embodiment of the present disclosure.
Figure 43C:
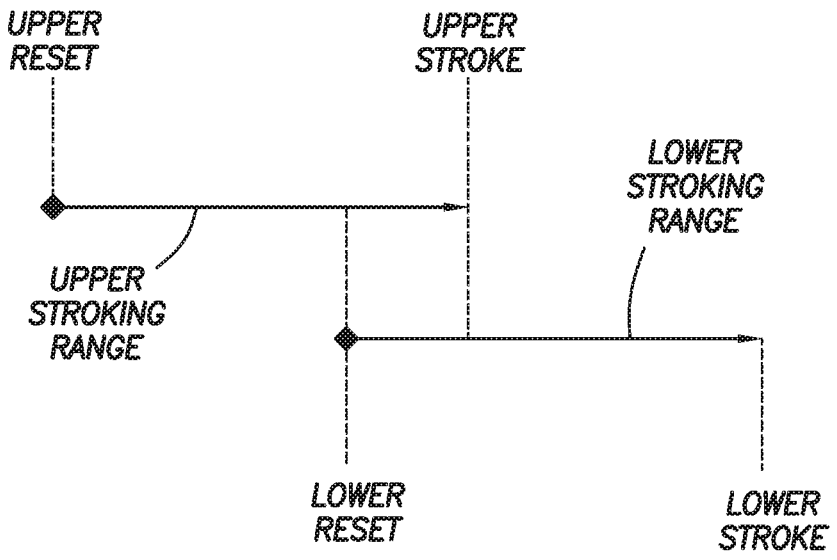
FIG. 43C depicts a schematic representation of stroking ranges for a downhole tool indexer consistent with at least one embodiment of the present disclosure.

In some embodiments, downhole tool control apparatus 30 may be configured such that stroking assembly 181 may be movable between two or more ranges of longitudinal movement, referred to herein as stroking ranges. In such an embodiment, downhole tool control apparatus 30 may be described as downhole tool indexer 100'. For the purpose of clarity, this disclosure refers to an upper stroking range and a lower stroking range as examples of two separate stroking ranges. These descriptions are not intended to limit the scope of this disclosure, as more than two stroking ranges and configurations of stroking ranges other than an upper stroking range and a lower stroking range are contemplated. In some embodiments, as depicted in FIGS. 43B and 43C, stroking assembly 181 may be movable within upper stroking range or within lower stroking range. In some embodiments, once a full indexing cycle is carried out, stroking assembly 181 may move from the upper stroking range to the lower stroking range or vice versa. Such an embodiment will be now described and may be referred to as downhole tool indexer 100'. In some embodiments, downhole tool indexer 100' may include elements that correspond to downhole tool actuator 100 as described herein above, although such components need not be identical. Such corresponding elements are described with the same reference numerals as used herein above with respect to downhole tool actuator 100. In some embodiments, downhole tool indexer 100' may be configured such that the upper stroking range and the lower stroking range of stroking assembly 181 do not overlap as depicted in FIG. 43B. In some embodiments, downhole tool indexer 100' may be configured such that the upper stroking range and the lower stroking range of stroking assembly 181 partially overlap as depicted in FIG. 43C. In other embodiments, the upper stroking range and lower stroking range may be contiguous in longitudinal position.

Figure 21:
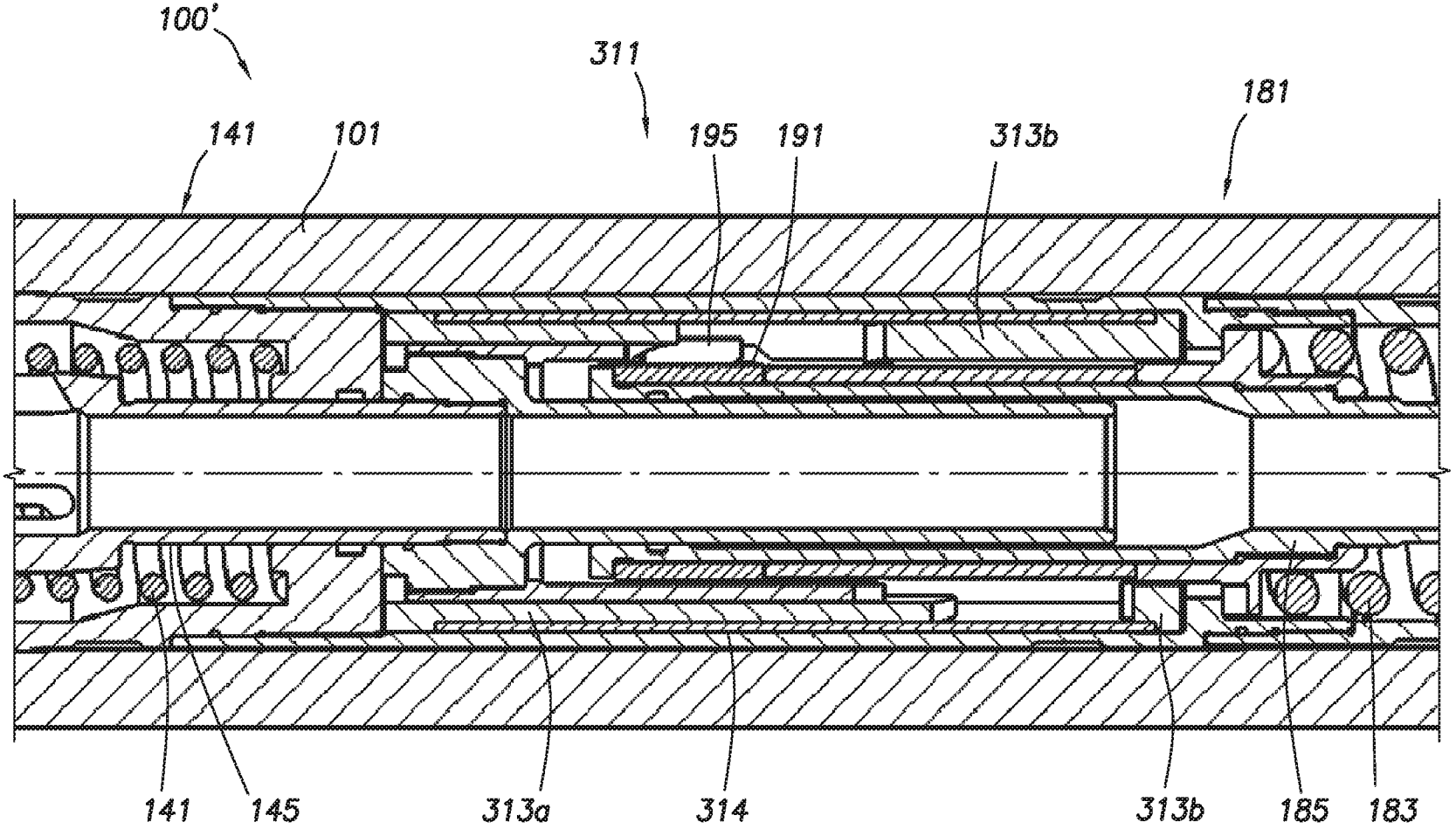
FIG. 21 depicts a partial cross section view of a downhole tool indexer consistent with at least one embodiment of the present disclosure.
Figure 21A:
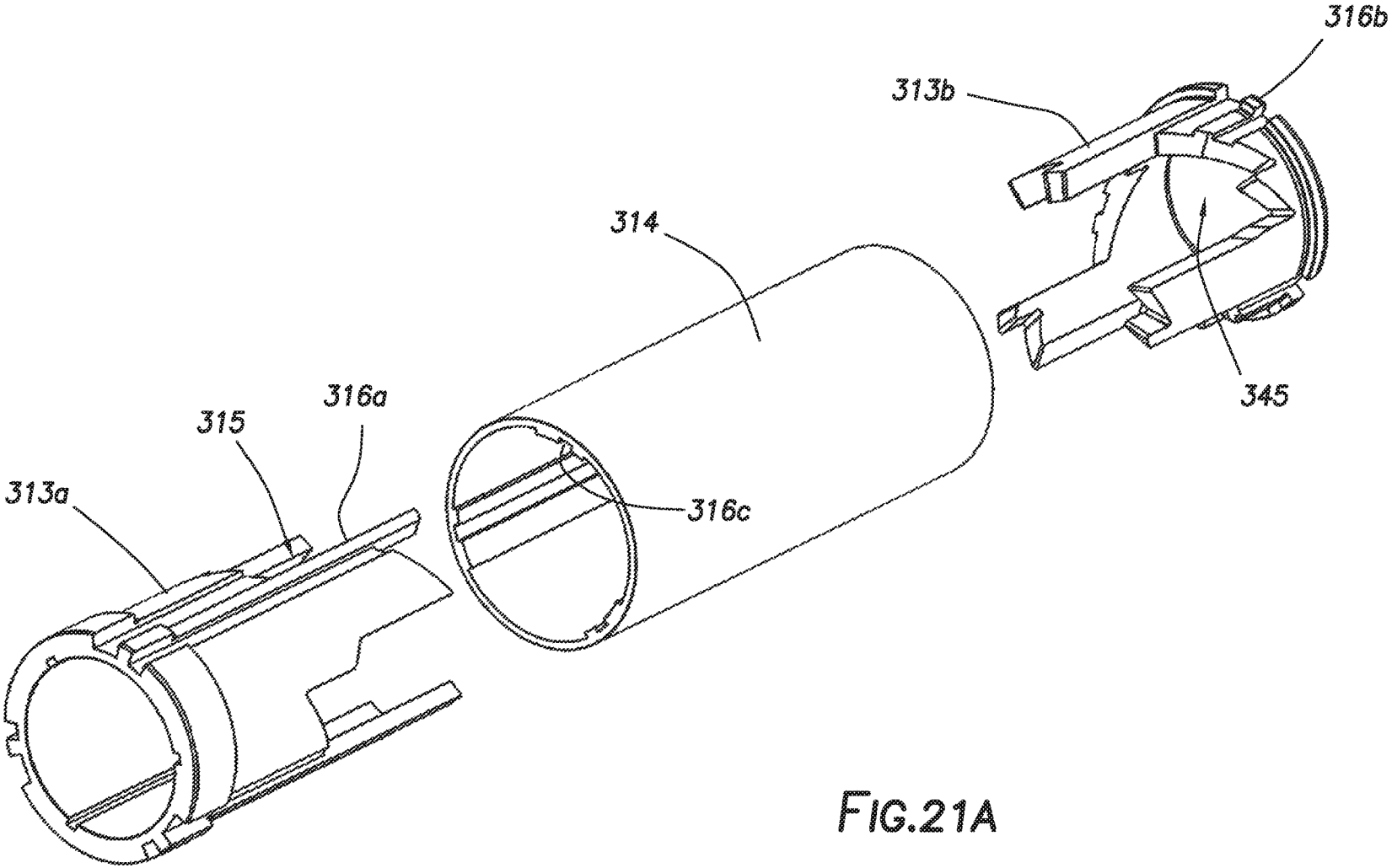
FIG. 21A depicts an exploded perspective view of a pocket assembly of the downhole tool indexer of FIG. 21.

In some such embodiments, pocket assembly 311 as depicted in FIGS. 21 and 21A may be formed from reset sleeve 313*a* and high flow ratchet sleeve 313*b*. In some embodiments, reset sleeve 313*a* and high flow ratchet sleeve 313*b* may be joined and held in place relative to outer sub 101 by orientation spacer 314. In some embodiments, reset sleeve 313*a* may include reset sleeve tongue 316*a* and high flow ratchet sleeve 313*b* may include ratchet sleeve tongue 316*b*. Reset sleeve tongue 316*a* and ratchet sleeve tongue 316*b* may be adapted to fit into corresponding orientation groove 316*c* formed in orientation spacer 314. Reset sleeve tongue 316*a* and ratchet sleeve tongue 316*b* may, for example and without limitation, retain proper alignment between reset sleeve 313*a* and high flow ratchet sleeve 313*b*.

Figure 22:
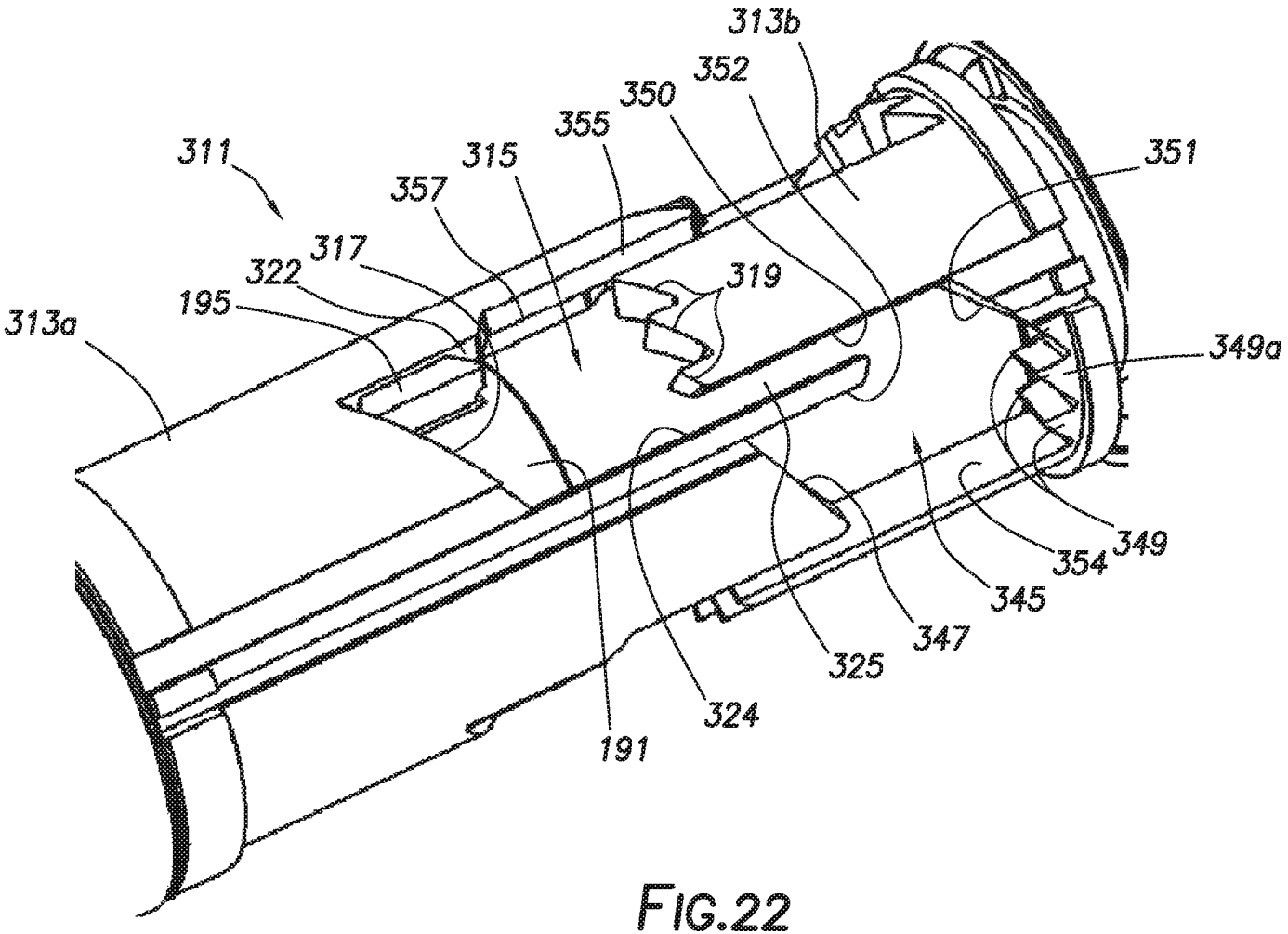
FIG. 22 depicts a partial perspective view of the downhole tool indexer of FIG. 21.

In some embodiments, pocket assembly 311 may include two or more spline pockets each corresponding to a stroking range for stroking assembly 181. For example, as depicted in FIG. 22, pocket assembly 311 may include first spline pocket 315 and second spline pocket 345 defined by reset sleeve 313*a* and high flow ratchet sleeve 313*b*. In some embodiments, one or more components of pocket assembly 311 may be formed integrally with outer sub 101. In some such embodiments, first spline pocket 315 and second spline pocket 345 may be at least partially formed in an inner surface of outer sub 101. In some embodiments, each spline pocket of pocket assembly 311 may include elements similar to those described with respect to spline pocket 215. For example and without limitation, first spline pocket 315 and second spline pocket 345 may define a continuous boundary that limits or affects the stroke or position of spline projection 195 as further discussed below. For example, first spline pocket 315 may include a first lower boundary, a first upper boundary, first reset boundary 322, and first exit boundary 324. In some embodiments, the first upper boundary may include first reset slope 317 formed in reset sleeve 313*a*. First reset slope 317 may extend between first reset boundary 322 and first exit boundary 324 at an angle such that when spline barrel 191 is moved upward by longitudinal translation of stroking assembly 181 while spline projection 195 is positioned in first spline pocket 315, reset face 198 of spline projection 195 engages reset slope 317. Continued upward longitudinal translation of stroking assembly 181 may cause rotation of spline barrel 191 toward first reset boundary 322 until spline projection 195 engages first reset boundary 322. Further movement of stroking assembly 181 may be stopped once spline projection 195 engages first reset slope 317 and first reset boundary 322.

In some embodiments, at least a portion of the lower boundary of first spline pocket 315 may include one or more upper high flow ratchet teeth 319 formed in high flow ratchet sleeve 313*b*. Upper high flow ratchet teeth 319 may be positioned to engage spline projection 195 as stroking assembly 181 moves longitudinally relative to pocket assembly 311 while spline projection 195 is positioned within first spline pocket 315, to rotate spline barrel 191 relative to pocket assembly 311 toward first exit boundary 324 as spline projection 195 engages the slope, and to limit the longitudinal movement of stroking assembly 181 as further described herein below.

Similarly, second spline pocket 345 may include a second lower boundary, a second upper boundary, entry boundary 350, second reset boundary 352, and second exit boundary 354. In some embodiments, the second upper boundary may include second reset slope 347 formed in reset sleeve 313*a*. Second reset slope 347 may extend between second reset boundary 352 and second exit boundary 354 at an angle such that when spline barrel 191 is moved upward by longitudinal translation of stroking assembly 181 while spline projection 195 is positioned in second spline pocket 345, reset face 198 of spline projection 195 engages second reset slope 347. Continued upward longitudinal translation of stroking assembly 181 may cause rotation of spline barrel 191 toward second reset boundary 352 until spline projection 195 engages second reset boundary 352. Further movement of stroking assembly 181 may be stopped once spline projection 195 engages second reset slope 347 and second reset boundary 352.

In some embodiments, at least a portion of the lower boundary of second spline pocket 345 may include one or more lower high flow ratchet teeth 349 formed in high flow ratchet sleeve 313*b*. Lower high flow ratchet teeth 349 may be positioned to engage spline projection 195 as stroking assembly 181 moves longitudinally relative to pocket assembly 311 while spline projection 195 is positioned within second spline pocket 345, to rotate spline barrel 191 relative to pocket assembly 311 toward second exit boundary 218 as spline projection 195 engages the slope, and to limit the longitudinal movement of stroking assembly 181 as further described herein below.

In some embodiments, the lower boundary of first spline pocket 315 may include first transition slot 325 formed between reset sleeve 313*a* and high flow ratchet sleeve 313*b* and located at or formed as part of first exit boundary 324 and entry boundary 350. In some embodiments, second spline pocket 345 may include second transition slot 355 formed between reset sleeve 313*a* and high flow ratchet sleeve 313*b* and located at or formed as part of second exit boundary 354 and first reset boundary 322. First spline pocket 315 may operate as described herein above with respect to the actuation cycle of spline pocket 215 wherein the high and low flow ratchet positions of stroking assembly 181 represent high and low flow ratchet positions of the upper stroking range. As spline projection 195 passes through first transition slot 325, similar to entering actuation slot 225 as described herein above, spline projection 195 may pass into second spline pocket 345 as stroking assembly 181 shift downward along first reset boundary 322 and entry boundary 350 until stroking assembly 181 is positioned in the lower high flow ratchet position. Second spline pocket 345 may operate similarly, wherein the longitudinal movement of stroking assembly 181 corresponds to the lower stroking range. In some embodiments, upon slowing or stoppage of the flow rate after a full lower stroking range indexing cycle as described herein below, spline projection 195 may pass through second transition slot 355 into first spline pocket 315.

Figure 23:
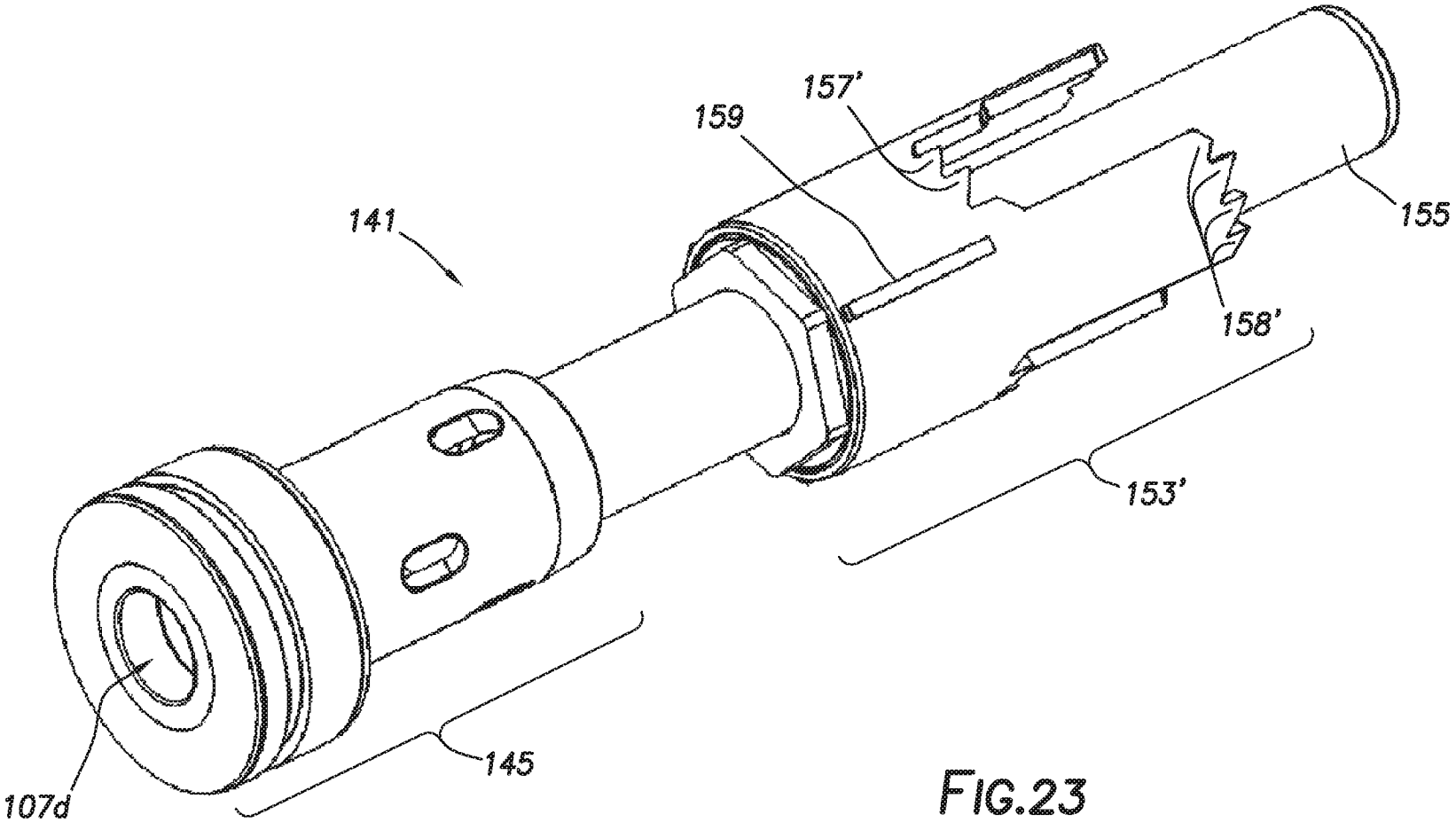
FIG. 23 depicts a partial perspective view of a control assembly of the downhole tool indexer of FIG. 21.

In some embodiments, as depicted in FIG. 23, low flow ratchet sleeve 153' may include upper low flow ratchet teeth 157' and lower low flow ratchet teeth 158'. Upper low flow ratchet teeth 157' may operate with respect to first spline pocket 315 as discussed herein above with respect to low flow ratchet teeth 157 and lower low flow ratchet teeth 158' may operate similarly with respect to second spline pocket 345.

In such an embodiment, downhole tool indexer 100' may require a full upper stroking range indexing cycle to move downhole tool indexer 100' to the lower stroking range and may require a full lower stroking range indexing cycle to move downhole tool indexer 100' to the upper stroking range.

Figure 45A:
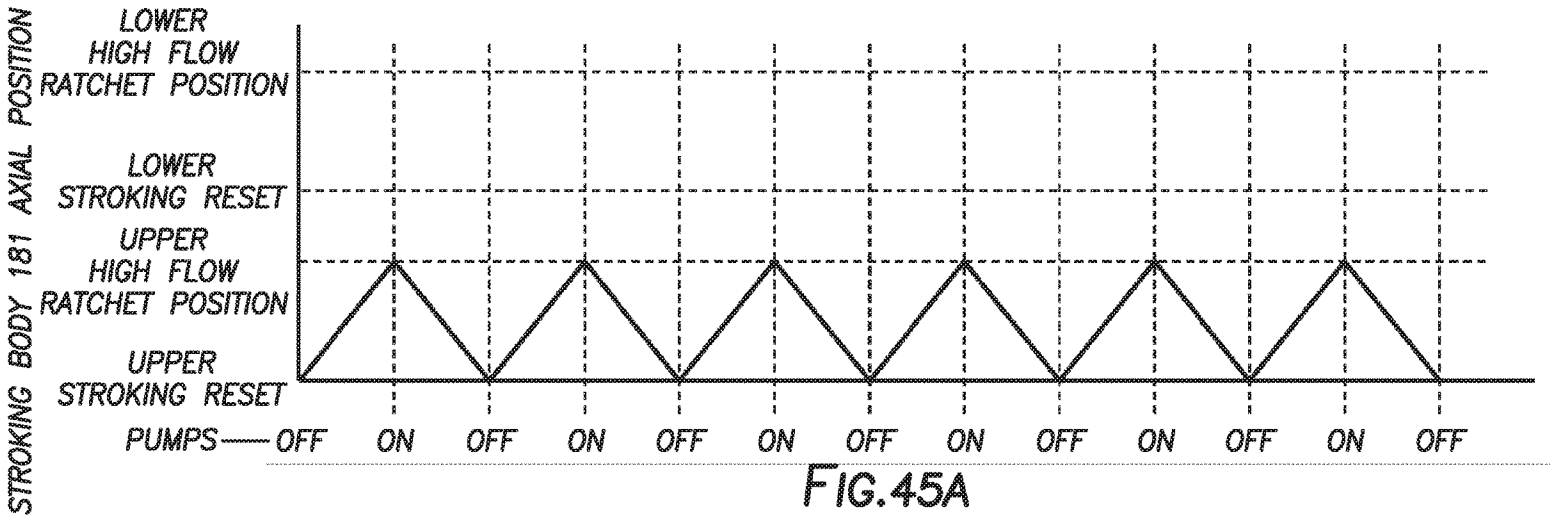
FIGS. 45A, 45B depict flow rates during inert or stay cycles of a downhole tool indexer consistent with at least one embodiment of the present disclosure.
Figure 45B:
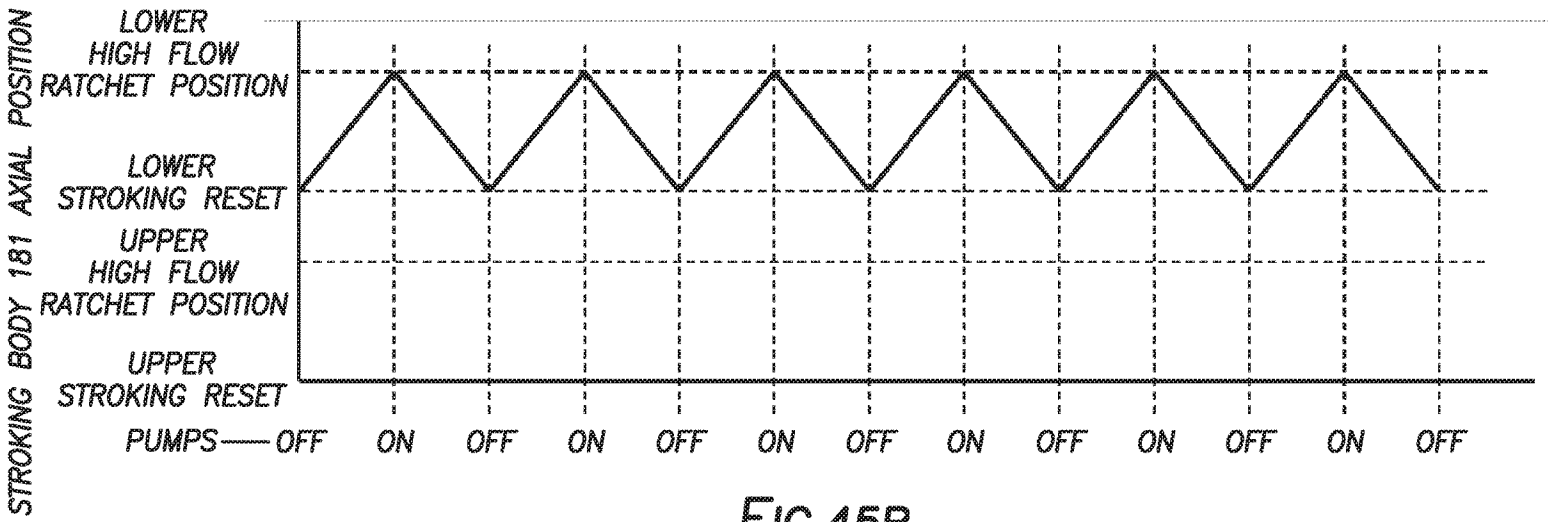

In some embodiments, as described above with respect to downhole tool actuator 100, where a number of operations may be undertaken with drill string 10 positioned in wellbore 20 that require multiple changes in flow rate due to the operations performed before it is desired to shift downhole tool indexer 100' between the lower stroking range and upper stroking range, unwanted reconfiguration of downhole tool indexer 100' may be avoided despite the changes in flow rate. In such a case, downhole tool indexer 100' may undergo multiple inert or "stay" cycles without indexing between the lower stroking range and upper stroking range while downhole tool indexer 100' is operating in either the lower stroking range or upper stroking range. Downhole tool 15 may therefore remain in the operating mode or configuration dictated by the stroking range in which downhole tool indexer 100' is operating through multiple such operations as depicted in FIGS. 45A and 45B.

Figure 46A:
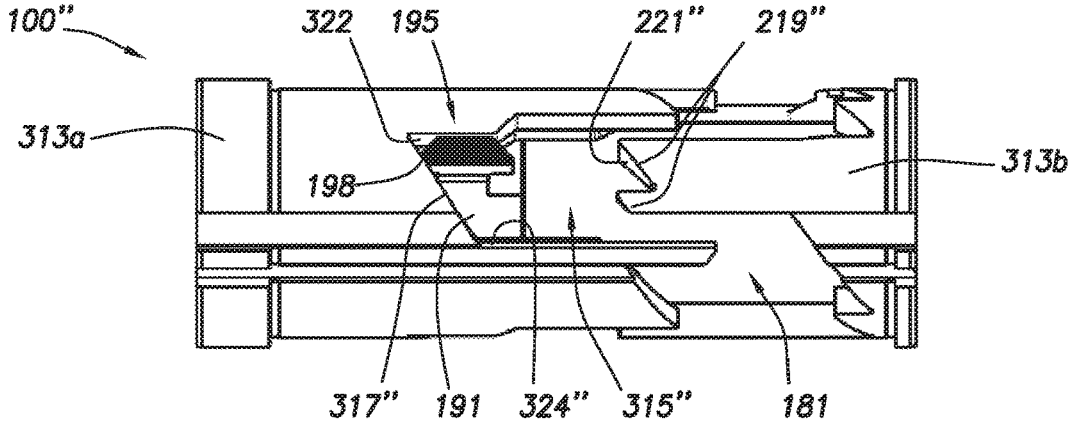
FIGS. 46A-46G depict an inert or stay cycle for a downhole tool indexer consistent with at least one embodiment of the present disclosure.
Figure 46B:
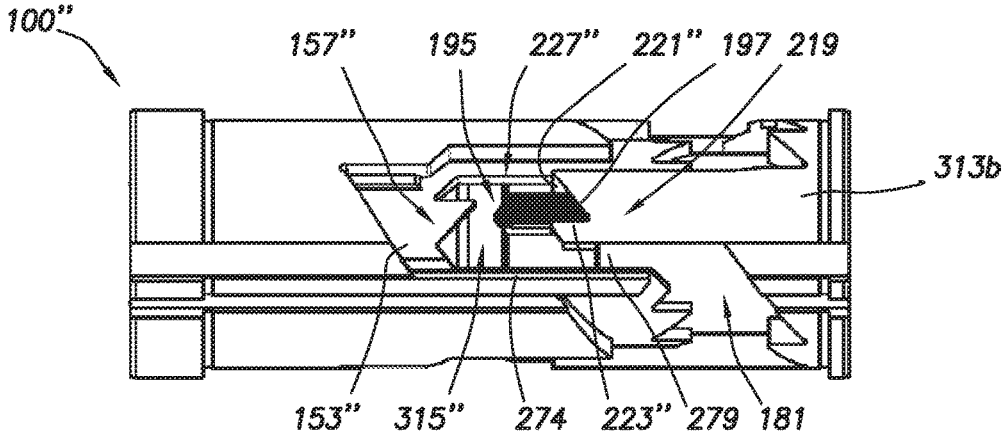
Figure 46C:
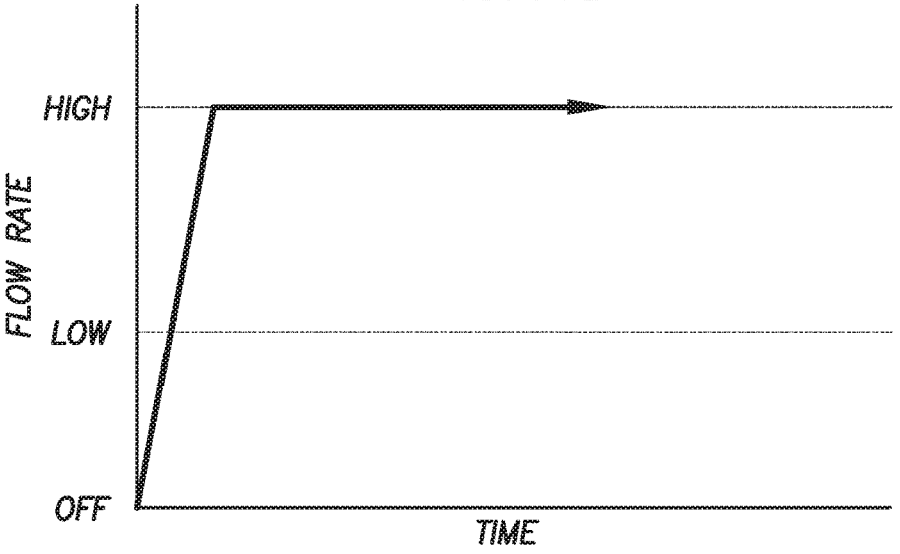
Figure 46D:
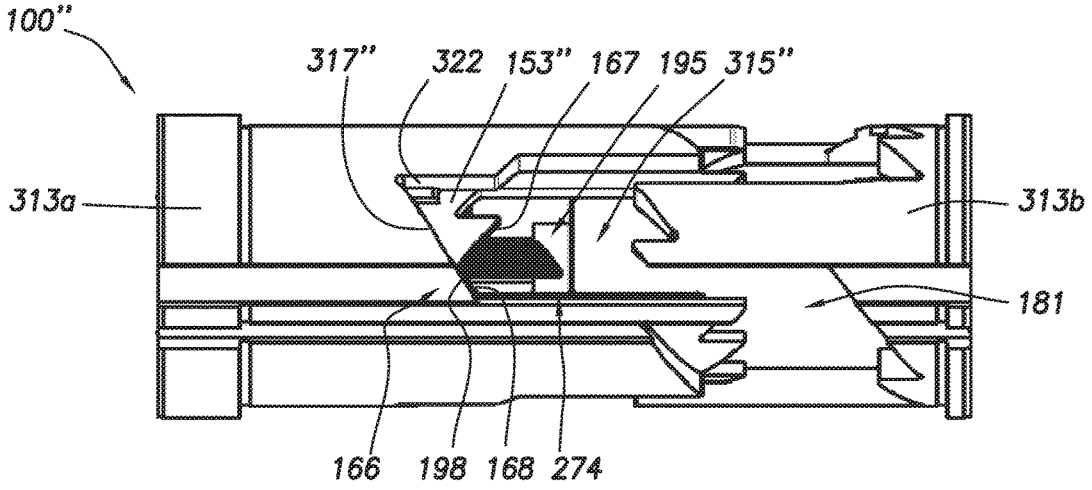
Figure 46E:
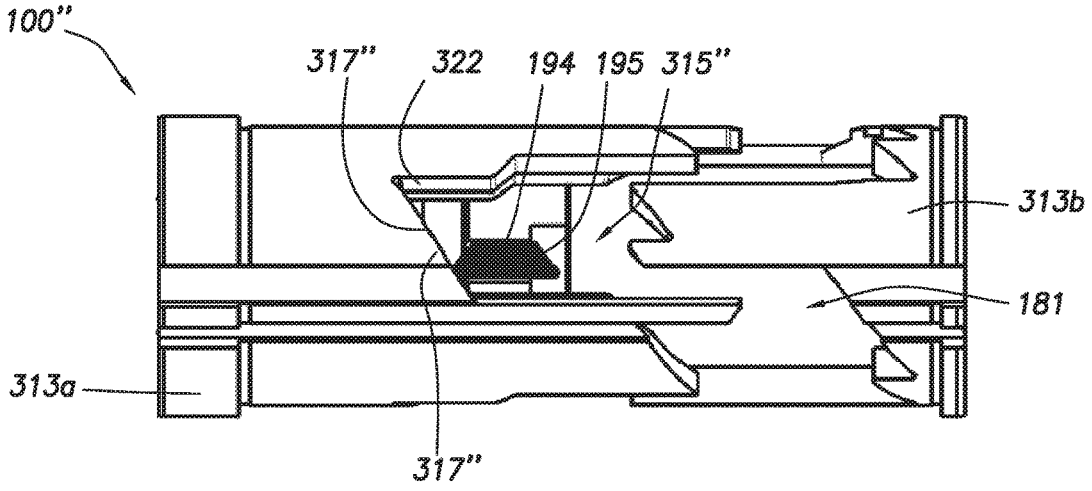
Figure 46F:
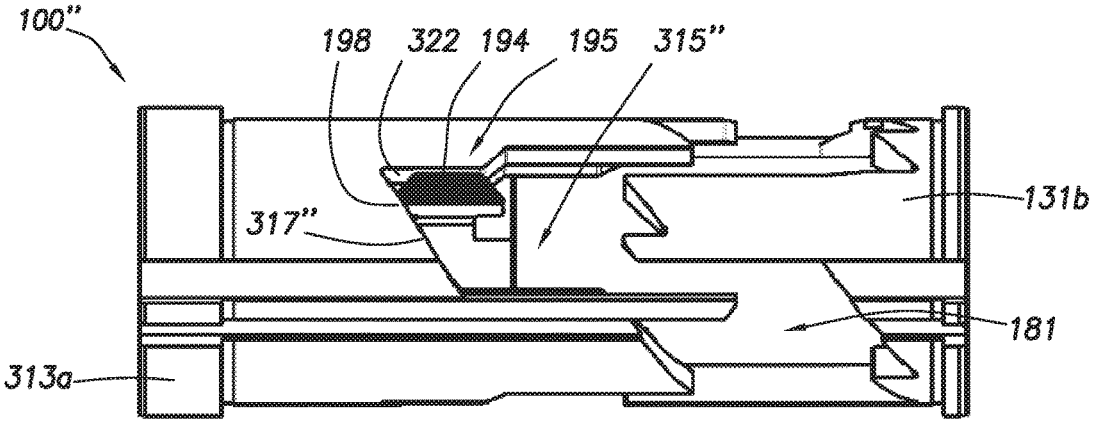
Figure 46G:
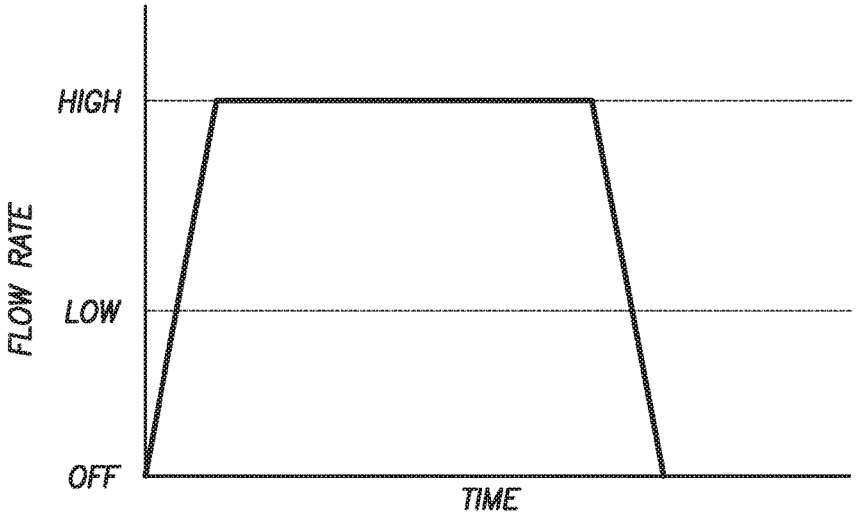

In some embodiments, downhole tool indexer 100" as depicted in FIGS. 46A-G may begin the inert or stay cycle in the upper reset position as depicted in FIG. 46A, with control assembly 141 in the control reset position and stroking assembly 181 in upper stroking reset position such that spline projection 195 is in the first home position against first reset slope 317 and first reset boundary 322. Although described and depicted as operating in the upper stroking range, an inert or stay cycle may be used in either the upper stroking range or lower stroking range by substantially similar operations with downhole tool indexer 100" beginning the inert or stay cycle in the lower stroking reset position of the lower stroking range as discussed further herein below. The flow rate may be increased through downhole tool indexer 100" to the high flow rate as shown in FIG. 46C during normal operations of drill string 10 in wellbore 20. As flow rate increases, control assembly 141 and stroking assembly 181 shifts downward into the upper high flow ratchet position such that spline projection 195 engages ratchet slope 221" as depicted in FIG. 46B, is rotated toward first exit boundary 324" to an upper high flow ratchet position 227", and stop face 223" of high flow ratchet tooth 219" limits longitudinal movement of stroking assembly 181. Fluid flow may be maintained at or set above the high flow rate such as to an operational flow rate for a prolonged duration, as depicted in FIG. 46C, which may allow drilling operations to continue with downhole tool 15 maintained set in a first operational mode. After the current drilling operation is complete the flow through downhole tool indexer 100" may be reduced or stopped as depicted in FIG. 46G. As the flow rate reduces to the low flow rate, stroking piston spring 183 may bias stroking assembly upward until spline projection 195 of spline barrel 191 of stroking assembly 181 engages upper low flow ratchet tooth 157" of low flow ratchet sleeve 153" as depicted in FIG. 46D. As the flow rate reduces to zero, control piston spring 143 may bias control assembly 141 upward to the control reset position such that upper low flow ratchet tooth 157" moves upward out of alignment with the boundary of first spline pocket 315" as depicted in FIG. 46E. Stroking piston spring 183 may bias stroking assembly 181 upward such that spline projection 195 engages first reset slope 317" as depicted in FIG. 44E. Continued upward movement of stroking assembly 181 may return stroking assembly 181 to the upper stroking reset position, with spline projection 195 engaging first reset slope 317" and first reset boundary 322" as depicted in FIG. 46F, such that downhole tool indexer 100" returns to the upper reset position.

Downhole tool indexer 100" as shown in FIGS. 46A-G, is depicted having a single upper high flow ratchet tooth 319" (and corresponding upper low flow ratchet tooth 157") and a single lower high flow ratchet tooth 349" (and corresponding lower low flow ratchet teeth 158"). In some embodiments, such as embodiments of downhole tool indexer 100' depicted in FIGS. 21-37, by including additional upper high flow ratchet teeth 319 (and corresponding upper low flow ratchet teeth 157'), unintentional indexing of downhole tool indexer 100' from the upper stroking range to the lower stroking range may be avoided by requiring additional changes in flow rate before such indexing occurs. Likewise, by including additional lower high flow ratchet teeth 349 (and corresponding lower low flow ratchet teeth 158'), unintentional indexing of downhole tool indexer 100' from the lower stroking range to the upper stroking range may be avoided by requiring additional changes in flow rate before such indexing occurs. The chance of unintentionally changing operational mode of downhole tool 15 caused by, for example, unintentional lowering of the flow rate below the high flow rate threshold to the low flow rate, may therefore be reduced.

A full upper stroking range indexing cycle and a full lower stroking range indexing cycle of downhole tool indexer 100' consistent with at least one embodiment of the present disclosure will now be described. An indexing cycle refers to a series of changes in flow rate through downhole tool indexer 100' to cause the shifting of control assembly 141 and stroking assembly 181 until the spline projection 195 of stroking assembly 181 indexes from being positioned within the boundary of first spline pocket 315 to being positioned within the boundary of second spline pocket 345 or vice versa, such downhole tool indexer 100' indexes from operating within the upper stroking range to operating within the lower stroking range or vice versa.

Figure 24A:
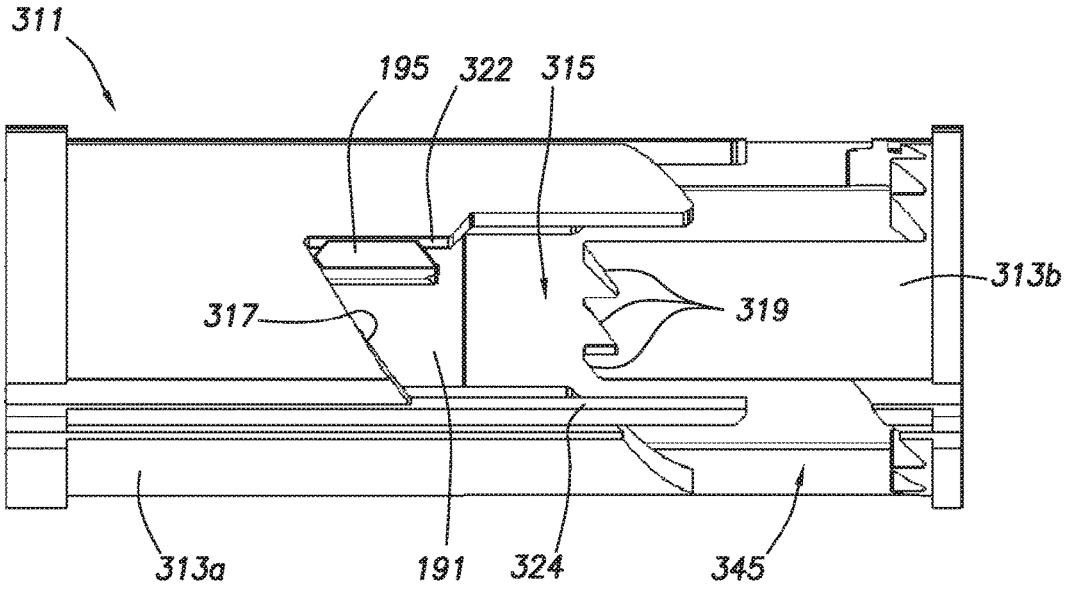
FIG. 24A depicts a partial side view of a downhole tool indexer consistent with at least one embodiment of the present disclosure at a stage in an indexing cycle.
Figure 24B:
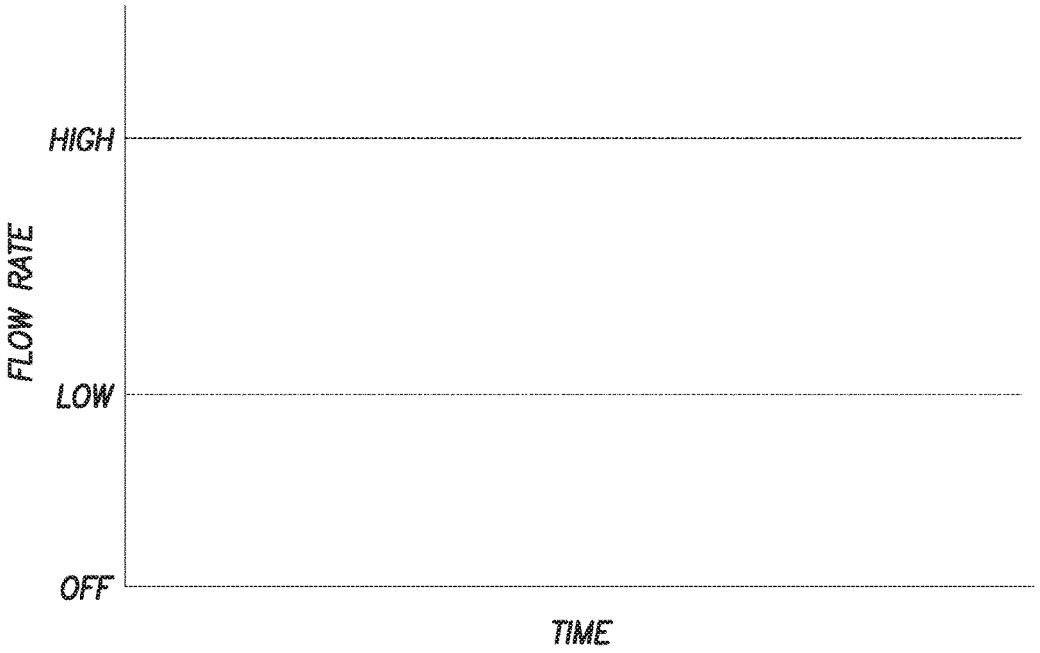
FIG. 24B depicts a chart of fluid flow rates in an indexing cycle.
Figure 48A:
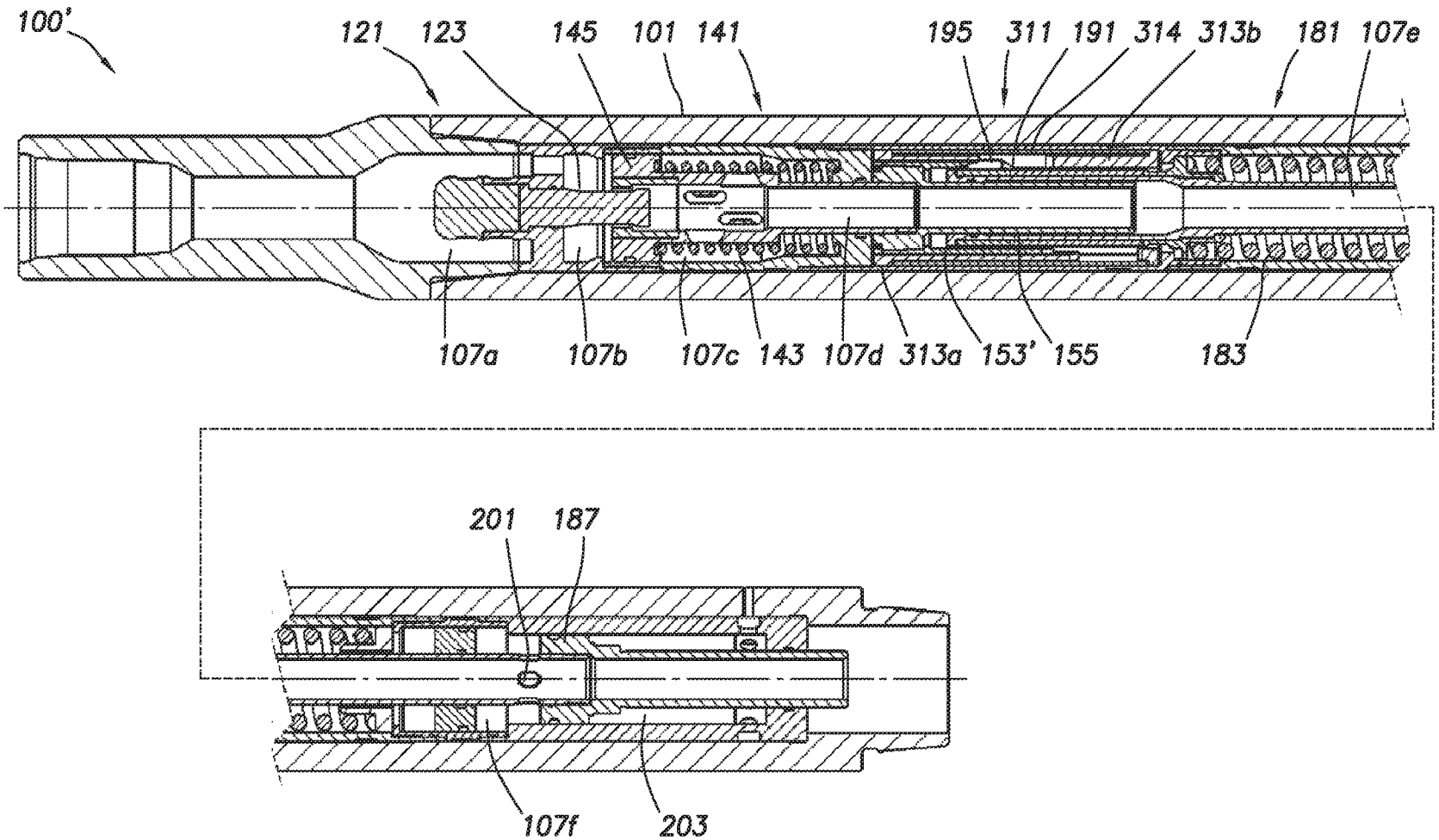
FIGS. 48A-48F depict a downhole tool indexer consistent with at least one embodiment of the present disclosure in various positions of one or more indexing cycles.

In some embodiments, downhole tool indexer 100' may begin the upper stroking range indexing cycle in the upper reset position as depicted in FIGS. 24A, 24B such that spline projection 195 is in the first home position within first spline pocket 315 against first reset slope 317 and first reset boundary 322, control assembly 141 is in the control reset position, and stroking assembly 181 is in the upper stroking reset position as depicted in FIG. 48A. In some embodiments, the rate of fluid flow through downhole tool indexer 100' at the beginning of the indexing cycle may be zero.

Figure 25A:
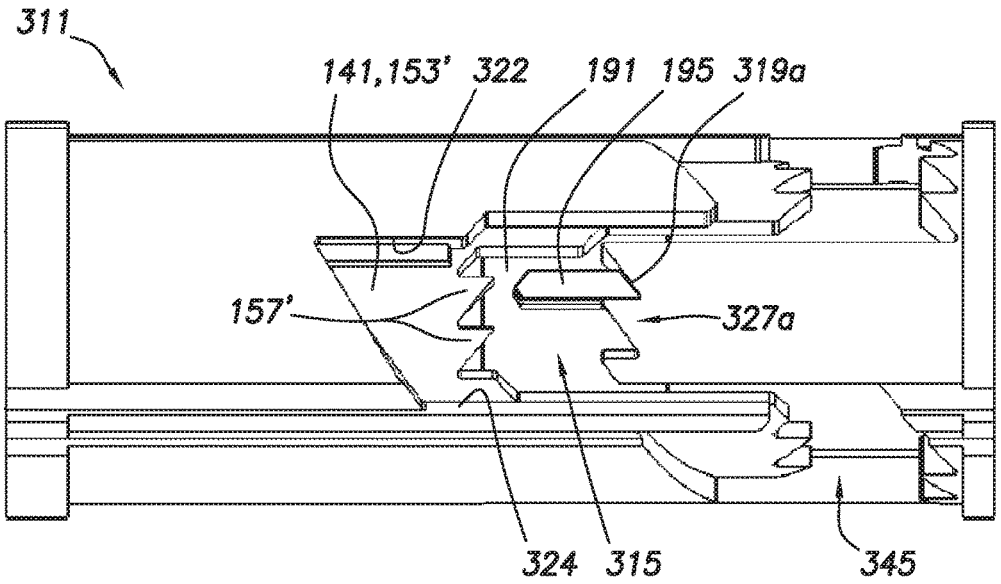
FIG. 25A depicts a partial side view of a downhole tool indexer consistent with at least one embodiment of the present disclosure at a stage in an indexing cycle.
Figure 25B:
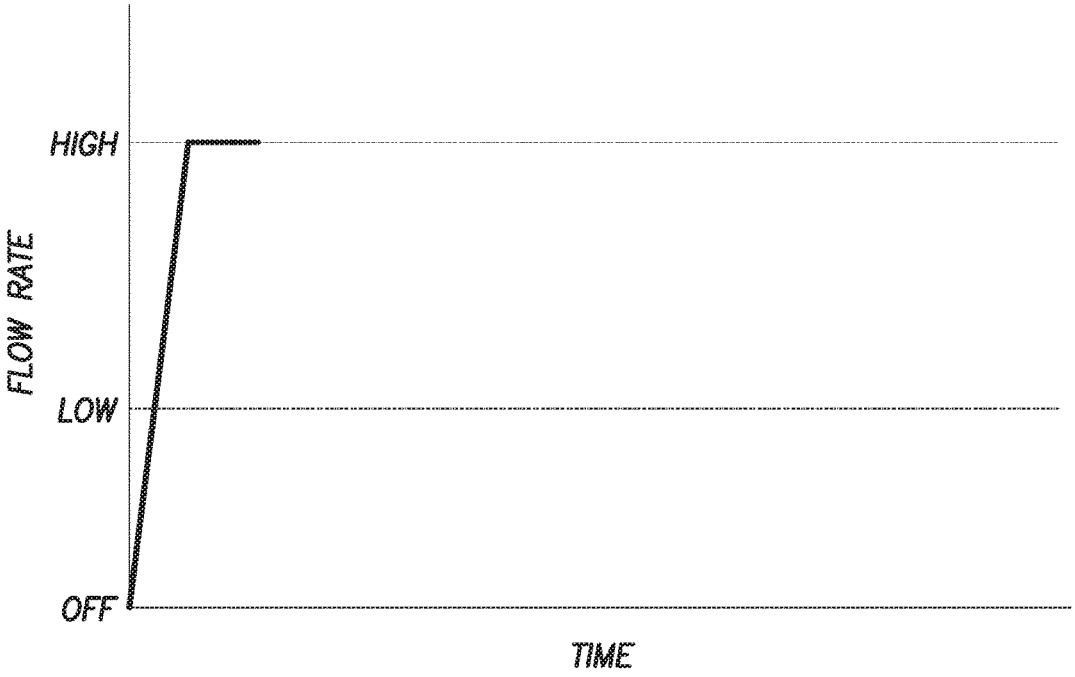
FIG. 25B depicts a chart of fluid flow rates in an indexing cycle.

The flow rate may be increased through downhole tool indexer 100' up to the high flow rate, defining the first indexing step depicted in FIGS. 25A, 25B. As flow rate increases, control assembly 141 shifts through the control low flow position (depicted in FIG. 48C) and into the control high flow position as the high flow rate is reached. Stroking assembly 181 shifts downward into the upper high flow ratchet position (depicted in FIG. 48B) such that spline projection 195 engages first upper high flow ratchet tooth 319*a* and is rotated toward first exit boundary 324 to a first upper high flow ratchet position 327*a*, preventing further downward longitudinal movement of stroking assembly 181 past the upper high flow ratchet position. Downhole tool indexer 100' is thereby positioned in the upper stroke position.

Figure 26A:
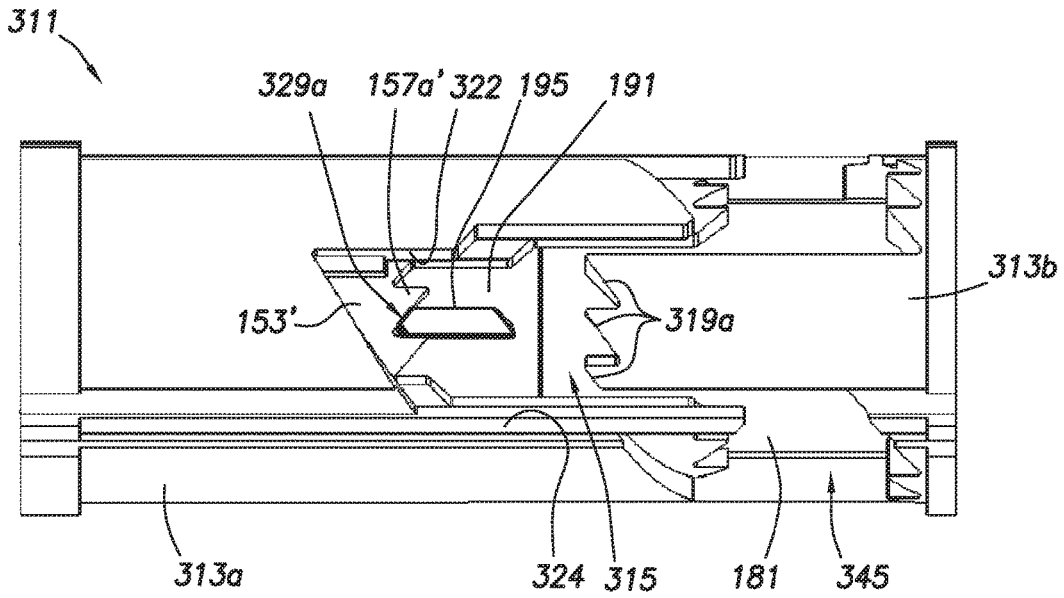
FIG. 26A depicts a partial side view of a downhole tool indexer consistent with at least one embodiment of the present disclosure at a stage in an indexing cycle.
Figure 26B:
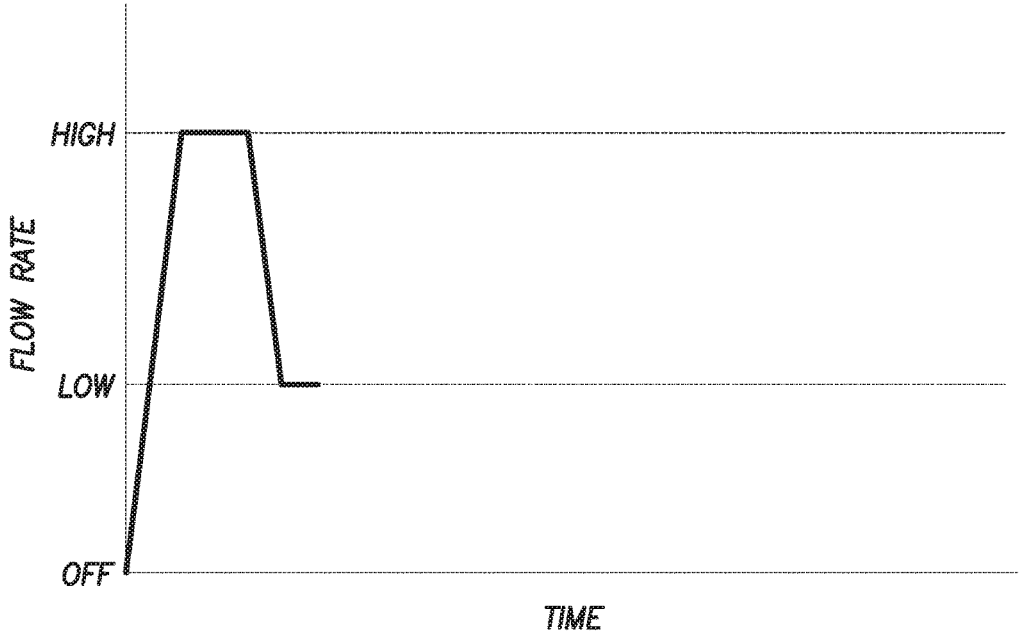
FIG. 26B depicts a chart of fluid flow rates in an indexing cycle.

The flow rate may be decreased to the low flow rate as depicted in FIGS. 26A, 26B. The control assembly 141 translates upward to the control low flow position as stroking assembly 181 moves upward to the upper low flow ratchet position as shown in FIG. 48C. As stroking assembly 181 moves upward to the upper low flow ratchet position, spline projection 195 engages first upper low flow ratchet tooth 157'*a*, causing spline barrel 191 to rotate toward first exit boundary 324, positioning stroking assembly 181 into first upper low flow ratchet position 329*a*. Low flow ratchet sleeve 153' prevents further upward longitudinal movement of stroking assembly 181 past the upper low flow ratchet position. Low flow ratchet sleeve 153' may, when control assembly 141 is in the control low flow position, be positioned such that spline projection 195 does not contact first reset slope 317 or such that low flow ratchet sleeve 153' prevents further upward movement of spline projection 195 along first reset slope 317 as upper low flow ratchet teeth 157' are longitudinally aligned within first spline pocket 315. Downhole tool indexer 100' is thereby positioned in an upper control position.

Figure 27A:
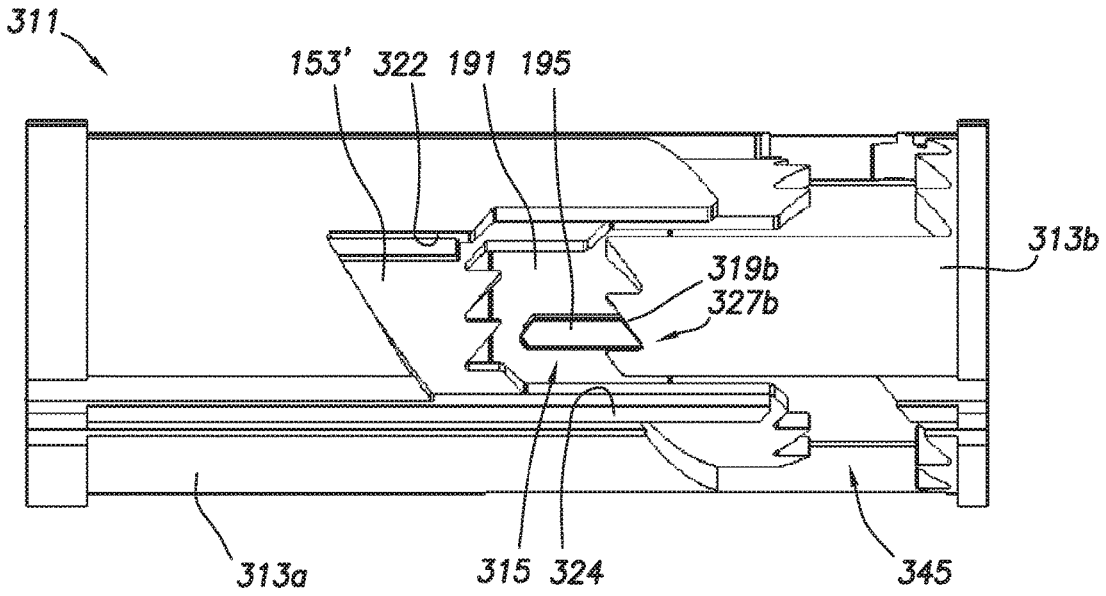
FIG. 27A depicts a partial side view of a downhole tool indexer consistent with at least one embodiment of the present disclosure at a stage in an indexing cycle.
Figure 27B:
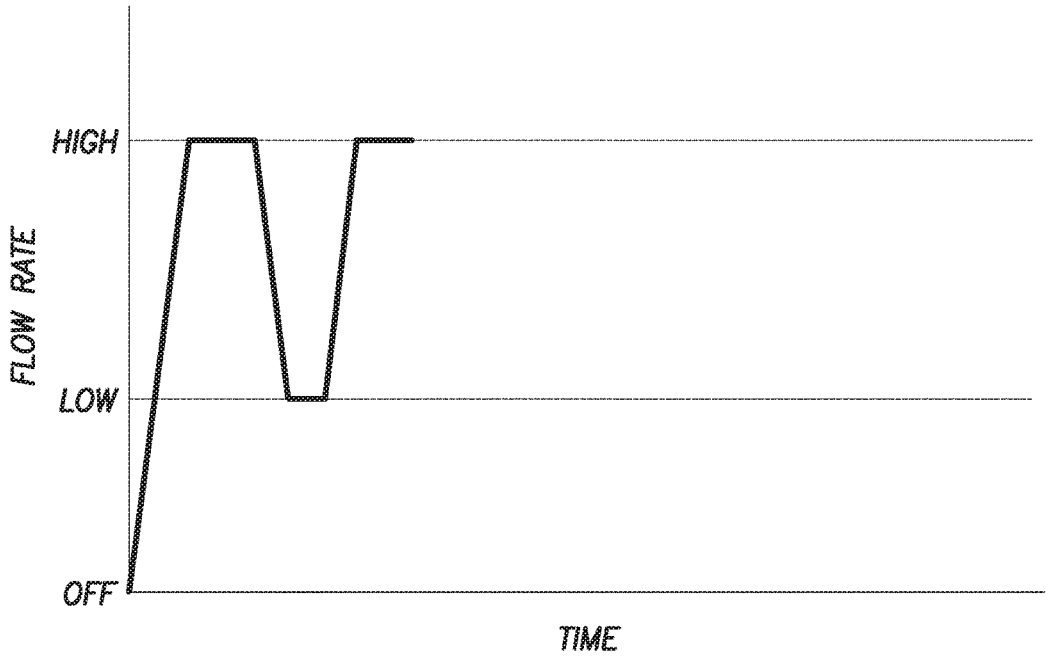
FIG. 27B depicts a chart of fluid flow rates in an indexing cycle.
Figure 48B:
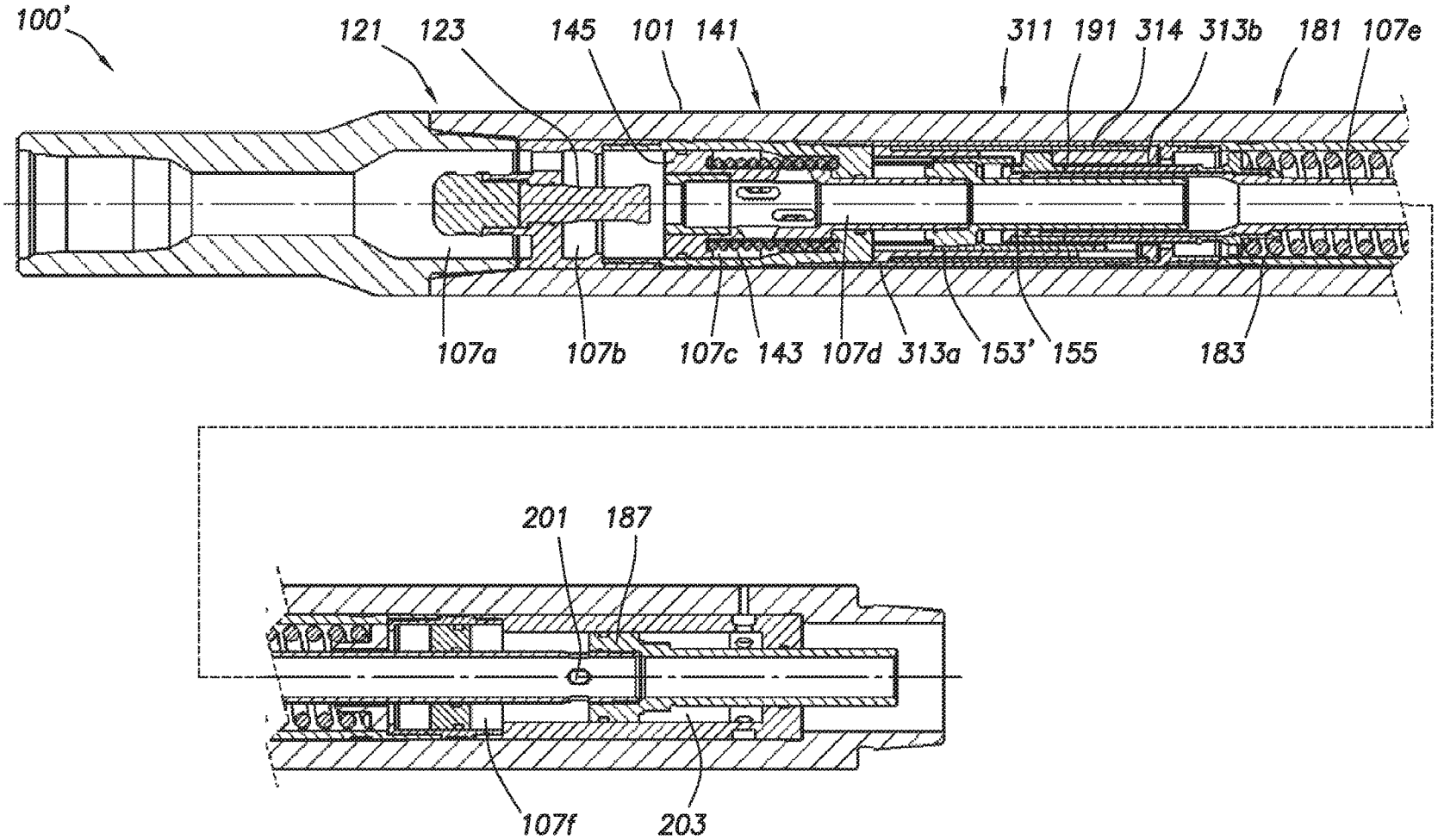
Figure 48C:
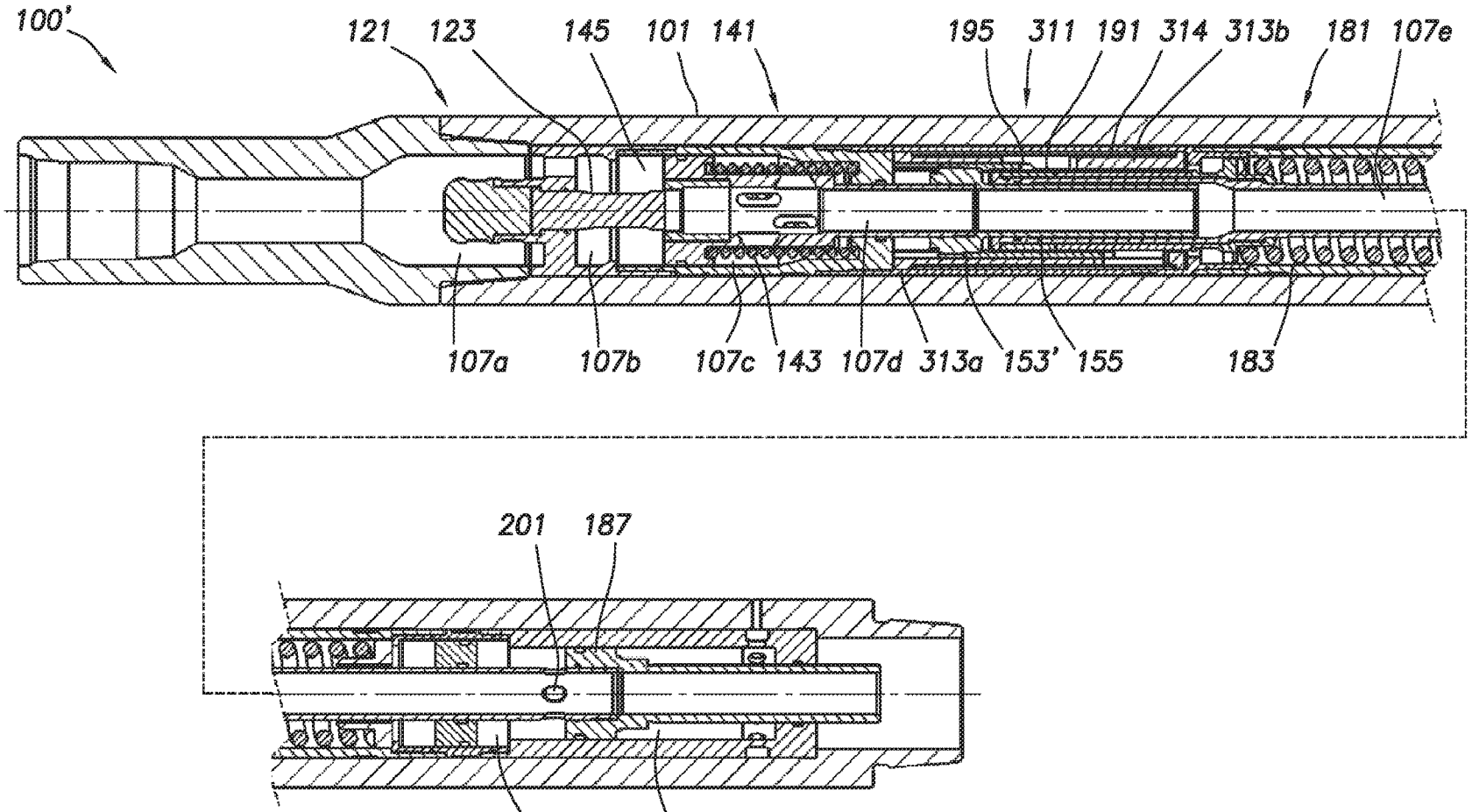

The flow rate may then be increased to the high flow rate and decreased to the low flow rate causing stroking assembly 181 to shift between the upper high flow ratchet position depicted in FIG. 48B and the upper low flow ratchet position depicted in FIG. 48C. Downhole tool indexer 100' is transitioned between the upper stroke position and the upper control position until spline projection 195 is aligned with first transition slot 325 allowing stroking assembly 181 to shift into the lower high flow ratchet position depicted in FIG. 48E. The number of flow rate steps may depend on the number of upper high flow ratchet teeth 319 and upper low flow ratchet teeth 157'. For example, as depicted in FIGS. 27A, 27B, the flow rate may be increased to the high flow rate such that stroking assembly 181 translates downward, and spline projection 195 engages second upper high flow ratchet teeth 319*b* such that spline barrel 191 is rotated toward first exit boundary 324 to a second upper high flow ratchet position 327*b*. Downhole tool indexer 100' is thereby positioned in the upper stroke position. The flow rate may then be decreased to the low flow rate such that stroking assembly 181 translates upwards, and spline projection 195 engages with second upper low flow ratchet tooth 157'*b* such that spline barrel 191 is rotated toward first exit boundary

Figure 28A:
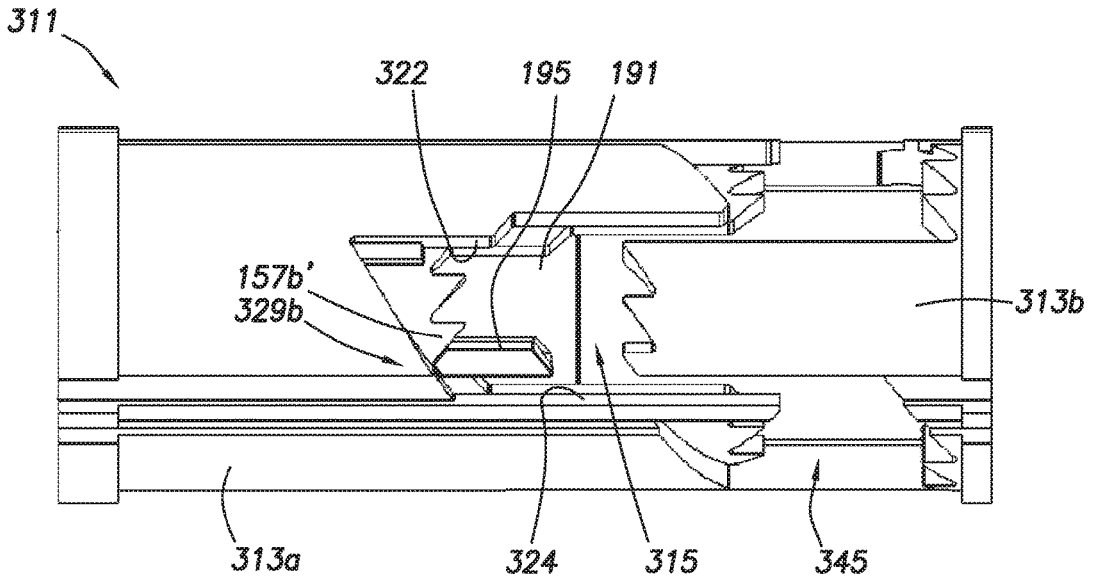
FIG. 28A depicts a partial side view of a downhole tool indexer consistent with at least one embodiment of the present disclosure at a stage in an indexing cycle.
Figure 28B:
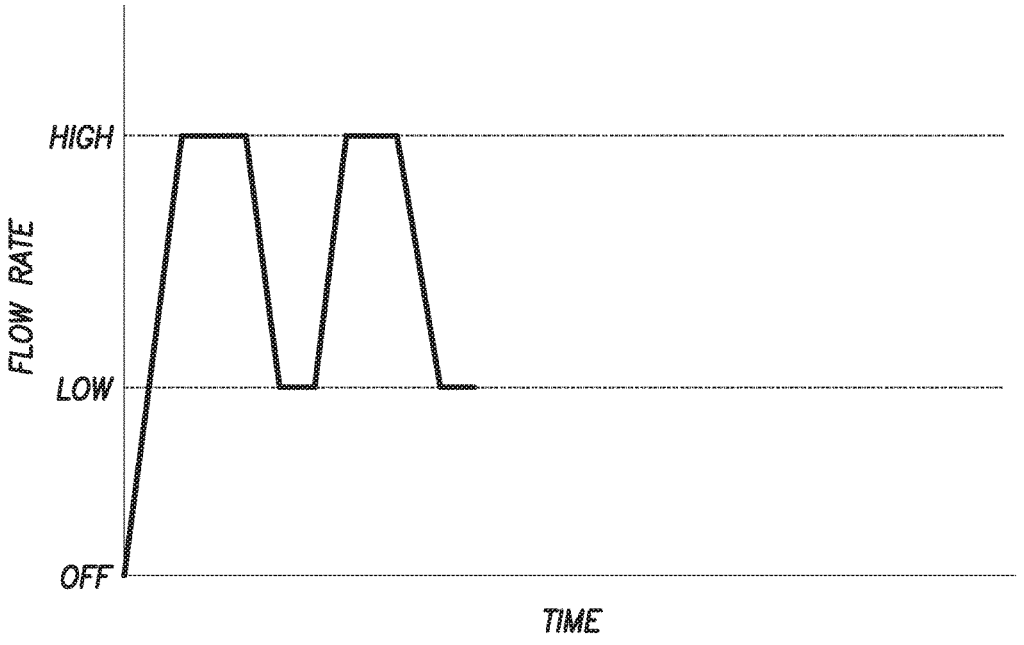
FIG. 28B depicts a chart of fluid flow rates in an indexing cycle.
Figure 29A:
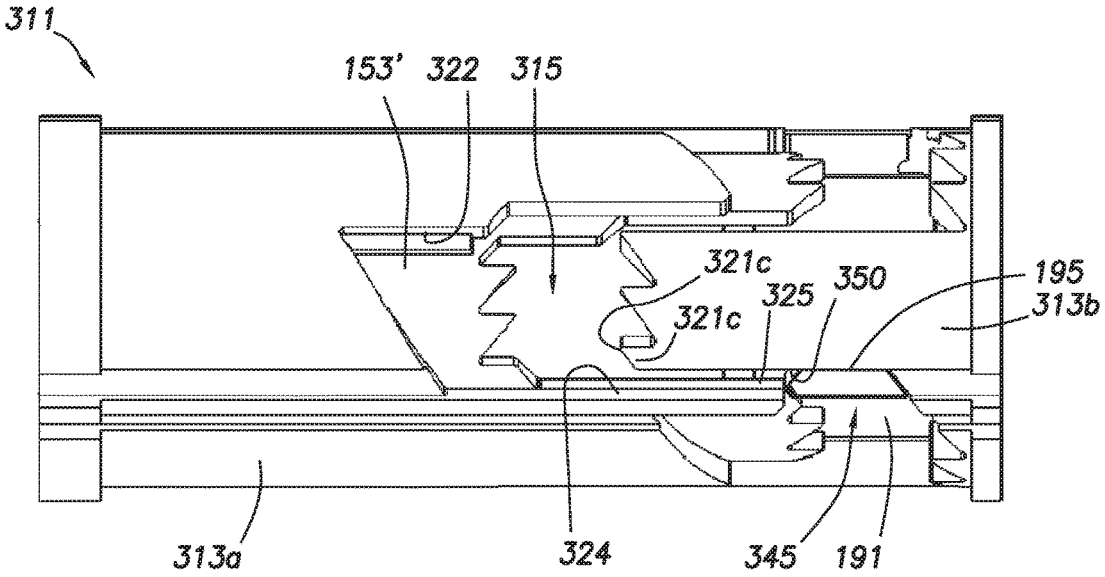
FIG. 29A depicts a partial side view of a downhole tool indexer consistent with at least one embodiment of the present disclosure at a stage in an indexing cycle.
Figure 29B:
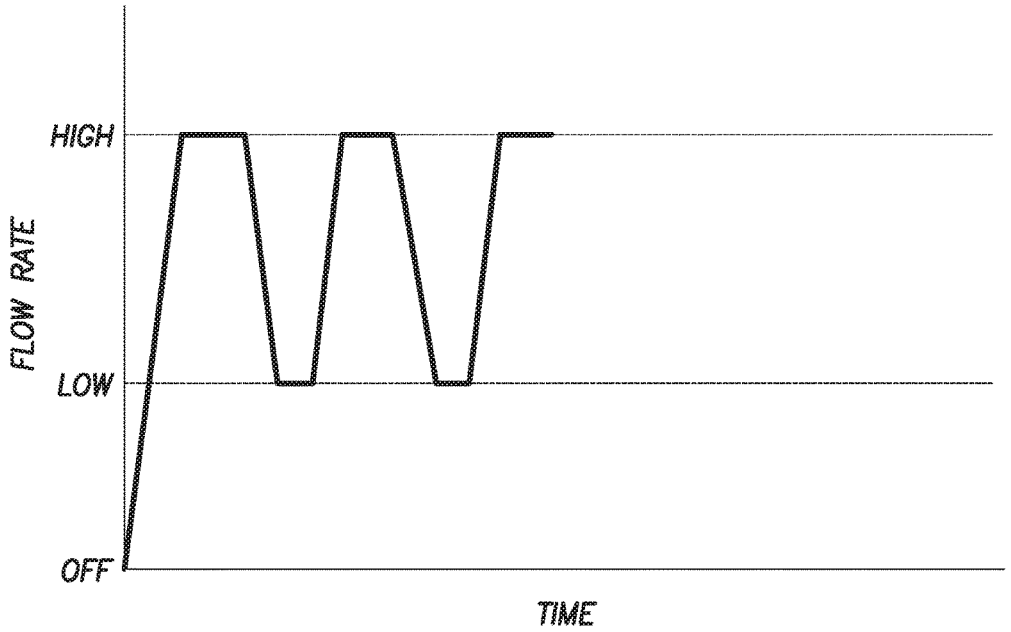
FIG. 29B depicts a chart of fluid flow rates in an indexing cycle.
Figure 30:
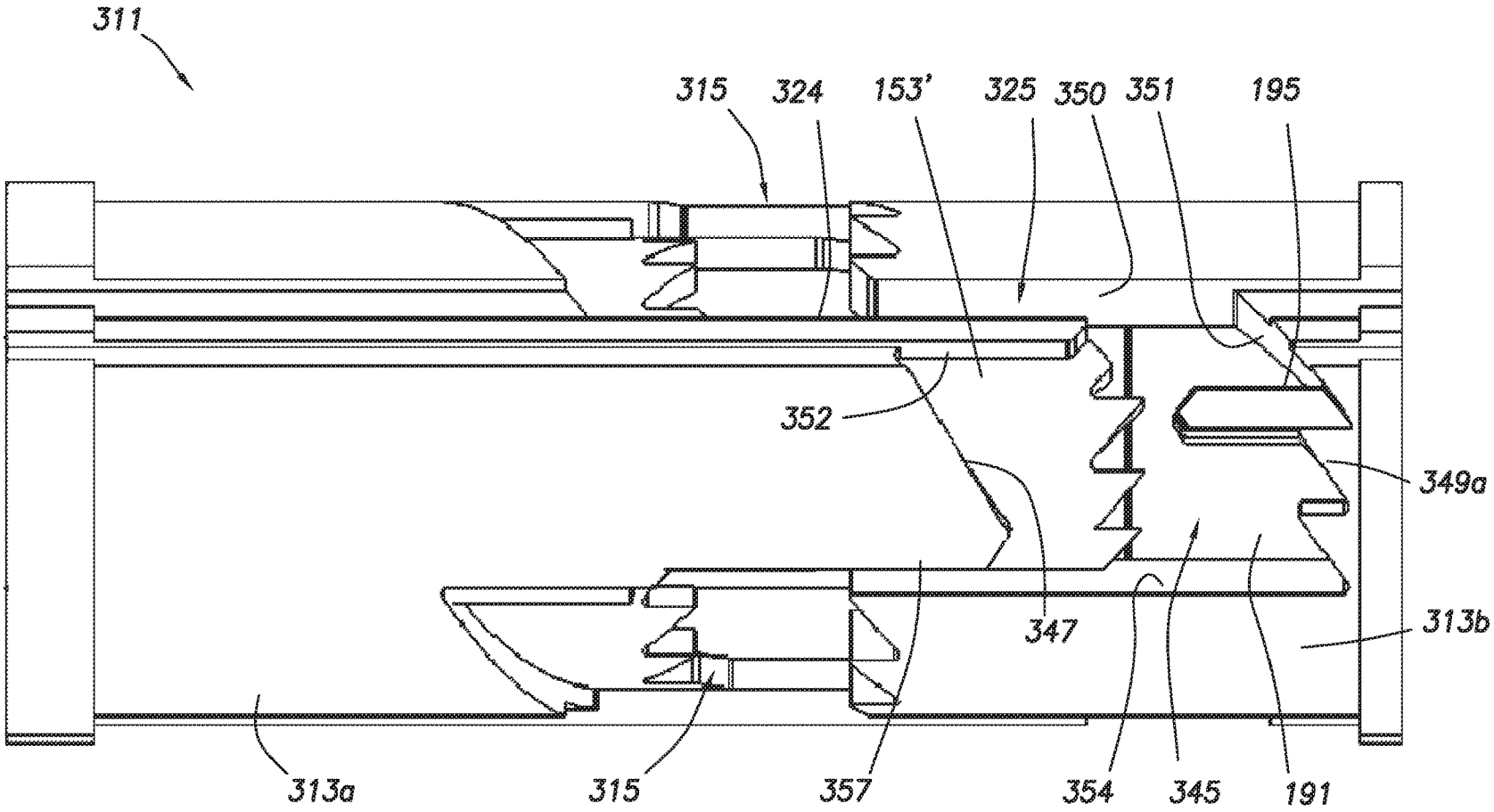
FIG. 30 depicts a partial side view of a downhole tool indexer consistent with at least one embodiment of the present disclosure.
Figure 31A:
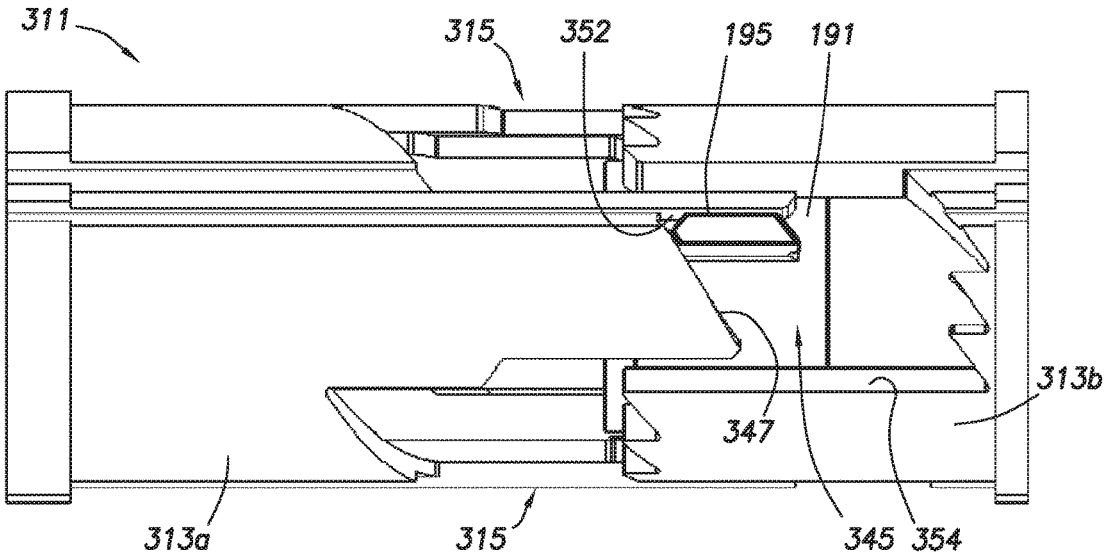
FIG. 31A depicts a partial side view of a downhole tool indexer consistent with at least one embodiment of the present disclosure at a stage in an indexing cycle
Figure 31B:
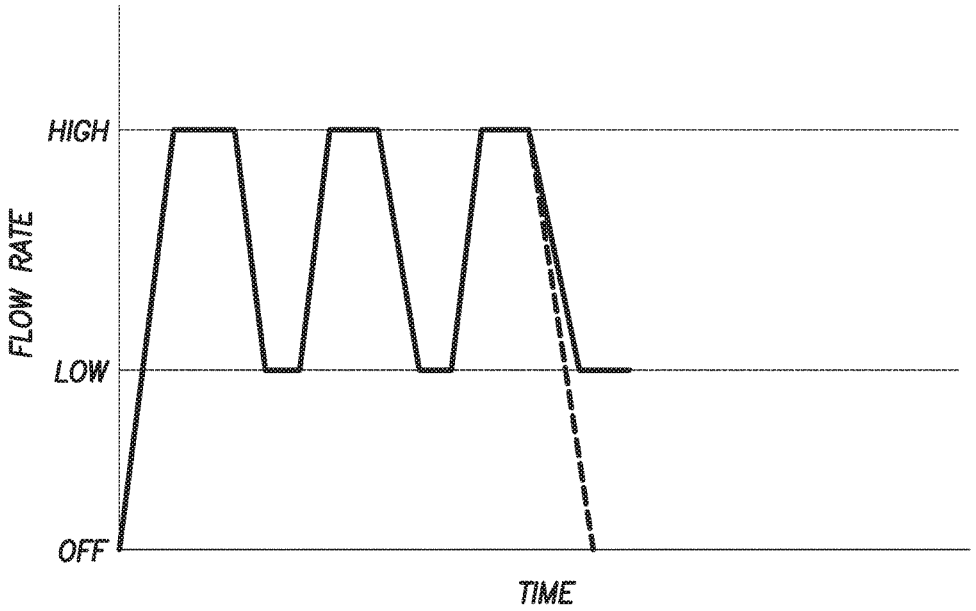
FIG. 31B depicts a chart of fluid flow rates in an indexing cycle.

324. Stroking assembly 181 is thereby positioned in the second upper low flow ratchet position 329*b*, as depicted in FIGS. 28A, 28B, and downhole tool indexer 100' is thereby positioned in the upper control position. The flow rate may then be increased to the high flow rate that spline projection 195 engages the slope of third upper high flow ratchet tooth 319*c*, defined as exit slope 321*c* and continues downward into first transition slot 325, allowing stroking assembly 181 to translate downward into the lower high flow ratchet position until spline projection 195 engages the first lower ratchet slope 351 of the first lower high flow ratchet tooth 349*a* formed as part of second spline pocket 345 as depicted in FIG. 29A. Transfer slope 351 may cause rotation of spline barrel 191 toward second exit boundary 354 until spline projection 195 engages with first lower high flow ratchet tooth 349*a* as depicted in FIG. 30. Downhole tool indexer 100' is thereby positioned in the lower stroke position. Once spline projection 195 is positioned in second spline pocket 345, decrease of flow rate or stoppage of flow may cause control assembly 141 to shift to the position as depicted in FIGS. 31A, 31B. Spline projection 195 may engage with second reset slope 347 and be rotated toward second reset boundary 352 to a second home position as depicted in FIG. 31A. Second reset slope 347 may, by retaining stroking assembly 181 in a position referred to herein as a lower stroking reset position, position downhole tool indexer 100' in a lower reset position.

Figure 48D:
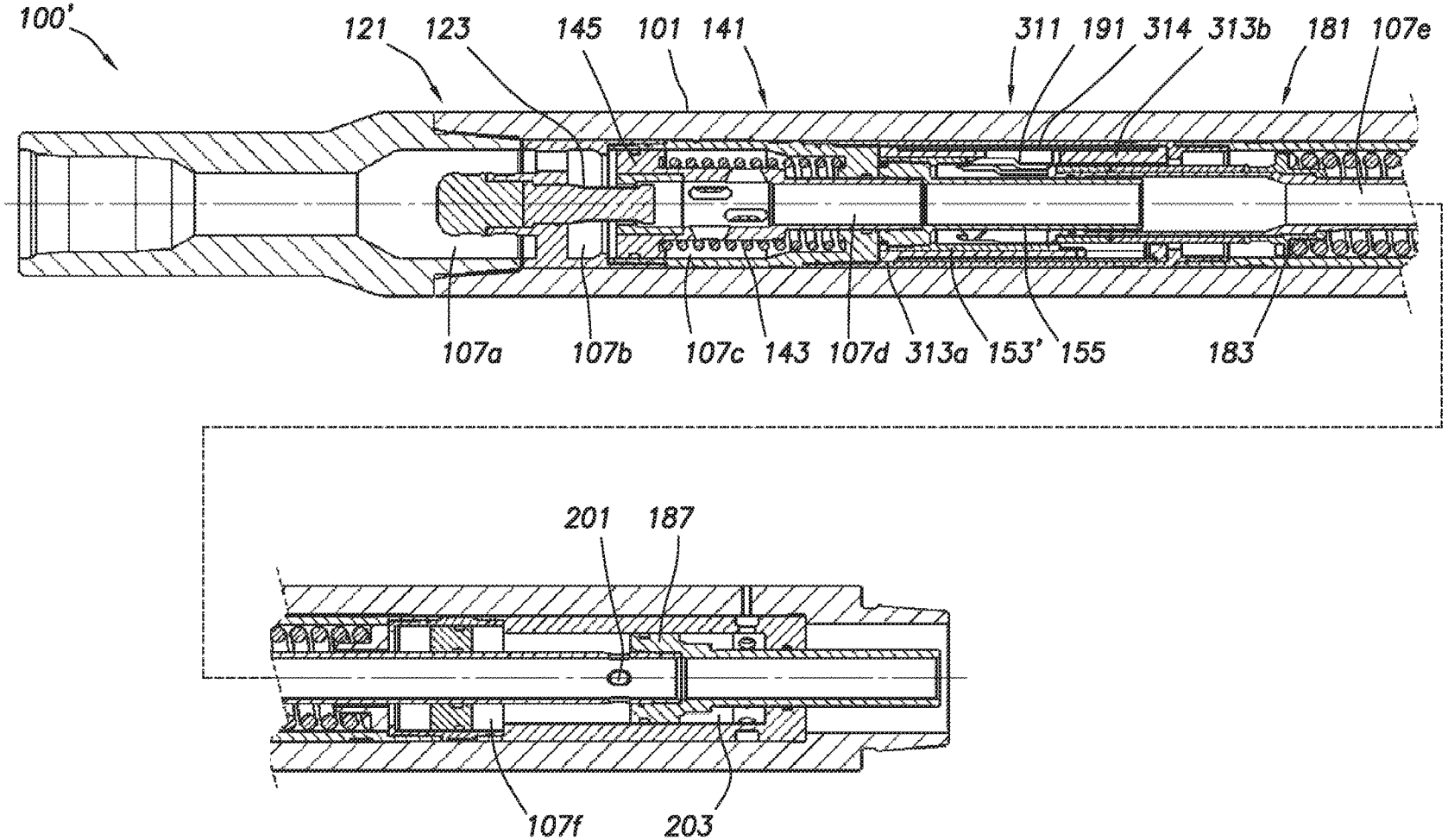
Figure 48E:
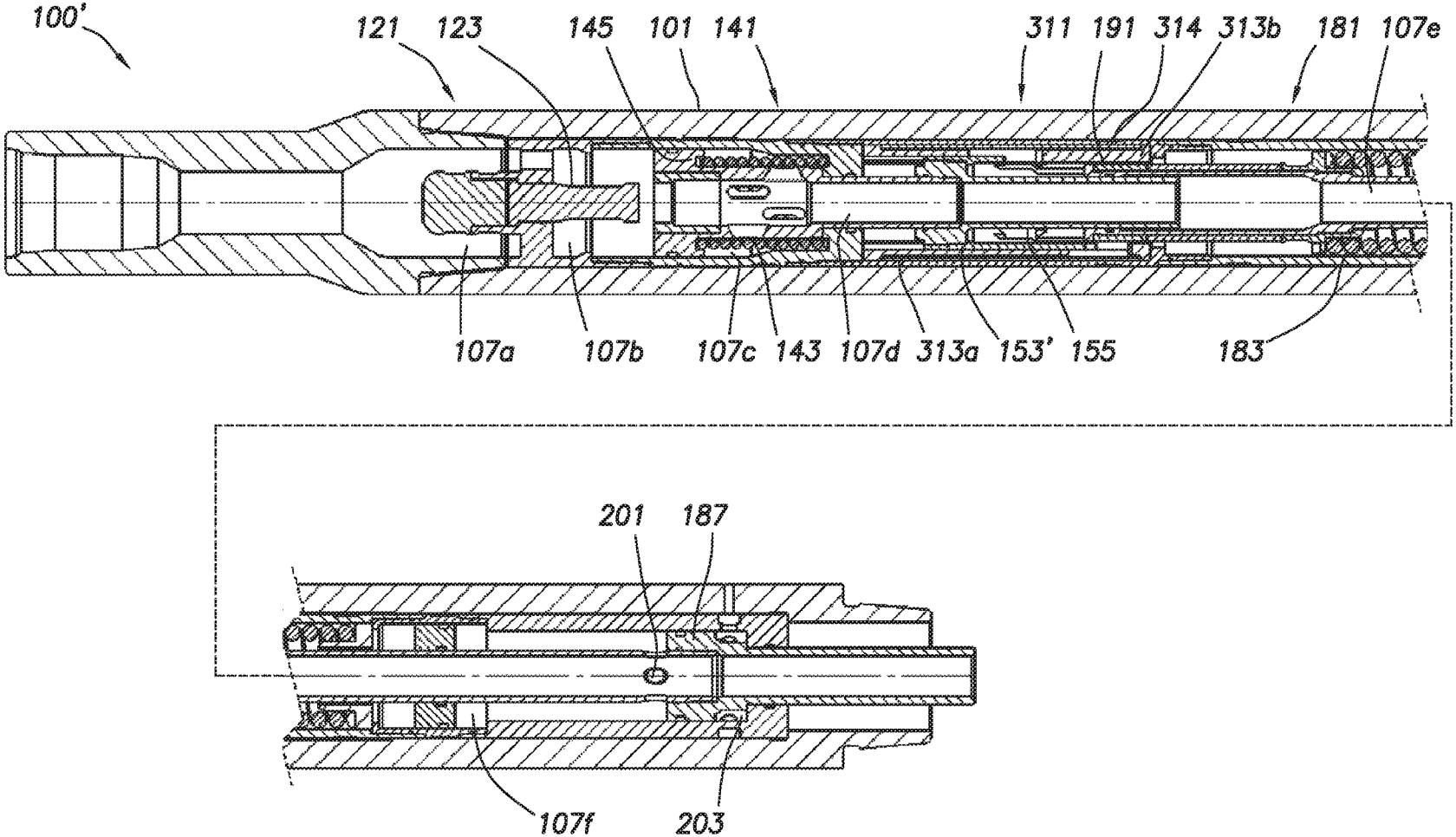

Downhole tool indexer 100' may now operate in the lower stroking range and may undergo multiple inert or stay cycles such as increasing flow from zero to the high flow rate or operational flow rate while downhole tool indexer 100' remains in the lower stroking range. In such an embodiment, downhole tool 15 may be maintained set in a second operational mode or configuration during subsequent drilling operations. At the high or operational flow rate, downhole tool indexer 100' may remain in the lower stroke position as depicted in FIG. 48E. Reducing flow to a zero flow rate, downhole tool indexer 100' may be positioned in the lower reset position depicted in FIG. 48D. Subsequent increases in flow rate to the high or operational flow rate may position downhole tool indexer 100' in the lower stroke position.

In some embodiments, subsequent increases in flow rate to the high flow rate and decreases in flow rate to or below the low flow rate may activate and deactivate downhole tool 15 respectively by moving stroking assembly 181 from the lower stroking reset position to the lower high flow ratchet position until the lower stroking range indexing cycle is carried out. In some embodiments, the operating mode, configuration, or other characteristic of downhole tool 15 may be dictated by whether downhole tool indexer 100' is in the lower stroking range or upper stroking range.

A lower stroking range indexing cycle to index downhole tool indexer 100' from the lower stroking range to the upper stroking range will now be described. In this example, downhole tool indexer 100' is described as beginning the lower stroking range indexing cycle such that spline projection 195 is located within the boundary of second spline pocket 345 and in the second home position depicted in FIG. 31A, control assembly 141 is in the control reset position, and stroking assembly 181 is in the lower stroking reset position. However, the lower stroking range indexing cycle may be initiated with control assembly 141 in the control low flow position, where fluid flow rate is at the low flow rate.

Figure 32A:
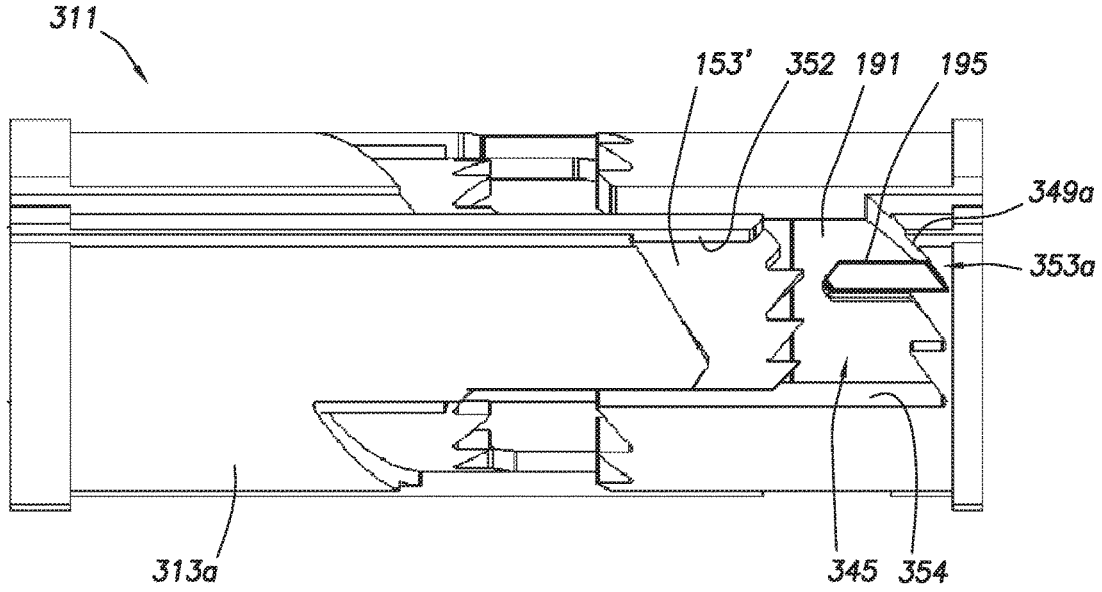
FIG. 32A depicts a partial side view of a downhole tool indexer consistent with at least one embodiment of the present disclosure at a stage in an indexing cycle.
Figure 32B:
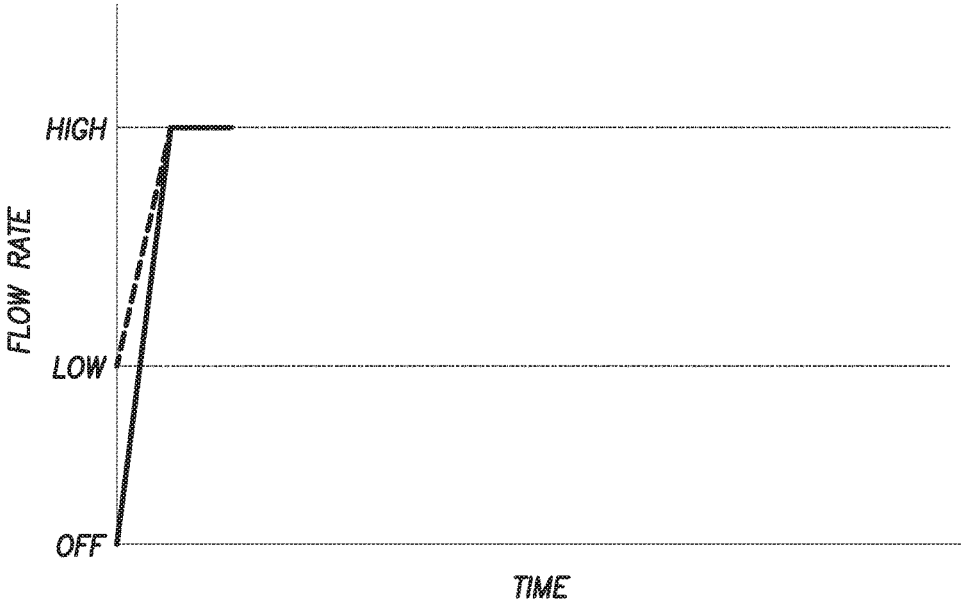
FIG. 32B depicts a chart of fluid flow rates in an indexing cycle.

The flow rate may be increased through downhole tool indexer 100' up to the high flow rate, as depicted in FIGS. 32A, 32B. As flow rate increases, control assembly 141 shifts into the control high flow position (depicted in FIG. 48E) as stroking assembly 181 shifts downward into the lower high flow ratchet position such that spline projection 195 engages first lower high flow ratchet tooth 349*a* and spline barrel 191 is rotated toward second exit boundary 354 to a first lower high flow ratchet position 353*a*, preventing further longitudinal movement of stroking assembly 181 past the lower high flow ratchet position. Downhole tool indexer 100' is thereby positioned in the lower stroke position.

Figure 33A:
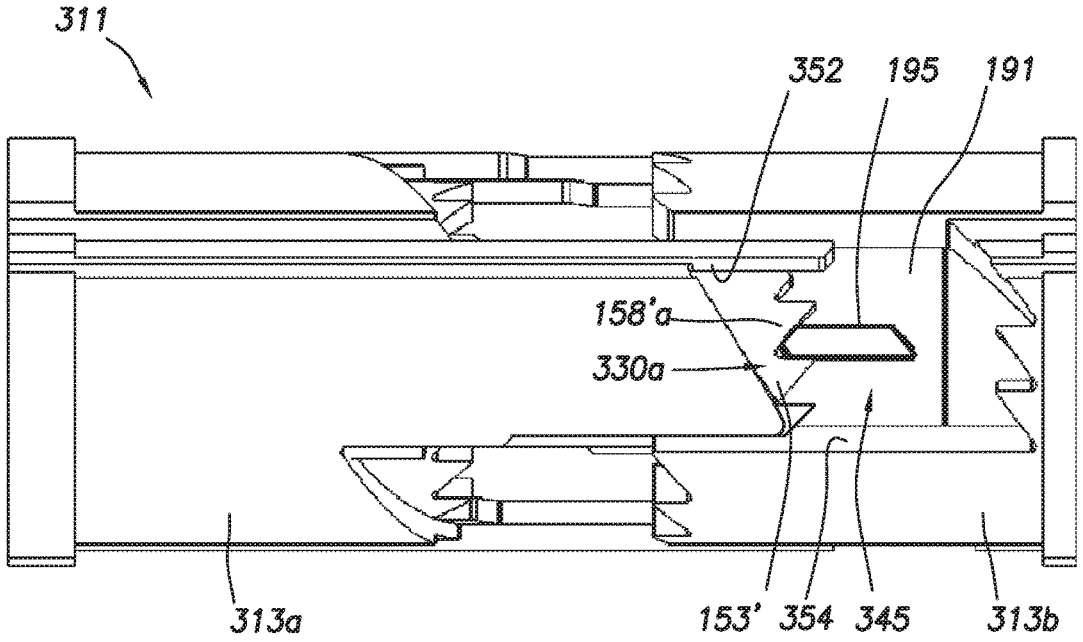
FIG. 33A depicts a partial side view of a downhole tool indexer consistent with at least one embodiment of the present disclosure at a stage in an indexing cycle.
Figure 33B:
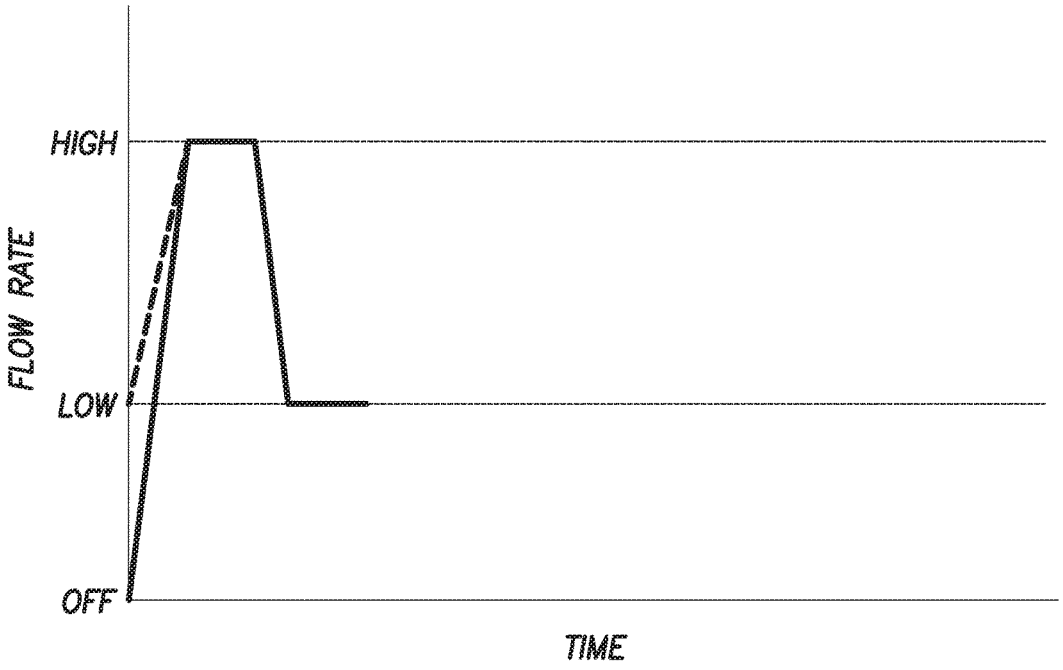
FIG. 33B depicts a chart of fluid flow rates in an indexing cycle.
Figure 48F:
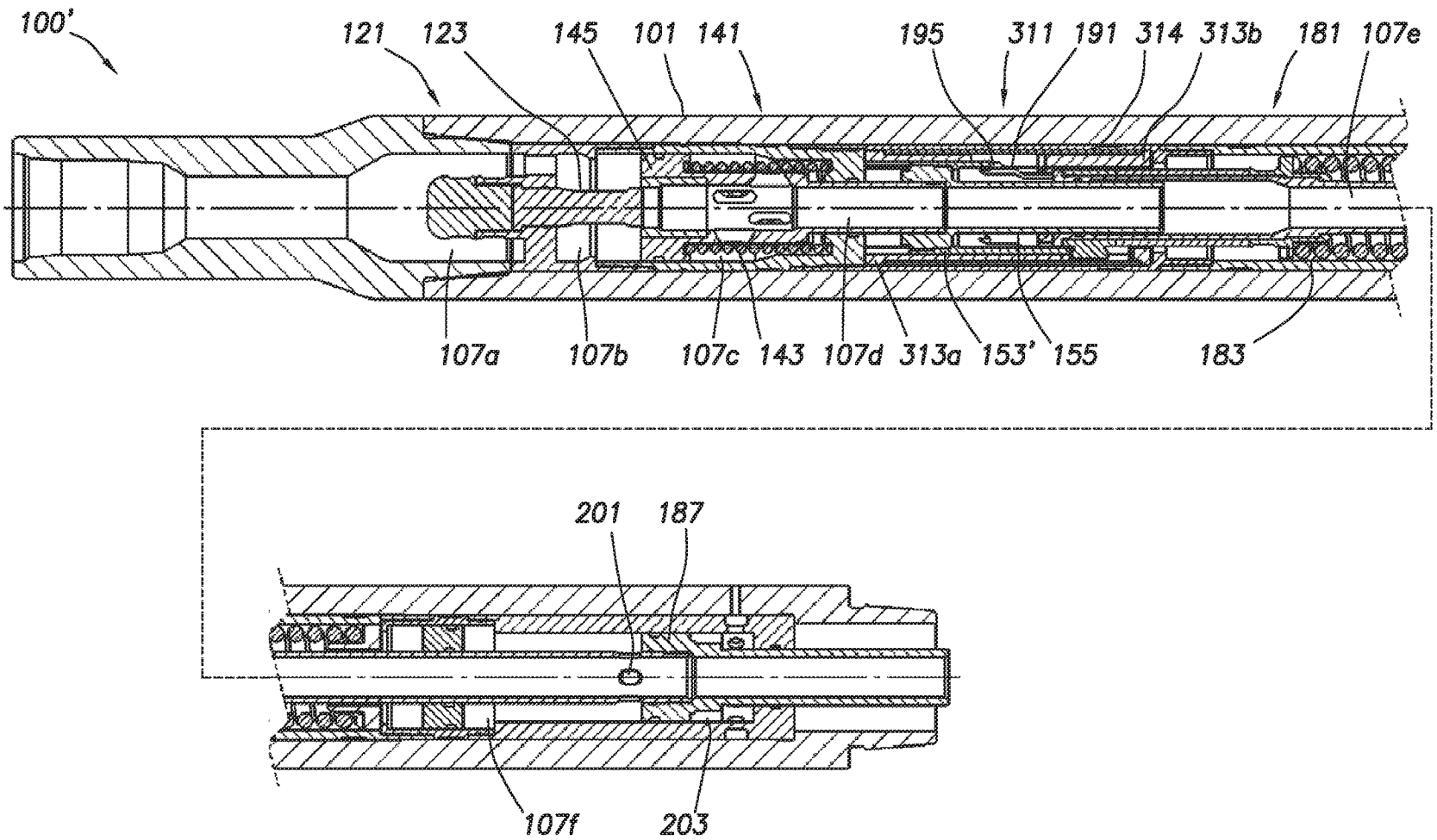

The flow rate may be decreased to the low flow rate, as depicted in FIGS. 33A, 33B. The control assembly 141 translates upward to and is held at the control low flow position as stroking assembly 181 moves upward to the lower low flow ratchet position (depicted in FIG. 48F). As stroking assembly 181 moves upward, spline projection 195 engages first lower low flow tooth 158'*a*, causing spline barrel 191 to rotate toward second exit boundary 354, positioning stroking assembly 181 into first lower low flow ratchet position 330*a*, and low flow ratchet sleeve 153' prevents further upward longitudinal movement of stroking assembly 181 past the lower low flow ratchet position. Low flow ratchet sleeve 153' may, when control assembly 141 is in the control low flow position, be positioned such that spline projection 195 does not contact second reset slope 347 or such that low flow ratchet sleeve 153' prevents further upward movement of spline projection 195 along second reset slope 347. Downhole tool indexer 100' is thereby positioned in a lower control position.

Figure 34A:
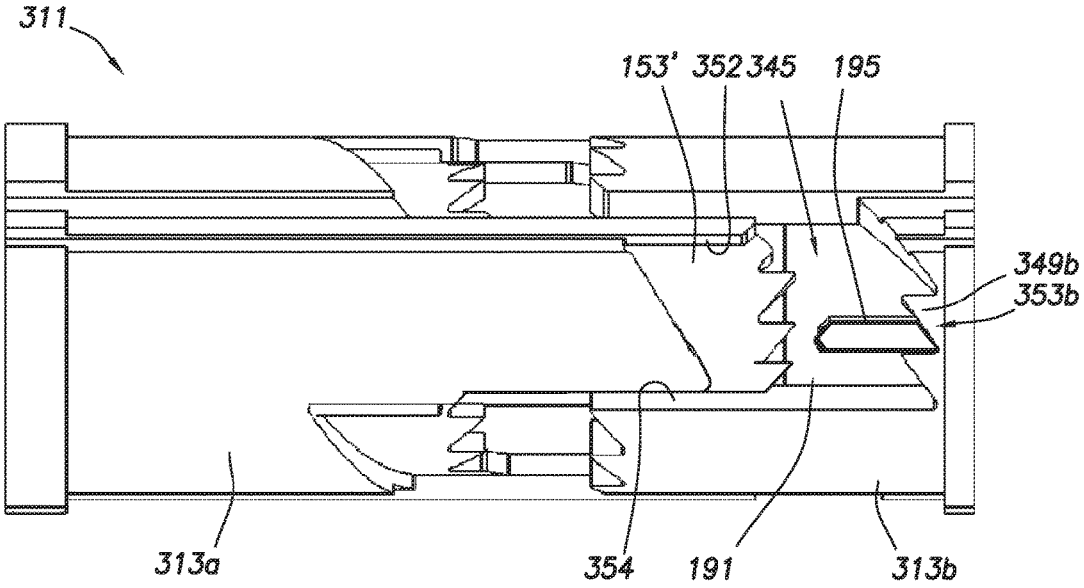
FIG. 34A depicts a partial side view of a downhole tool indexer consistent with at least one embodiment of the present disclosure at a stage in an indexing cycle.
Figure 34B:
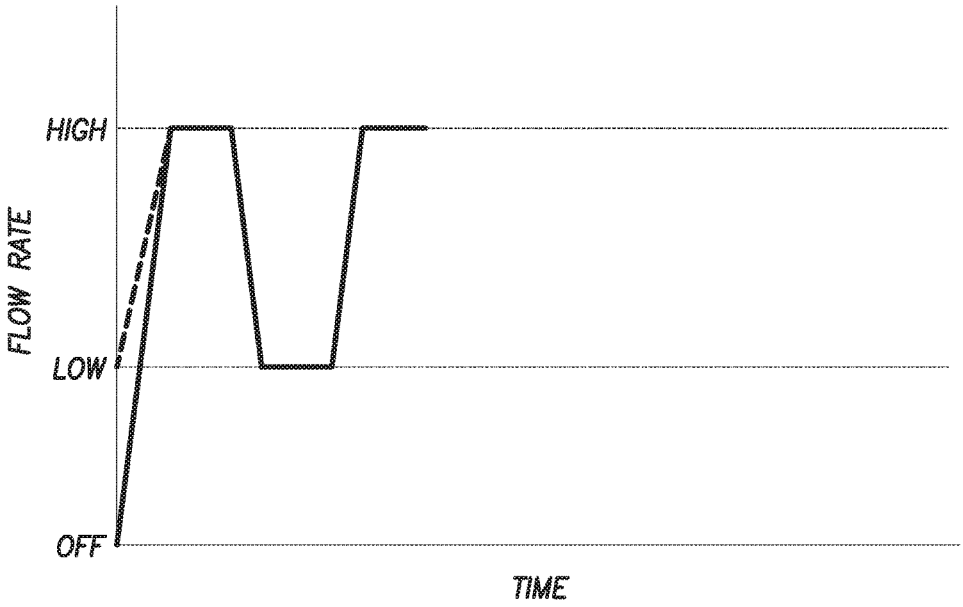
FIG. 34B depicts a chart of fluid flow rates in an indexing cycle.
Figure 35A:
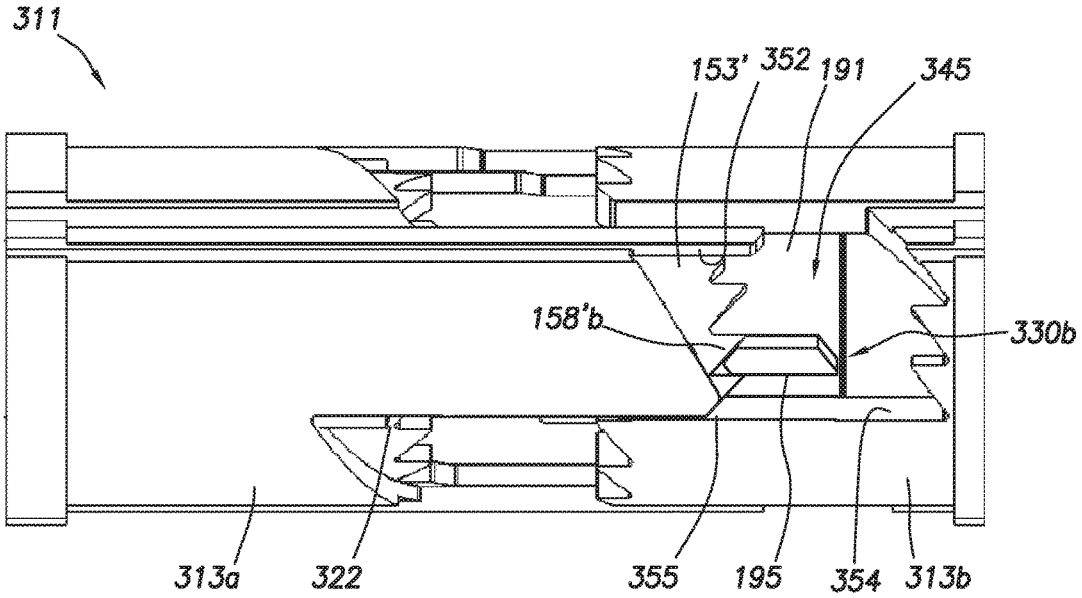
FIG. 35A depicts a partial side view of a downhole tool indexer consistent with at least one embodiment of the present disclosure at a stage in an indexing cycle.
Figure 35B:
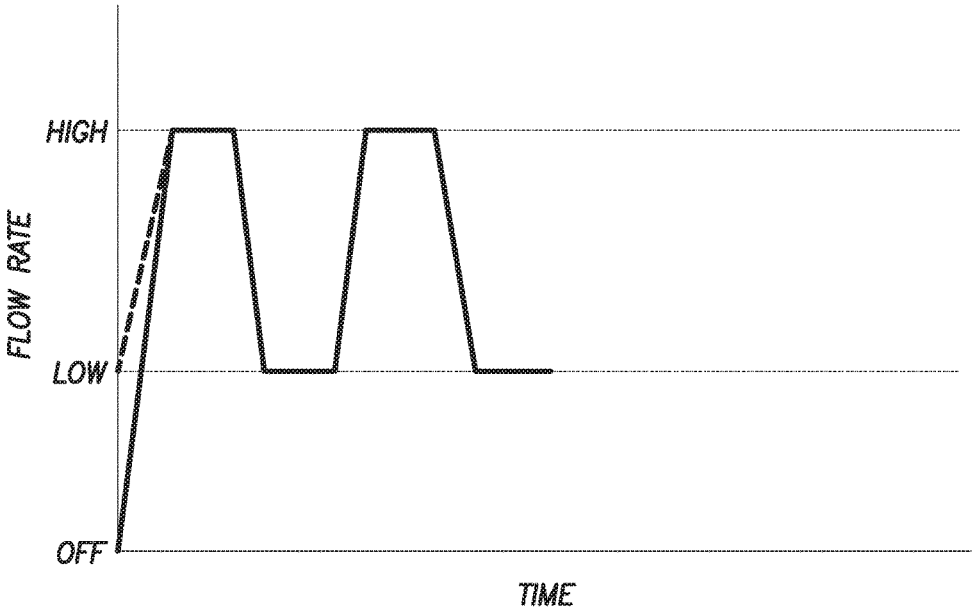
FIG. 35B depicts a chart of fluid flow rates in an indexing cycle.
Figure 36A:
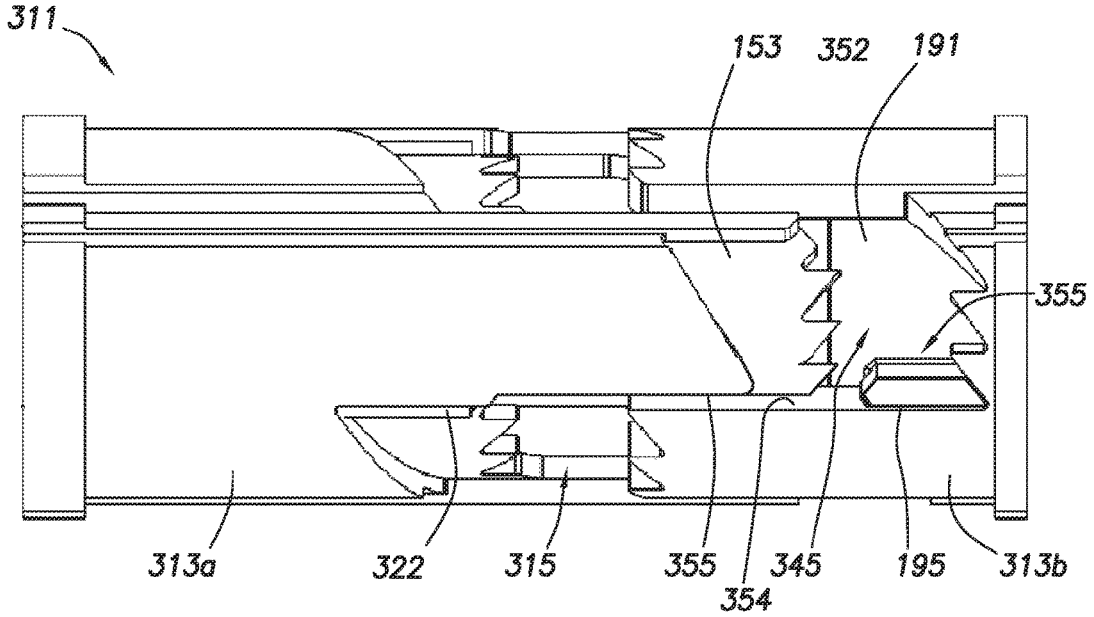
FIG. 36A depicts a partial side view of a downhole tool indexer consistent with at least one embodiment of the present disclosure at a stage in an indexing cycle.
Figure 36B:
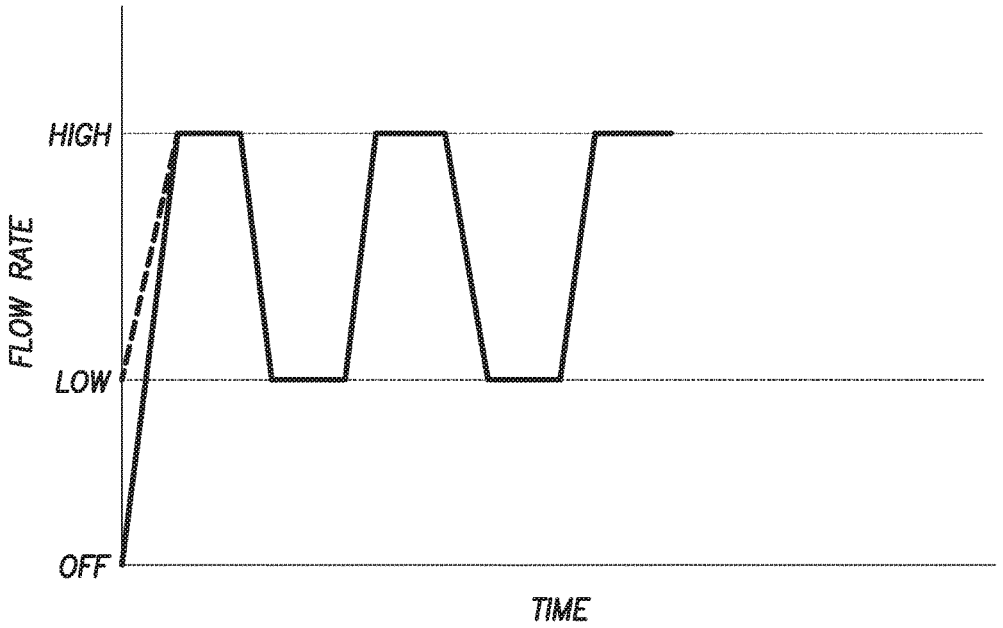
FIG. 36B depicts a chart of fluid flow rates in an indexing cycle.

The flow rate may then be increased to the high flow rate and decreased to the low flow rate causing stroking assembly 181 to shift between the lower high flow ratchet position and the lower low flow ratchet position until spline projection 195 is aligned with second transition slot 355. The number of flow rate steps may depend on the number of lower high flow ratchet teeth 349 and lower low flow ratchet teeth 158'. For example, as depicted in FIGS. 34A, 34B, the flow rate may be increased to the high flow rate such that stroking assembly 181 translates downward and spline projection 195 engages second lower high flow ratchet tooth 349*b* such that spline barrel 191 is rotated toward second exit boundary 354, positioning spline projection 195 in second lower high flow ratchet position 353*b*Downhole tool indexer 100' is thereby positioned in the lower stroke position. The flow rate may then be decreased to the low flow rate such that stroking assembly 181 translates upward and spline projection 195 engages second lower low flow ratchet tooth 158'*b* such that spline barrel 191 is rotated toward second exit boundary 354 as depicted in FIGS. 35A, 35B. Spline projection 195 may thereby be positioned in the second lower low flow ratchet position 330*b*, and downhole tool indexer 100' may be positioned in the lower control position. The flow rate may then be increased to and held at the high flow rate such that stroking assembly 181 translates downward and spline projection 195 engages second lower high flow ratchet tooth 349*b* and spline barrel 191 is rotated toward second exit boundary 354 until spline projection 195 engages second exit boundary 354, thereby positioned in third lower high flow ratchet position 353*b* as depicted in FIGS. 36A and 36B. Downhole tool indexer 100' may thereby be positioned in the lower stroke position. Spline projection 195 may now be aligned with second transition slot 355.

Figure 37A:
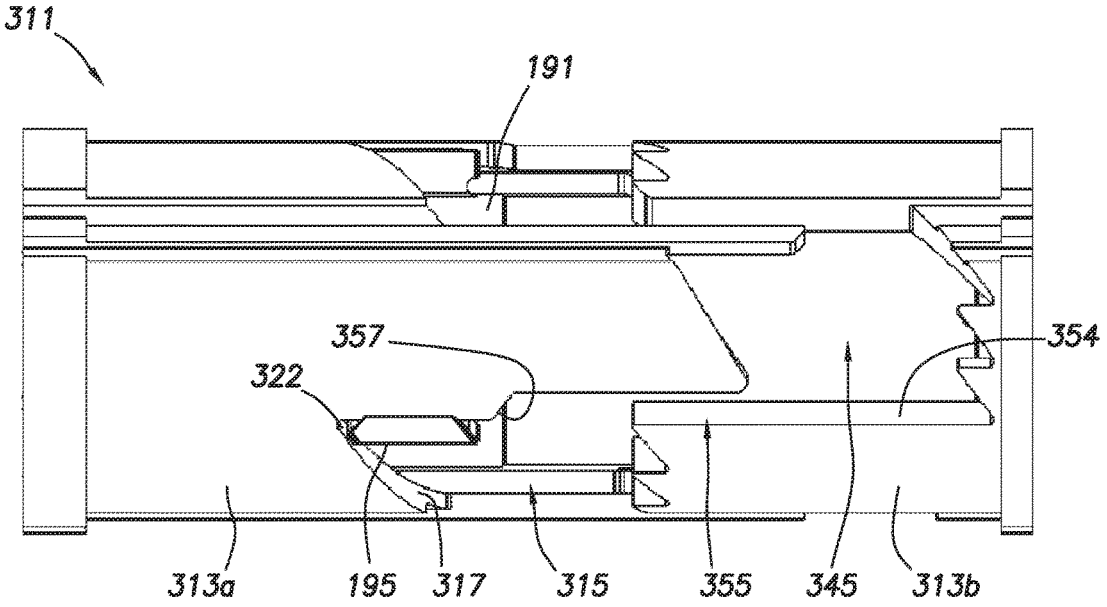
FIG. 37A depicts a partial side view of a downhole tool indexer consistent with at least one embodiment of the present disclosure at a stage in an indexing cycle.
Figure 37B:
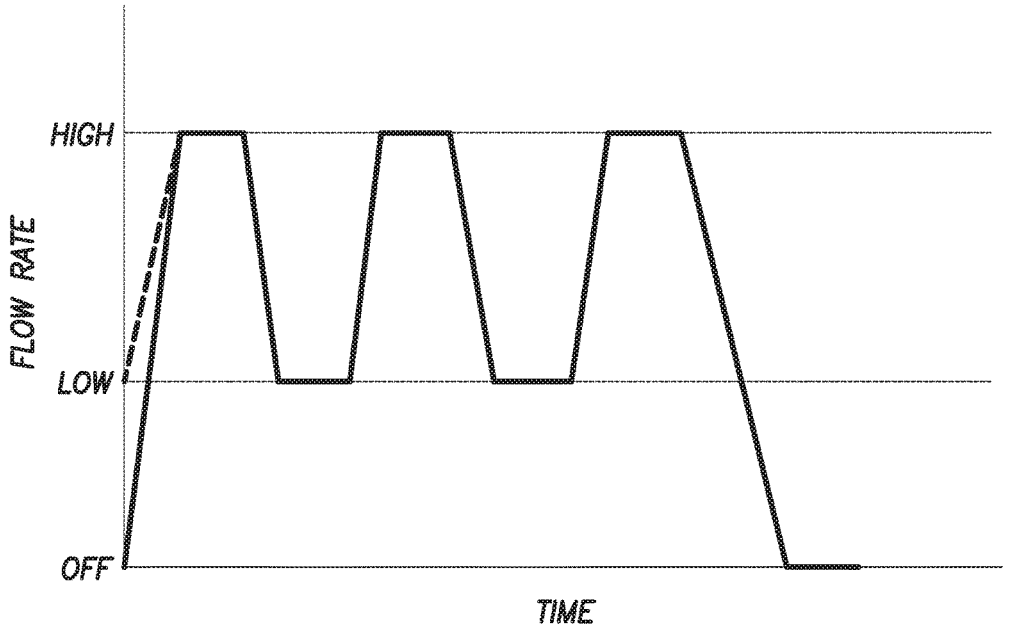
FIG. 37B depicts a chart of fluid flow rates in an indexing cycle.

By lowering the flow rate below the low flow rate or stopping the flow, as depicted in FIGS. 37A, 37B, control assembly 141 may translate to the control reset position and stroking assembly 181 may translate upward such that spline projection 195 moves upward through second transition slot 355 into first spline pocket 315. In some embodiments, spline projection 195 may engage transfer slope 357 which may position spline projection 195 in the upper home position as previously described. Transfer slope 357 may slant upwards towards first spline pocket 315, thereby guiding spline projection 195 out of second transition slot 355 such that spline projection 195 enters first spline pocket 315 and moves to the upper home position, thereby positioning stroking assembly 181 in the upper stroking reset position. In some embodiments, downhole tool indexer 100' may now be positioned in the upper reset position as depicted in FIG. 48A. In some embodiments, the downhole tool indexer 100' may operate in the upper stroking range with one or more inert or stay cycles. In some embodiments, downhole tool indexer 100' may be indexed back to the lower stroking range by completing an indexing cycle as described above.

In some embodiments, a fluid-activated downhole tool 15 may be controlled with downhole tool indexer 100' and valve assembly 900. In some embodiments, as further discussed below, valve assembly 900 may be configured such that valve ports 905 may be positioned relative to housing ports 915 such that fluid communication between valve bore 907 and annular fluid path 913 is opened when stroking assembly 181 is in the lower stroking range.

Figure 41A:
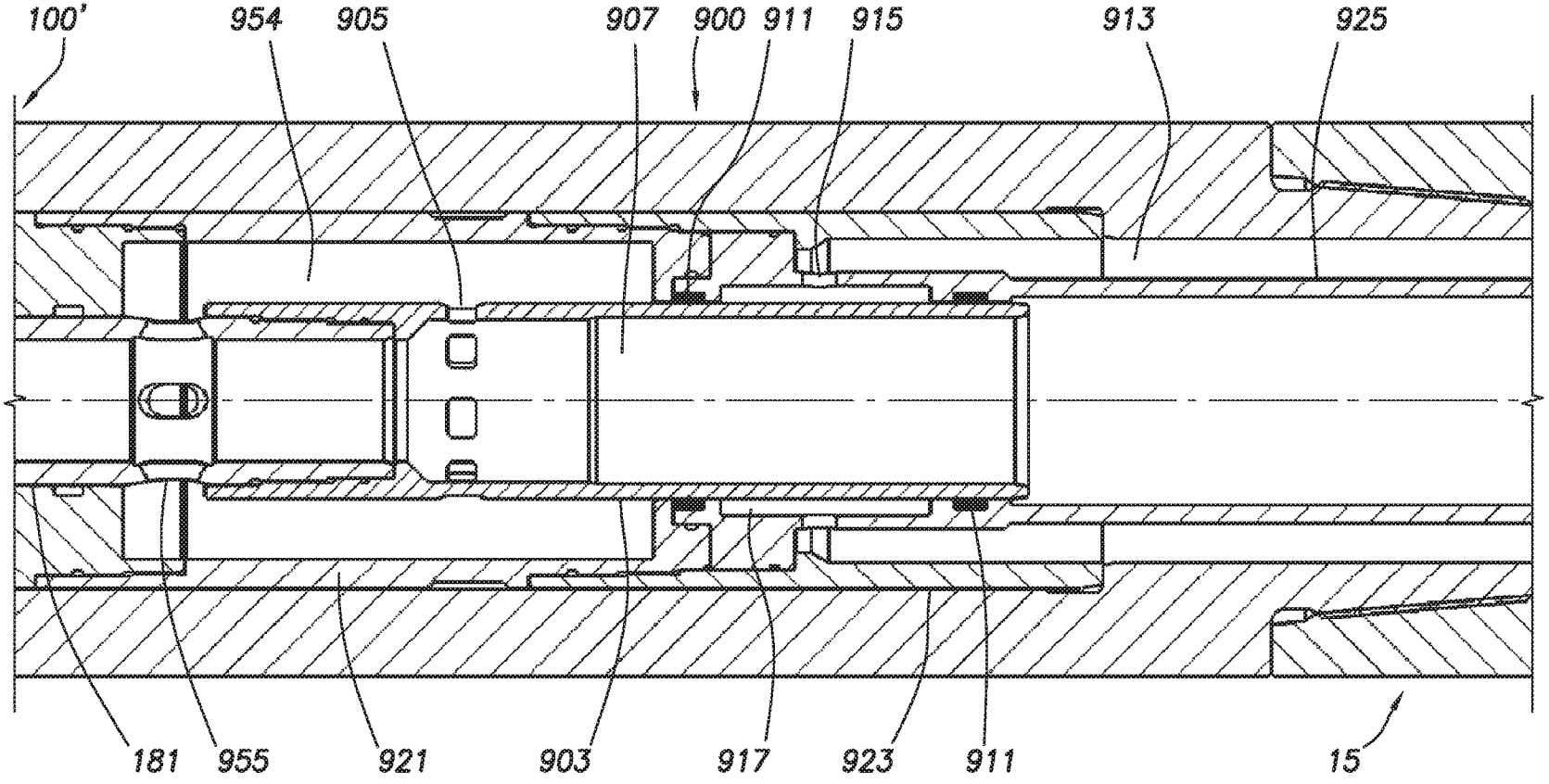
FIGS. 41A-41C and 42A-42C depict partial cross section views of a valve assembly for a downhole tool indexer consistent with at least one embodiment of the present disclosure.

As depicted in FIG. 41A, valve assembly 900 may be used to control fluid flow through annular fluid path 913 located within downhole tool 15. Valve mandrel 903 may be mechanically coupled to stroking piston 187. Outer sub 101 may be mechanically coupled to relief housing 921, which may be mechanically coupled to control housing 923. Control chamber housing 925 may be mechanically coupled to and fixed in place between relief housing 921 and control housing 923. Control chamber housing 925 may contain seals 911. The outer diameter of valve mandrel 903 may provide a sealing face for seals 911. In some embodiments, control chamber housing 925 may include an annular recess between seals 911 defining fluid path chamber 917 about valve mandrel 903. In some embodiments, housing port 915 may fluidly couple fluid path chamber 917 with annular fluid path 913. In some embodiments, relief chamber 954 may be formed within relief housing 921 about valve mandrel 903 and stroking piston 187. In some embodiments, stroking piston 187 may include one or more relief ports 955 to fluidly couple the bore of downhole tool indexer 100' with relief chamber 954.

Figure 41B:
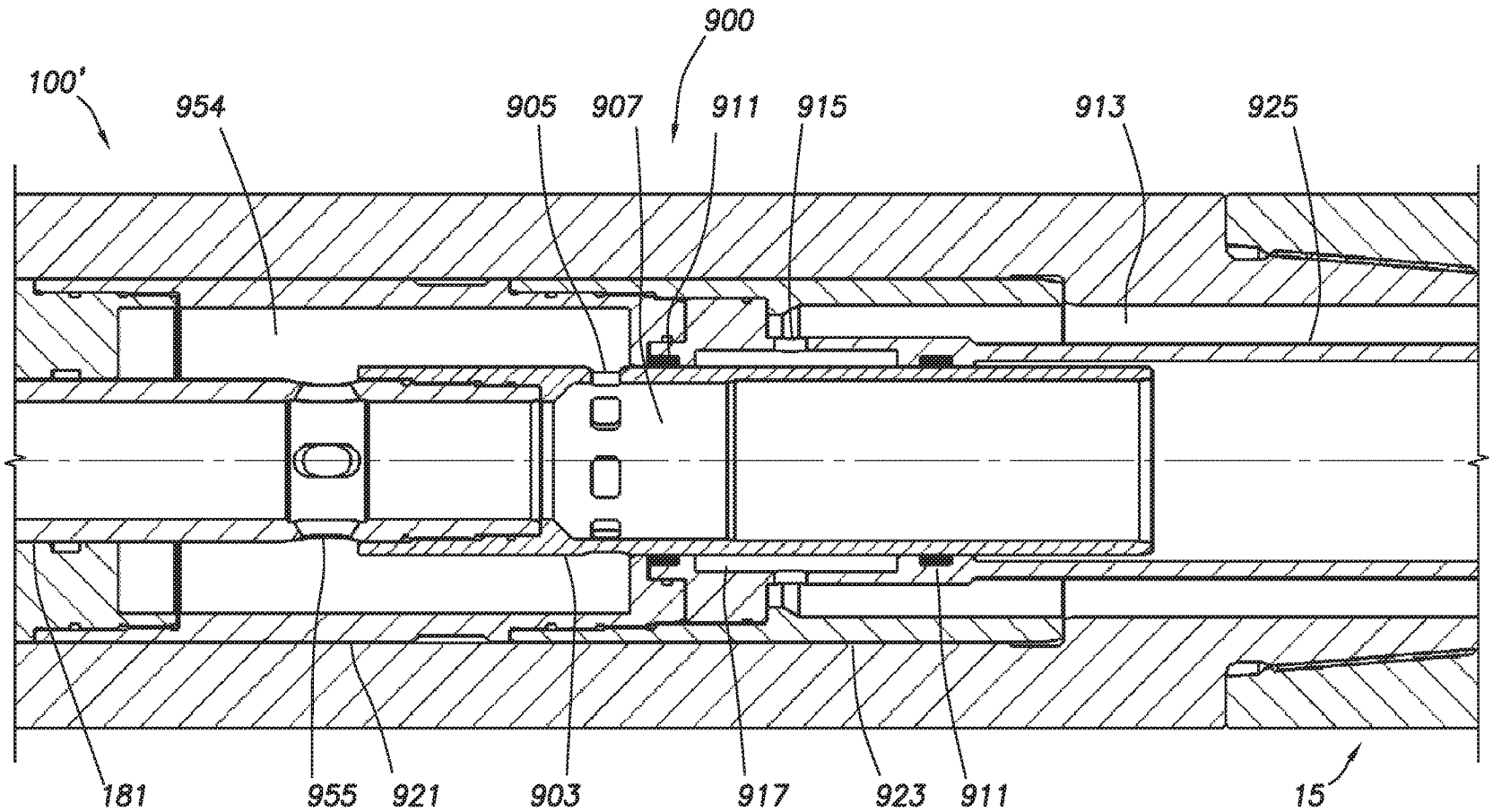
Figure 41C:
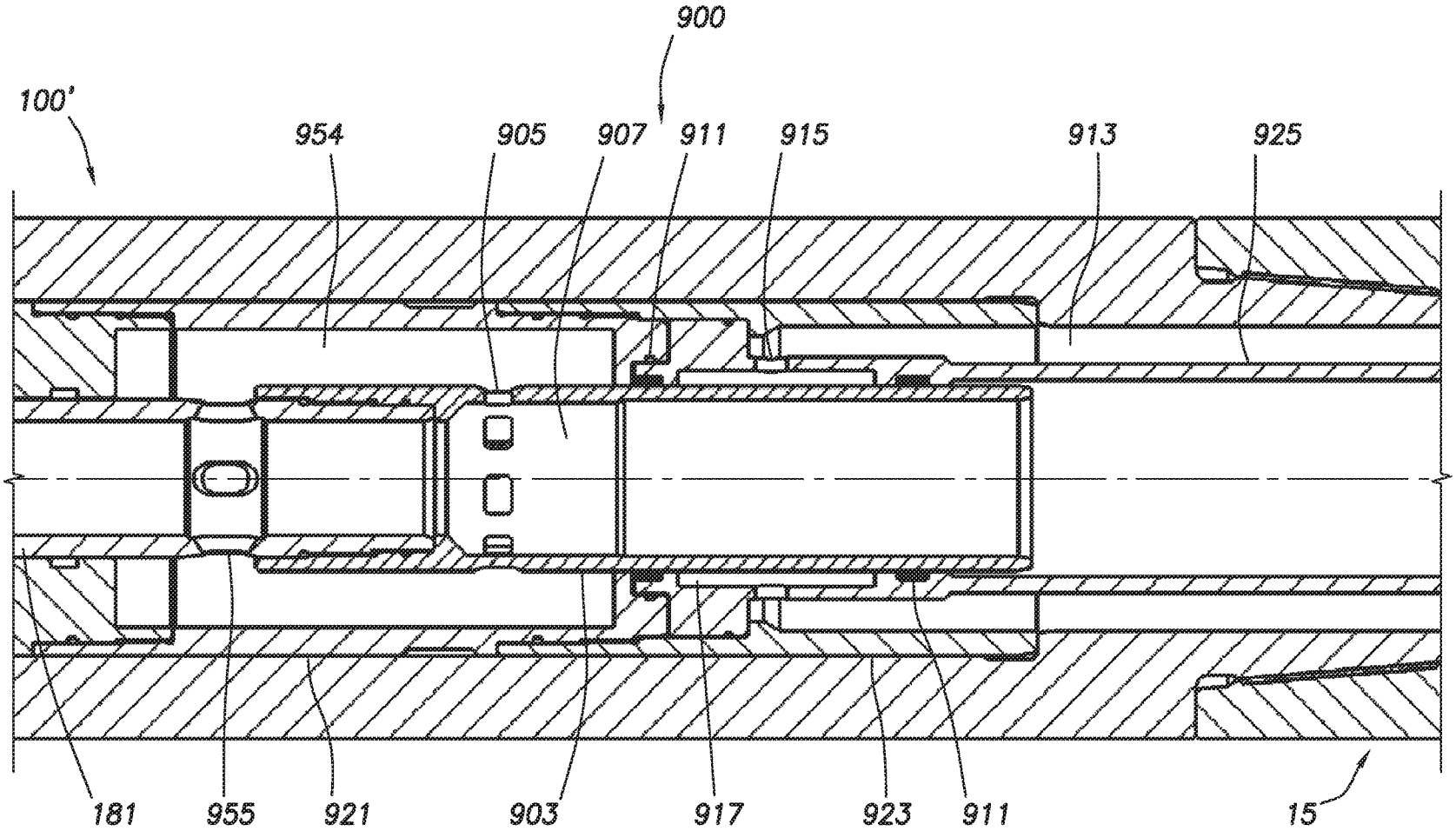
Figure 42A:
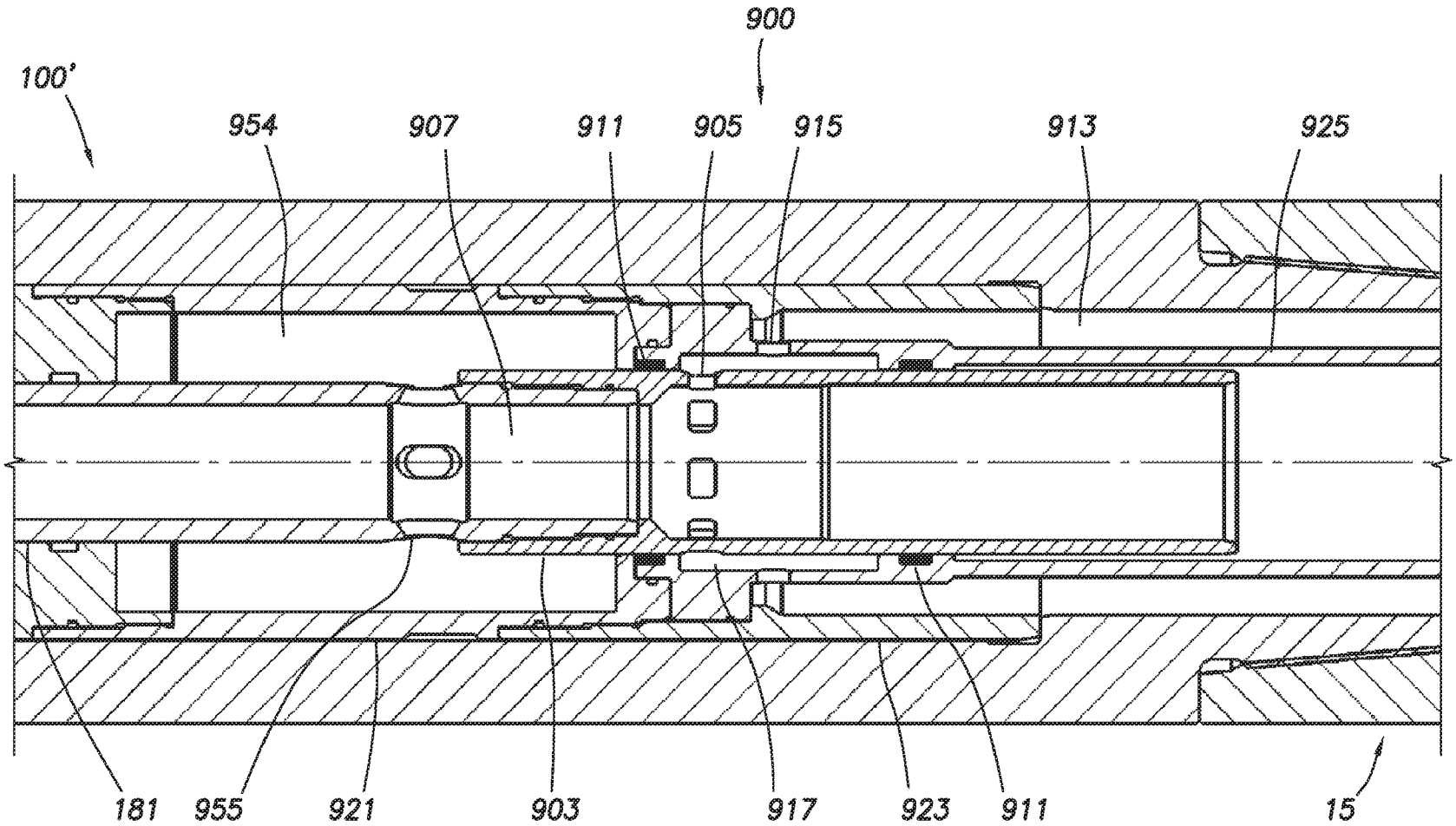

In some embodiments, valve mandrel 903 may be positioned to translate longitudinally relative to control chamber housing 925 as stroking assembly 181 translates through the positions of downhole tool indexer 100' as discussed herein above. In some embodiments, when stroking assembly 181 is in the upper stroking reset position (as depicted in FIG. 41A), upper high flow ratchet position (as depicted in FIG. 41B), or upper low flow ratchet position (as depicted in FIG. 41C) of the upper stroking range, valve mandrel 903 may be positioned to block fluid communication between valve bore 907 and fluid path chamber 917, thereby reducing or preventing fluid flow to annular fluid path 913. In some embodiments, when stroking assembly 181 is in the second stroking range as depicted in FIGS. 42A-C, valve ports 905 may be substantially aligned with fluid path chamber 917, thereby fluidly coupling valve bore 907 and annular fluid path 913, allowing fluid to flow through annular fluid path 913 and activate downhole tool 15.

In some embodiments, downhole tool indexer 100' may be initially set to operate within the upper stroking range, such that downhole tool 15 is operating in the first operational condition. In such an embodiment, a full upper stroking range indexing cycle may be used before valve assembly 900 opens. In such an embodiment, with pumps 14 off, control assembly 141 may be positioned at control reset position and the stroking assembly 181 positioned at the upper stroking reset position. In such a position, depicted in FIG. 41A, valve mandrel 903 may be positioned such that valve ports 905 are not aligned with fluid path chamber 917. In some such embodiments, valve ports 905 may positioned such that valve bore 907 is fluidly coupled to relief chamber 954. In some embodiments, valve mandrel 903 is positioned such that fluid flow from valve bore 907 to annular fluid path 913 is retarded or prevented by seals 911.

Figure 42B:
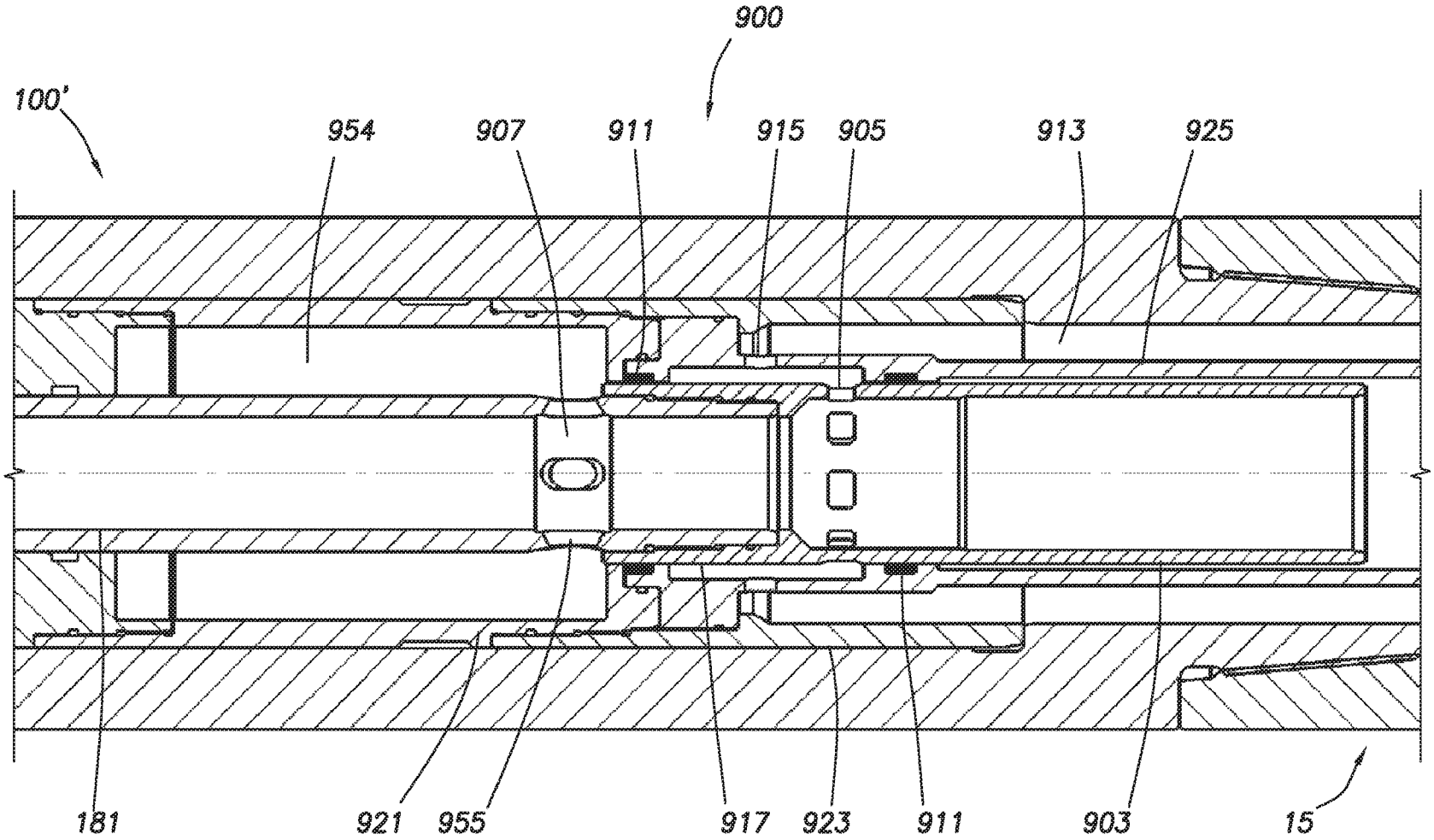
Figure 42C:
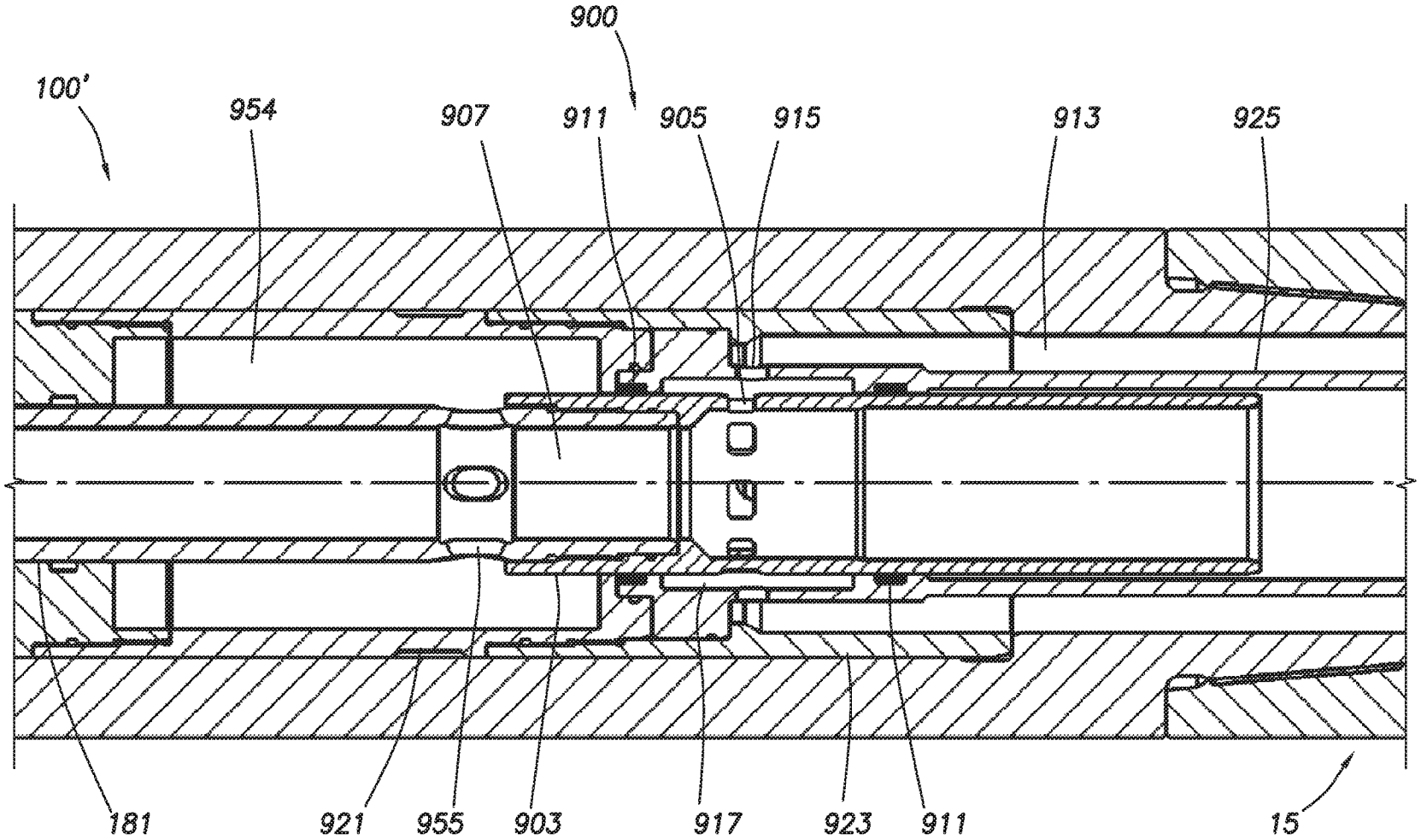

Increasing the flow rate to the high flow rate and decreasing the flow rate to the low flow rate may cause stroking assembly 181 to shift between the upper high flow ratchet position and the upper low flow ratchet position, positioning valve mandrel 903 as depicted in FIGS. 42B and 42C respectively. Once stroking assembly 181 shifts into the lower stroking range with respect to first transition slot 325 and FIG. 13, stroking assembly 181 may operate in the lower stroking range as depicted in FIGS. 42A-C, positioning valve ports 905 in alignment with fluid path chamber 917. Subsequent increases or decreases in flow rate may reposition stroking assembly 181 among the lower stroking reset, lower low flow ratchet position, or lower high flow ratchet position as discussed above, thereby positioning valve mandrel 903 in the positions depicted in FIGS. 42A-C respectively. In each such position, valve ports 905 are aligned with fluid path chamber 917, allowing fluid communication between valve bore 907 and annular fluid path 913 through valve ports 905, fluid path chamber 917, and housing ports 915. A full lower stroking range indexing cycle may be carried out to return stroking assembly 181 to the upper stroking range, thereby closing fluid communication between valve bore 907 and annular fluid path 913.

EXAMPLES

The disclosure having been generally described, the following examples show particular embodiments of the disclosure. It is understood that the example is given by way of illustration and is not intended to limit the specification or the claims. The flow rates, diameters of control pin 123 and control sleeve 146, and mud weight are intended merely as an example of at least one embodiment of the present disclosure.

Example 1

In an exemplary embodiment of downhole tool control apparatus 30, the high flow rate may be selected to be 550 gallons per minute (gpm) and the low flow rate may be selected to be 175 gpm for a mud weight of 10.5 pounds per gallon (ppg). For this example, the pressure drop across components below downhole tool control apparatus 30 is at 1,100 psi at 550 gpm and 110 psi at 175 gpm.

In some such embodiments, reset TFA 149*a* at control reset position between first control sleeve diameter 148*a* and first control pin diameter 124*a* may have an area of 0.54 square inches. Control TFA 149*b* at the control high flow position may have an area of 0.25 square inches. High flow TFA 149*c* at the control high flow position may be active if the control pressure differential across first control sleeve diameter 148*a* bore area is insufficient to allow control piston 145 to compress control piston spring 143. First control sleeve diameter 148*a* bore area is 1.77 square inches.

At the control reset position, the effective area of control piston 145 may be defined between the outer diameter of control piston 145 and first control pin diameter 124*a*, and is 13.38 square inches. At the control high flow position, the effective area of control piston 145 may be defined by the outer diameter of control piston 145, and is 14.60 square inches. At the control high flow position, the effective area of control piston 145 may be defined between the outer diameter of control piston 145 and second control pin diameter 124*b*, and is 13.09 square inches.

The force exerted by control piston spring 143 may vary depending on the position of control piston 145. The force exerted by control piston spring 143 may be approximately 1,630 lb force at the control reset position; approximately 2,300 lb force when fully compressed at the control high flow position; and approximately 2,100 lb force at the control low flow position.

The effective area of stroking piston 187 is defined between upper stroking seal 601 and lower stroking seal 602 and is 9.39 square inches. The force exerted by stroking piston spring 183 varies depending on the position of stroking assembly 181. The force exerted by stroking piston spring 183 is approximately 2,100 lb force at the stroking reset position; approximately 3,120 lb force when at the high flow ratchet position; approximately 2,560 lb force at the low flow ratchet position; and approximately 3,550 lb force at the actuation position.

Example 2

The above figures and parameters will be applied to an example downhole tool control apparatus 30 to illustrate how changes in flow rate settings impact various components and subassemblies at various stages throughout an actuation cycle.

With the downhole tool control apparatus 30 at the reset position, pumps 14 are turned from off to the high flow rate setting of 550 gpm. Fluid flow through reset TFA 149*a* (0.54 square inches) generates a transient control pressure differential of 1,000 psi, which generates a force on control piston 145, having an effective area of 13.38, of approximately 13,400 lbs, which is substantially in excess of the control piston spring 143 force at reset of 1,600 lbs. Control piston 145 compresses control piston spring 143, moving control assembly 141 beyond control pin 123 toward the control high flow position before the high control pressure differential of 1,100 psi can be fully developed. Control assembly 141 moves to the control high flow position. Once in the control high flow position, fluid flow across high flow TFA 149*c* (1.77 square inches) generates a control pressure differential of 93 psi, which acts on the control piston 145 high flow effective area of 14.60 square inches to generate a 1,300 lbs force on control piston 145. This force is insufficient to fully compress control piston spring 143. High flow TFA 149*c* consequently becomes the active flow area for the control pressure differential to act across. Control assembly 141 is not in contact with control piston stop 113, leaving a gap such that control piston spring 143 may compress to a slightly lower force. At 550 gpm, an effective high flow TFA 149*c* of 1.38 square inches generates a control pressure differential of 154 psi which acts on control piston 145 high flow effective area of 14.60 square inches to generate 2,200 lbs of force, which compresses control piston spring 143 such that the control assembly position is approximately 0.22 inches from contacting control piston stop 113.

Under the same conditions, the stroking pressure differential of 1,100 psi acts on the stroking piston 187 effective area of 9.39 square inches to generate a 10,300 lb force on stroking piston 187. This force overcomes the stroking piston spring force of 3,100 lbs such that the stroking assembly 181 moves into the high flow ratchet position. At the high flow rate of 550 gpm, downhole tool control apparatus 30 is positioned at the short stroke position with a control pressure differential of 154 psi and a stroking pressure differential of 1,100 psi.

The fluid flow rates are adjusted from the high flow rate setting of 550 gpm to the low flow rate setting of 175 gpm. The fluid flow reduction reduces the stroking pressure differential from 1,100 psi to 110 psi. The stroking pressure differential of 110 psi acts on the 9.39 inches effective area of stroking piston 187 to generate a 1,000 lb force on stroking piston 187. This force is insufficient to overcome the 3,100 lbs of stroking piston spring 183. Stroking piston spring 183 therefore biases stroking assembly 181 in an upward direction such that spline projection 195 engages low flow ratchet teeth 157 of control assembly 141. The control pressure differential at high flow TFA 149*c* of 1.38 square inches reduces from of 154 psi to 16 psi. The 16 psi control pressure differential acts on the 14.60 square inch effective area of control piston 145 to generate a force of 234 lbs on control piston 145. Being less than the 2,200 lb force of control piston spring 143, the 234 lb force is insufficient to overcome the force of control piston spring 143, allowing control piston spring 143 to bias control assembly 141 in an upward direction toward the control low flow position. Once control assembly 141 reaches the control low flow position, a control pressure differential of 474 psi is generated across the 0.25 square inch control TFA 149*b*. This 474 psi control pressure differential acts on the 13.09 square inch effective area of control piston 145 to generate a 6,200 lb force on control piston 145. The combined 7,200 lb force (6,200 lbs from control assembly 141 and 1,000 lbs from stroking assembly 181) on control assembly 141 and stroking assembly 181 acts in a downward direction against the combined 4,600 lb force (2,100 lbs from control piston spring 143 and 2,500 lbs from the stroking piston spring 183) of control piston spring 143 and stroking piston spring 183 such that control assembly 141 and stroking assembly 181 are held at the low flow ratchet position. Holding the fluid flow rate at the low flow rate of 175 gpm after being previously set at the high flow rate of 550 gpm, downhole tool control apparatus 30 is positioned at the control stroke with a control pressure differential of 474 psi and a stroking pressure differential of 110 psi.

The above examples demonstrate in calculated figures downhole tool control apparatus 30 controlled by high flow rate and low flow rate fluid pump 14 settings to move to short stroke position and control stroke positions, alternating the pumps 14 a number of times between high flow rate and low flow rate may allow the spline projection 195 to work its way through a series of high flow and low flow ratchet teeth to enter the actuation slot 225 such that the downhole tool control apparatus 30 moves to the actuation stroke position as previously described. The calculated figures demonstrate the relationship of control pressure differential and stroking pressure differential as the flow rate alternates between the high flow rate and the low flow rate, when switching from high flow rate to low flow rate the control pressure differential increases and the stroking pressure decreases, when switching from low flow rate to high flow rate the control pressure decreases and the stroking pressure increases.

Example 3

With respect to any embodiment of downhole tool control apparatus 30, the high flow rate and low flow rate parameters may be configurable relative to the required operational flow rate parameters for BHA 17 of drill string 10. A desired flow rate may be required and/or specified for BHA 17 to function which may be referred to herein as the operational flow rate. Downhole tool control apparatus 30 placement relative to BHA 17 along with other operational parameters such as the density and viscosity of the fluid may determine the stroking pressure at the operational flow rate. Downhole tool control apparatus 30 may be configured such that the high flow rate may take form as a minimum flow rate threshold parameter which must be at least achieved or preferably exceeded. Downhole tool control apparatus 30 may be configured such that the threshold for the high flow rate must not exceed and may be equal to or preferably less than the operational flow rate. Downhole tool control apparatus 30 may also be configured such that the stroking assembly 181 translates in downward direction when set at the high flow rate and upward direction when set at the low flow rate as described above. The stroking assembly 181 may contain configurable features including various areas as discussed below to achieve the high flow rate and low flow rate parameters and operational conditions. The control assembly 141 may contain configurable features including reset TFA 149*a*, control TFA 149*b*, high flow TFA 149*c*, control piston diameter 145*a*, first control pin diameter 124*a*, second control pin diameter 124*b*, first control sleeve diameter 148*a* and second control sleeve diameter 148*b* to achieve the high flow rate and low flow rate parameters and operational conditions as described above.

With respect to at least one embodiment of downhole tool apparatus 100 as described above, an example configuration of various parameters of downhole tool control apparatus 30 may be adapted and applied to an example application of BHA 17, these configurations and application are intended merely as an example and do not in any way limit the scope of the present disclosure. The parameters and values described in this example are approximated for readability, but are based on calculations underlying each described parameter. In the exemplary embodiment of downhole tool control apparatus 30, the operational flow rate of BHA 17 may be defined at 550 gallons per minute (referred to hereafter as gpm) with a mud weight of 10.5 pounds per gallon (referred to hereafter as ppg), from which the high flow rate may be selected to be 425 gpm and the low flow rate may be selected to be 150 gpm. For this example, the stroking pressure differential (the cumulative pressure differential across all BHA 17 components positioned below downhole tool control apparatus 30) may be considered 1,100 psi at the operational flow rate of 550 gpm, 650 psi at the high flow rate of 425 gpm and 80 psi at the low flow rate of 150 gpm. These values are representative examples of a typical downhole application and may provide an indication of the relationship between the magnitude of stroking pressure differential at various flow rate settings.

The example application of downhole tool control apparatus 30 may be configured with control pin 123 with first control pin diameter 124*a* of 1.2 inches and second control pin diameter 124*b* of 1.4 inches, control sleeve 146 may be configured with first control sleeve diameter 148*a* of 1.5 inches and a second control sleeve diameter 148*b* of 1.7 inches. When the control assembly 141 is located at the control reset position as depicted in FIG. 3, reset TFA 149*a* may be the flow area between first control sleeve diameter 148*a* and first control pin diameter 124*a* which equates to an area of 0.6 square inches, or the area between second control sleeve diameter 148*b* and second control pin diameter 124*b* which equates to an area of 0.6 square inches such that reset TFA 149*a* of the example configuration may be considered the smallest flow path of 0.6 square inches. When the control assembly 141 is located at the control low flow position as depicted in FIG. 9, control TFA 149*b* may be configured to be at least equal to the area between first control sleeve diameter 148*a* and second control pin diameter 124*b* which equates to 0.2 square inches. The control piston diameter 145*a* may be configured as 4.3 inches. The effective area of control piston 145 when control assembly 141 is located at the control reset position as depicted in FIG. 3 may be 13.3 square inches. The effective area of control piston 145 when control assembly 141 is located at the control high flow position as depicted in FIG. 8 may be the full area of control piston 145, and may be 14.6 square inches. The effective area of control piston 145 when control assembly 141 is located at the control low flow position as depicted in FIG. 9 may be the area of control piston 145 outside second control pin diameter 124*b*, and may be 12.9 square inches. The force exerted by control piston spring 143 in upward direction against control assembly 141 is dependent upon compression relative to the axial position of control assembly 141. With respect to the example configuration, when control assembly 141 is located at the reset position as depicted in FIG. 3, control piston spring 143 may generate 1,600 lb. force. When control assembly 141 is located at the control high flow position, the control piston spring 143 may generate 2,300 lb. force. When control assembly 141 is located at the control low flow position, control piston spring 143 may generate 2,100 lb. force.

The example application of downhole tool control apparatus 30 may be configured with stroking piston 172 with an outer diameter of 4.1 inches and an inner diameter of 2.2 inches, resulting in an effective piston area of approximately 9.3 square inches. The force exerted by stroking piston spring 183 in the upward direction against stroking assembly 181 may be dependent upon compression relative to the axial position of stroking assembly 181. With respect to the example configuration, when stroking assembly 181 is located at the stroking reset position, stroking piston spring 183 may generate 2,400 lb. force. When stroking assembly 181 is located at the high flow ratchet position, stroking piston spring 183 may generate 3,200 lb. force. When stroking assembly 181 is located at the low flow ratchet position, stroking piston spring 183 may generate 2,600 lb. force. When stroking assembly 181 is located at the actuation position, stroking piston spring 183 may generate 3,700 lb. force.

The example application of figures and parameters as described above will be applied to an example embodiment of downhole tool control apparatus 30 in order to, for example and without limitation, demonstrate how high flow rate and low flow rate settings may be derived to suit the example application and how changes in flow rate settings and sequences of flow rate settings may act on downhole tool control apparatus 30 at various stages throughout an actuation cycle.

In some embodiments of downhole tool control apparatus 30, the actuation cycle may commence with pumps 14 initially turned off such that downhole tool control apparatus 30 is in the reset position as depicted in FIG. 2. Pumps 14 may be increased to the low flow rate of 150 gpm which may generate a reset control pressure differential of 54 psi across reset TFA 149*a* which may act on control piston 145 area of 13.3 square inches to generate a force of 722 lbs. acting in downward direction on control assembly 141, which is less than the 1,600 lb. force of control piston spring 143 such that the control assembly 141 remains located at the control reset position. The low flow rate of 150 gpm may generate a stroking pressure differential of 82 psi which may act on the stroking piston 172 area of 9.3 square inches to generate a stroking assembly force of 770 lbs. which is less than stroking piston spring 183 force of 2,400 lbs. such that the stroking assembly 181 remains located at the stroking reset position. Whilst pumps 14 are held at the low flow rate of 150 gpm, a standpipe pressure reading may be recorded as and may describe a reset control pressure differential of 54 psi.

In some embodiments of downhole tool control apparatus 30, progress of the actuation cycle may continue by increasing pumps 14 to the operational flow rate of 550 gpm, generating a stroking pressure differential of 1,100 psi which may act on the stroking piston 172 area of 9.3 square inches to generate a stroking assembly force of 10,000 lbs. which is greater than stroking piston spring 183 force of 2,400 lbs. such that stroking assembly 181 translates in downward direction until spline projection 195 fully engages high flow ratchet tooth 219, halting downward translation of stroking assembly 181 at the high flow ratchet position as depicted in FIG. 33*b*, stroking piston spring 183 may generate a force of 3,200 lbs. at the high flow ratchet position such that the stroking assembly 181 generates a net force in downward direction of 7,000 lbs. which may be transferred through and absorbed by the spline projection 195 (or a plurality of spline projections 195). The example embodiment may be configured with a high flow rate threshold of 425 gpm which may generate a stroking pressure differential of 657 psi which may act on stroking piston 172 area of 9.3 square inches to generate a stroking assembly force of 6,100 lbs. such that stroking assembly 181 generates a net force in downward direction of 2,900 lbs. The high flow rate threshold flow rate may be configured to provide margin for error. For example and without limitation, the example embodiment high flow rate of 425 gpm stroking assembly force of 6,100 lbs. provides an excess force of 3,000 lbs. over what is required to compress the 3,100 lbs. force of stroking piston spring 183 this may allow sufficient margin of force to overcome the frictional effects within downhole tool control apparatus 30 due to seals etc. The excess force may also provide margin for error to allow for inaccuracy in the calculation of the stroking pressure differential which may rely on information from third parties for the pressure differential generated across some components of BHA 17. The margin for error may also allow for changes in BHA 17 configuration which may alter the stroking pressure differential. The example embodiment high flow rate figure of 425 gpm, which is lower than the example operational flow rate of 550 gpm, provides a margin of allowance for the operational flow rate parameter to be reduced if required. The operational flow rate of 550 gpm may generate a reset control pressure differential of 746 psi across reset TFA 149*a* which may act on control piston 145 area of 13.3 square inches to generate a force of 9,900 lbs. which is substantially greater than the 1,600 lb. force of control piston spring 143, such that control assembly 141 may commence translating downwards before the operational flow rate is achieved, such that for the exemplary application, translation may commence as the flow rate exceeds 223 gpm, which may generate a control pressure differential of 123 psi, which may act on control piston 145 area of 13.3 square inches to generate a downward force 1,600 lbs., initiating translation at such a low flow rate may provide substantial margin of safety. The flow area through the first control sleeve diameter 148*a* of 1.5 inches equates to 1.9 square inches, which at the operational flow rate of 550 gpm may generate a control pressure differential of 80 psi, which may act on control piston 145 area of 14.6 square inches to generate a force of 1,100 lbs., which in the example embodiment is insufficient to fully compress the control piston spring 143 such that fluid flow across high flow TFA 149*c* may generate the required control exposed pressure differential. In this scenario, a small gap may exist between control piston stop face 113 and fixed stop face 109 such that control piston spring 143 does not fully compress, for example, at the operational flow rate of 550 gpm, and control assembly 141 may locate at an axial position such that high flow TFA 149*c* of 1.3 square inches may emerge which may generate a control pressure differential of 154 psi which may act on control piston 145 area of 14.6 square inches to hold the control assembly 141 at the control high flow position with a slightly smaller control piston spring 143 force of 2,200 lbs.

In some embodiments, progress of actuation cycle may continue by decreasing pumps 14 from the operational flow rate of 550 gpm to the low flow rate of 150 gpm. The low flow rate of 150 gpm may generate a control pressure differential of 12 psi across high flow TFA 149*c* of 1.3 square inches which may act on control piston 145 area of 14.6 square inches to generate a force of 175 lbs., which is substantially less than the 2,200 lb. force of control piston spring 143 such that control assembly 141 may translate in upward direction towards the control low flow position where fluid flow across control TFA 149*b* of 0.2 square inches may generate control pressure differential of 475 psi which may act on control piston 145 area of 12.9 square inches to generate a downward force of 6,100 lbs., which is in excess of the 2,100 lb. force of control piston spring 143 such that control assembly 141 is held at the control low flow position. The stroking pressure differential may decrease to 82 psi, which may act on the stroking piston 172 area of 9.3 square inches to generate a stroking assembly force of 770 lbs. which is less than the 3,700 lb. force of stroking piston spring 183 such that stroking assembly 181 translates upwards from the high flow ratchet position towards the low flow ratchet position, where spline projection 195 fully engages low flow ratchet tooth 157*a*, stroking piston spring 183 may generate a force of 2,600 lbs. at the low flow ratchet position in the upward direction whilst the stroking assembly force generates a force of 770 lbs. in the downward direction which equates to 1,900 lbs. of force transferred in upward direction from stroking assembly 181 through spline projection 195 to act against control assembly 141, which may combine with control piston spring 143 force of 2,100 to generate a total spring force of 4,000 lbs. Control assembly 141 may generate a force of 6,100 lbs. at the control low flow position which equates to 2,100 lbs. in excess of the total spring force of 4,000 lbs., such that control assembly 141 may translate downward to provide control TFA 149*b* of 0.2 square inches which may generate an control pressure differential of 310 psi which may act on control piston 145 area of 12.9 square inches to generate a force of 4,000 lbs. acting on stroking assembly 141 to balance against the total spring force such that control assembly 141 holds stroking assembly 181 at the low flow ratchet position. The example embodiment was configured with a control TFA 149*b* of 0.2 square inches which is smaller than the required control TFA 149*b* of 0.2 square inches which may provide a margin for error to ensure the control assembly 141 balances the total spring force at the low flow rate. Whilst pumps 14 are held at the low flow rate of 150 gpm, a standpipe pressure reading may be recorded, which may incorporate control pressure differential of 310 psi. The standpipe pressure recording may be 256 psi greater than the previous standpipe pressure recording although both recordings were taken at the low flow rate of 150 gpm but at different stages of the actuation cycle, such that the difference in standpipe pressure may be used as means of confirming progress of the actuation cycle on rig floor as described above.

In some embodiments of downhole tool control apparatus 30, progress of actuation cycle may continue by cycling pumps 14 between the high flow rate and the low flow rate until spline projection 195 enters the actuation slot 225 such that the stroking assembly 181 translates to the actuation position, where the pumps 14 may be held at the high flow rate such that stroking assembly 181 generates a stroking assembly force of 10,300 lbs. (as detailed above), stroking piston spring 183 may generate a force of 3,700 lbs. at the actuation position such that the stroking assembly 181 generates a net force in downward direction of 6,600 lbs. Should pumps 14 be set at the high flow rate, stroking assembly 181 may generate a stroking assembly force in downward direction of 6,100 lbs. (as detailed above) which may provide an excess force of 2,400 lbs. over what is required to compress the 3,700 lb. force of stroking piston spring 183 such that the example configuration provides a margin of safety when stroking assembly 181 locates at actuation stroke.

The example configuration of downhole tool control apparatus 30 described above with a combination of reference application figures and calculated figures illustrate an approximation of the operation of downhole tool control apparatus 30 within an example downhole application, the figures are just one example and may serve as an example for any embodiment of downhole tool control apparatus 30. The figures may serve as example definitions of operating parameters such as the high flow rate and the low flow rate, the figures show how the stroking assembly 181 may be controlled to translate in downward direction when subject to the high flow rate and in upward direction when subject to the low flow rate, the figures show how the control assembly 141 reacts to sequences of flow rate cycles so as to hold the stroking assembly 181 in the low flow ratchet position when subject to a sequence of high flow rate followed by low flow rate, the figures also show how standpipe pressure may be monitored as an indication of progress of an actuation cycle or an indexing cycle. The above example also shows how safety margins may be built into configurations which may ensure or improve reliable operation. The figures illustrate how the stroking pressure differential and control pressure differential respond at various stages of flow rate sequences for example when pumps 14 are set at the high flow rate the stroking pressure differential may be relatively large in magnitude whilst the control pressure differential may be relatively small, after pumps 14 have been reduced from the high flow rate to the low flow rate the stroking pressure differential may reduce from a large figure to a relatively small figure whilst the control pressure differential may increase from a relatively small figure to a relatively large figure.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the scope of the present disclosure.

The invention claimed is:

1. A downhole tool actuator comprising:

an outer sub, the outer sub having an inner surface defining a control apparatus bore;

a control pin, the control pin positioned within the control apparatus bore and mechanically coupled to the outer sub;

a control assembly, the control assembly positioned within the control apparatus bore, the control assembly being tubular and defining a control assembly bore, the control pin positioned at least partially within the control assembly bore, the control assembly including:

a control piston;

a control piston spring, the control piston spring positioned between a dynamic control spring stop of the control assembly and a fixed control spring stop mechanically coupled to the outer sub;

a ratchet mandrel, the ratchet mandrel mechanically coupled to the control piston; and a low flow ratchet sleeve, the low flow ratchet sleeve mechanically coupled to the ratchet mandrel, the low flow ratchet sleeve including one or more low flow ratchet teeth;

a stroking assembly, the stroking assembly positioned within the control apparatus bore, the stroking assembly being tubular and defining a stroking assembly bore, the stroking assembly including:

a stroking mandrel, the stroking mandrel being tubular and defining the stroking assembly bore;

a stroking piston mechanically coupled to the stroking mandrel;

a stroking piston spring positioned between a dynamic stroking spring stop and a fixed spring stop mechanically coupled to the outer sub; and a spline barrel, the spline barrel including a spline projection, the spline barrel coupled to the stroking mandrel such that the spline barrel is rotatable relative to the stroking mandrel; and a pocket assembly, the pocket assembly mechanically coupled to the outer sub, the pocket assembly including a pocket sleeve having a spline pocket formed therein, the spline pocket including a reset slope, a high-flow ratchet tooth, and an actuation slot, the spline projection of the stroking assembly positioned within the spline pocket.

2. The downhole tool actuator of claim 1, wherein the outer sub and control pin define a control pin chamber.

3. The downhole tool actuator of claim 2, wherein the control piston, ratchet mandrel, and outer sub define a control piston chamber.

4. The downhole tool actuator of claim 3, wherein the control piston and control pin define a flow path between the control pin chamber and the control assembly bore, the flow path defining a total flow area.

5. The downhole tool actuator of claim 4, wherein the control piston comprises one or more apertures fluidly coupling the control assembly bore and the control piston chamber.

6. The downhole tool actuator of claim 3, wherein the control piston spring is positioned within the control piston chamber.

7. The downhole tool actuator of claim 1, wherein the stroking mandrel, stroking piston, and outer sub define a stroking chamber.

8. The downhole tool actuator of claim 7, wherein the stroking mandrel comprises a stroking chamber port fluidly coupling the stroking assembly bore with the stroking chamber.

9. The downhole tool actuator of claim 7, wherein the stroking piston and outer sub define a stroking reaction chamber, the stroking reaction chamber fluidly coupled to an exterior of the outer sub by a stroking reaction port.

10. The downhole tool actuator of claim 1, wherein the outer sub comprises a tool coupler.

11. The downhole tool actuator of claim 1, wherein each low flow ratchet tooth comprises a ratchet slope and a stop face.

12. The downhole tool actuator of claim 1, wherein each high flow ratchet tooth comprises a ratchet slope and a stop face.

13. A downhole tool indexer comprising:

an outer sub, the outer sub having an inner surface defining a control apparatus bore;

a control pin, the control pin positioned within the control apparatus bore and mechanically coupled to the outer sub;

a control assembly, the control assembly positioned within the control apparatus bore, the control assembly being tubular and defining a control assembly bore, the control pin positioned at least partially within the control assembly bore, the control assembly including:

a control piston;

a control piston spring, the control piston spring positioned between a dynamic control spring stop of the control assembly and a fixed control piston spring stop mechanically coupled to the outer sub;

a ratchet mandrel, the ratchet mandrel mechanically coupled to the control piston; and a low flow ratchet sleeve, the low flow ratchet sleeve mechanically coupled to the ratchet mandrel, the low flow ratchet sleeve including one or more upper low flow ratchet teeth and one or more lower low flow ratchet teeth;

a stroking assembly, the stroking assembly positioned within the control apparatus bore, the stroking assembly being tubular and defining a stroking assembly bore, the stroking assembly including:

a stroking mandrel, the stroking mandrel being tubular and defining a stroking assembly bore;

a stroking piston mechanically coupled to the stroking mandrel;

a stroking piston spring; and a spline barrel, the spline barrel including a spline projection, the spline barrel coupled to the stroking mandrel such that the spline barrel is rotatable relative to the stroking mandrel; and a pocket assembly, the pocket assembly mechanically coupled to the outer sub, the pocket assembly including:

a reset sleeve, the reset sleeve including a first reset slope and a second reset slope;

a high flow ratchet sleeve, the high flow ratchet sleeve including one or more upper high flow ratchet teeth and one or more lower high flow ratchet teeth, the reset sleeve and high flow ratchet sleeve defining a first spline pocket and a second spline pocket, the reset sleeve and high flow ratchet sleeve defining a first transition slot and a second transition slot between the first spline pocket and second spline pocket, the spline projection of the stroking assembly positioned within the first or second spline pocket; and an orientation spacer, the orientation spacer mechanically coupled to the reset sleeve and the high flow ratchet sleeve.

14. The downhole tool indexer of claim 13, wherein the outer sub and control pin define a control pin chamber.

15. The downhole tool actuator of claim 14, wherein the control piston, ratchet mandrel, and outer sub define a control piston chamber.

16. The downhole tool actuator of claim 15, wherein the control piston and control pin define a flow path between the control pin chamber and the control assembly bore, the flow path defining a total flow area.

17. The downhole tool actuator of claim 16, wherein the control piston comprises one or more apertures fluidly coupling the control assembly bore and the control piston chamber.

18. The downhole tool actuator of claim 15, wherein the control piston spring is positioned within the control piston chamber.

19. The downhole tool actuator of claim 13, wherein the stroking mandrel, stroking piston, and outer sub define a stroking chamber.

20. The downhole tool actuator of claim 19, wherein the stroking mandrel comprises a stroking chamber port fluidly coupling the stroking assembly bore with the stroking chamber.

21. The downhole tool actuator of claim 19, wherein the stroking piston and outer sub define a stroking reaction chamber, the stroking reaction chamber fluidly coupled to an exterior of the outer sub by a stroking reaction port.

22. The downhole tool actuator of claim 13, wherein the outer sub comprises a tool coupler.

23. The downhole tool actuator of claim 13, wherein each low flow ratchet tooth comprises a ratchet slope and a stop face.

24. The downhole tool actuator of claim 13, wherein each high flow ratchet tooth comprises a ratchet slope and a stop face.

25. A downhole tool control apparatus comprising:

an outer sub, the outer sub having an inner surface defining a control apparatus bore;

a control pin, the control pin positioned within the control apparatus bore and mechanically coupled to the outer sub;

a control assembly, the control assembly positioned within the control apparatus bore, the control assembly being tubular and defining a control assembly bore, the control pin positioned at least partially within the control assembly bore, the control assembly including:

a control piston;

a control piston spring, the control piston spring positioned between a dynamic control spring stop of the control assembly and a fixed control spring stop mechanically coupled to the outer sub;

a ratchet mandrel, the ratchet mandrel mechanically coupled to the control piston; and a low flow ratchet sleeve, the low flow ratchet sleeve mechanically coupled to the ratchet mandrel, the low flow ratchet sleeve including one or more low flow ratchet teeth;

a stroking assembly, the stroking assembly positioned within the control apparatus bore, the stroking assembly being tubular and defining a stroking assembly bore, the stroking assembly including:

a stroking mandrel, the stroking mandrel being tubular and defining a stroking assembly bore;

a stroking piston mechanically coupled to the stroking mandrel;

a stroking piston spring positioned between a dynamic stroking spring stop and a fixed spring stop mechanically coupled to the outer sub; and a spline barrel, the spline barrel including a spline projection, the spline barrel coupled to the stroking mandrel such that the spline barrel is rotatable relative to the stroking mandrel; and a spline pocket formed on the inner surface of the outer sub, the spline pocket including a lower boundary, an upper boundary, a reset boundary, and an exit boundary, the lower boundary including a reset slope, the upper boundary including at least one high-flow ratchet tooth, wherein the spline projection of the stroking assembly is positioned within the spline pocket.

26. The downhole tool control apparatus of claim 25, wherein the spline pocket is formed integrally into the inner surface of the outer sub.

27. The downhole tool control apparatus of claim 25, wherein the spline pocket is formed in a pocket sleeve, the pocket sleeve being tubular and mechanically coupled to the inner surface of the outer sub.

28. A downhole tool control apparatus comprising:

an outer sub, the outer sub being tubular, the outer sub having an inner surface defining a control apparatus bore;

a stroking assembly, the stroking assembly positioned within the control apparatus bore, the stroking assembly including:

a stroking mandrel; and a spline barrel, the spline barrel including a spline projection, the spline projection extending radially outward from the spline barrel, the spline barrel coupled to the stroking mandrel such that the spline barrel is rotatable relative to the stroking mandrel; and a spline pocket formed on the inner surface of the outer sub, the spline pocket including a lower boundary, an upper boundary, a reset boundary, and an exit boundary, the lower boundary including a reset slope, the upper boundary including at least one high-flow ratchet tooth, wherein the spline projection of the stroking assembly is positioned within the spline pocket.

29. The downhole tool control apparatus of claim 28, wherein the spline pocket is formed integrally into the inner surface of the outer sub.

30. The downhole tool control apparatus of claim 28, wherein the spline pocket is formed in a pocket sleeve, the pocket sleeve being tubular and mechanically coupled to the inner surface of the outer sub.

31. The downhole tool control apparatus of claim 28, wherein the stroking assembly is tubular and defines a stroking assembly bore.

32. The downhole tool control apparatus of claim 31, wherein the stroking assembly further comprises a stroking piston mechanically coupled to the stroking mandrel and a stroking piston spring positioned between a dynamic stroking spring stop and a fixed spring stop mechanically coupled to the outer sub.

33. The downhole tool control apparatus of claim 32, further comprising a control assembly, the control assembly positioned within the control apparatus bore, the control assembly being tubular and defining a control assembly bore.

34. The downhole tool control apparatus of claim 33, wherein the control assembly comprises:

a control piston;

a control piston spring, the control piston spring positioned between a dynamic control spring stop of the control assembly and a fixed control spring stop mechanically coupled to the outer sub;

a ratchet mandrel, the ratchet mandrel mechanically coupled to the control piston; and a low flow ratchet sleeve, the low flow ratchet sleeve mechanically coupled to the ratchet mandrel, the low flow ratchet sleeve including one or more low flow ratchet teeth.

35. The downhole tool control apparatus of claim 34, further comprising a control pin, the control pin positioned within the control apparatus bore and mechanically coupled to the outer sub.

36. The downhole tool control apparatus of claim 35, wherein the control apparatus further comprises a control sleeve, the control pin positioned at least partially within the control sleeve.

* * * * *